US012351427B2

(12) United States Patent
Bernard et al.

(10) Patent No.: US 12,351,427 B2
(45) Date of Patent: Jul. 8, 2025

(54) PROCESSING MACHINE AND METHOD FOR ACTIVATING AT LEAST ONE ALIGNMENT SEGMENT OF A PROCESSING MACHINE

(71) Applicant: KOENIG & BAUER AG, Würzburg (DE)

(72) Inventors: Andreas Bernard, Sulzfeld (DE); Karl Schäfer, Kürnach (DE); Thomas Schneider, Zell am Main (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 18/866,099

(22) PCT Filed: Aug. 28, 2023

(86) PCT No.: PCT/EP2023/073534

§ 371 (c)(1),
(2) Date: Nov. 15, 2024

(87) PCT Pub. No.: WO2024/068150

PCT Pub. Date: Apr. 4, 2024

(65) Prior Publication Data

US 2025/0171259 A1 May 29, 2025

(30) Foreign Application Priority Data

Sep. 28, 2022 (DE) ..... 10 2022 125 017.2

(51) Int. Cl.
*B65H 9/00* (2006.01)
*B65H 9/10* (2006.01)

(52) U.S. Cl.
CPC ..... *B65H 9/002* (2013.01); *B65H 9/106* (2013.01); *B65H 2701/1762* (2013.01)

(58) Field of Classification Search
CPC ..... B65H 9/002
See application file for complete search history.

(56) References Cited

U.S. PATENT DOCUMENTS 9,637,338 B2 * 5/2017 Nakai ..... B65H 7/10

FOREIGN PATENT DOCUMENTS

DE 69124755 T2 7/1997
DE 10023290 A1 11/2001
(Continued)

OTHER PUBLICATIONS

International Search Report of PCT/EP2023/073534 dated Dec. 13, 2023.

*Primary Examiner* — Howard J Sanders
(74) *Attorney, Agent, or Firm* — Mattingly & Malur, PC

(57) ABSTRACT

Examples include a processing machine for processing a substrate. At least one alignment segment is arranged before at least one processing unit of the processing machine. The at least one alignment segment includes a plurality of transport sections following one another in the transport direction. The at least one alignment segment includes a dedicated drive for axially adjusting at least one of the transport section. The at least one transport section includes at least one first transport sub-section and at least one second transport sub-section in the transverse direction. The first transport sub-section and the second transport sub-section are drivable relative to one another at differing speeds in the circumferential direction. The alignment segment includes a transport section that includes the dedicated drive for axially adjusting the transport section and the transport sub-sections that can be driven relative to one another at differing speeds.

15 Claims, 28 Drawing Sheets

(56) References Cited

FOREIGN PATENT DOCUMENTS

| | | | |
|---|---|---|---|
| DE | 60010027 | T2 | 11/2004 |
| DE | 102008038771 | A1 | 2/2010 |
| DE | 202012100708 | U1 | 4/2012 |
| DE | 102019119372 | A1 | 1/2021 |
| EP | 0849929 | B1 | 7/2009 |
| EP | 2147879 | A2 | 1/2010 |
| EP | 2456698 | B1 | 3/2015 |
| EP | 3015409 | A1 | 5/2016 |
| EP | 2801542 | B1 | 8/2018 |
| EP | 3272683 | B1 | 12/2019 |
| EP | 3663242 | A1 | 6/2020 |
| EP | 3932841 | A1 | 1/2022 |
| KR | 102209606 | B1 | 1/2021 |
| WO | 2016174221 | A1 | 11/2016 |
| WO | 2022106393 | A1 | 5/2022 |

* cited by examiner

PROCESSING MACHINE AND METHOD FOR ACTIVATING AT LEAST ONE ALIGNMENT SEGMENT OF A PROCESSING MACHINE

CROSS-REFERENCES TO RELATED APPLICATIONS

This application is the US national phase, under 35 USC § 371, of PCT/EP2023/073534, filed on Aug. 28, 2023, published as WO 2024/068150 A1 on Apr. 4, 2024, and claiming priority to DE 10 2022 125 017.2 filed on Sep. 28, 2022, and all of which are incorporated by reference herein in their entireties.

TECHNICAL FIELD

Some examples herein relate to a processing machine for processing a substrate, and to a method for activating at least one alignment segment of a processing machine. For instance, the processing machine may include at least one alignment segment that is arranged before at least one processing unit of the processing machine. The at least one alignment segment includes a plurality of transport sections following one another in a transport direction. The at least one alignment segment includes at least one dedicated drive for axially adjusting at least one transport section of the plurality of transport sections. At least two transport sections of the plurality of transport sections include at least one first transport sub-section and at least one second transport sub-section in a transverse direction. The at least one first transport sub-section and the at least one second transport sub-section are drivable relative to one another at differing speeds in a circumferential direction.

In addition, in some examples, the method may include that the at least one alignment segment is arranged before at least one processing unit of the processing machine being activated. A plurality of transport sections of the at least one alignment segment follow one another in a transport direction. At least one dedicated drive axially adjusts at least one transport section of the plurality of transport sections. At least one transport section of the plurality of transport sections includes at least one first transport sub-section and at least one second transport sub-section in a transverse direction. At least one main drive of the at least one first transport sub-section drives the at least one first transport sub-section at a first speed, while at least one main drive of the at least one second transport sub-section drives the at least one second transport sub-section at a second speed. The at least one alignment segment includes at least one transport section of the transport sections, which comprises the at least one dedicated drive for axially adjusting the at least one transport section and the transport sub-sections that can be driven relative to one another at differing speeds in a circumferential direction.

BACKGROUND

Various processing units are used in processing machines, in particular for sheets such as corrugated cardboard sheets. Printing fluid is applied to the sheets by means of at least one application unit and, additionally or alternatively, the mass and/or shape and/or contour of the sheets are modified by way of at least one shaping device. Flexographic printing is one possible application method. Flexographic printing is characterized by a plate cylinder including a flexible printing plate. A die cutter, in particular a rotary die cutter, is usually a possible shaping device. To ensure a high quality of the end product, it is necessary to align the substrate in the processing machine true to register.

The alignment of the substrate is achieved before the substrate reaches a processing unit. The alignment of the substrate is typically carried out in the equipment of the processing machine, that is, before the first processing unit. For example, EP 2 456 698 B1 shows such a processing machine comprising a feeder arranged before the first processing unit. The feeder comprises a lateral driving device for the movement in the lateral direction as well as two longitudinal driving devices for the movement in the longitudinal direction.

In particular due to the substrate being processed by the processing units, or also due to the substrate being transported by transport means, the positioning thereof in relation to an ideal alignment can change along the transport path through the processing machine, in particular after at least one first processing unit.

A processing machine is known from DE 10 2019 119 372 A1, wherein at least one sheet sensor arranged upstream from the application unit is assigned to the application unit, the sheet sensor detecting the arrival time of sheets at the position of the sheet sensor to compensate for color registration errors in the transport direction. However, it is not possible to compensate for errors of the color register in the transverse direction, that is, during a lateral displacement of the sheet, and/or to compensate for errors of the color register due to a skewed position of the sheet.

DE 20 2012 100 708 U1 discloses a die-cutting device comprising a die-cutting cylinder and comprising a feed unit, which is arranged upstream from the die-cutting cylinder and feeds a material sheet to be die-cut to the die-cutting cylinder, and comprising a control system synchronizing the movements of the material sheet and of the die-cutting cylinder. The die-cutting cylinder is continuously rotationally driven at a substantially constant speed. A detection device detecting the position of the material sheet is provided, which is connected to the control system for signal transmission. The control system is configured so as to control the speed of the feed unit based on the signals of the detection device.

EP 2 147 879 A2 discloses a device for aligning the leading edge and side edge of a panel-shaped material, comprising a leading edge alignment device for aligning the leading edge of the material and a side edge alignment device, which comprises at least one roller that has an axis of rotation and is designed as a friction roller and/or as a magnetic roller and/or as a gripper roller, wherein the roller, when carrying out a rotation and conveying the material by way of friction and/or magnetic action and/or gripper action, is guided so as to be displaceable toward the axis of rotation thereof for the side edge alignment.

WO 2022/106393 A1 teaches a processing machine comprising processing units. Suction transport means are provided for transporting substrate, which transport the substrate in a hanging or lying state.

WO 2016/174221 A1 teaches a machine system comprising several processing stations for processing sheets, wherein at least one of these processing stations is embodied as a non-impact printing device. An alignment device is arranged in the transport direction of the sheets between the non-impact printing device and a processing station arranged downstream from the non-impact printing device, wherein this alignment device aligns each of the sheets, at least in terms of their axial register and/or in terms of their circumferential register, true to register relative to a processing position of the processing station arranged downstream from the non-impact printing device.

DE 100 23 290 A1 discloses a printing machine comprising an alignment unit for sheet-format material. Rotation elements which correct an offset of the sheet-format material with respect to the conveying direction thereof and which grip the sheet-format material are accommodated in the alignment unit, with at least two of these rotation elements located in a plane being displaceable relative to the remaining rotation elements.

DE 600 10 027 T2 discloses a method and a device for transversely aligning sheets in front of a printing device. A sheet is fed to two roller pairs, which are arranged next to one another and can be driven separately at different speeds by respective motors, and a skew of the sheet is corrected thereby. A further, downstream transport nip is adjusted by a stepper motor in the transverse direction so as to align the sheet in the transverse direction.

EP 3 932 841 A1 teaches a sheet feeding device of a printing machine. A feed roller pair is provided, which can be moved in a transverse direction perpendicular to a sheet feeding device comprising a clamped sheet.

EP 0 849 929 B1 teaches a printing device comprising an upstream alignment unit for aligning the skewed position of a substrate. Each of two transport rollers, which are parallel in the axial direction, is driven by a dedicated motor at differing speeds to correct the skewed position. At the same time, each of two rollers, which are arranged upstream in the transport direction and arranged one behind the other, is adjusted by a dedicated motor in the axial direction to support the skew correction of the trailing edge of the substrate.

DE 691 24 755 T2 discloses a device for aligning a sheet in a feed path, in particular for consecutively processing paper sheets. A first and a second sheet conveying roller, which are attached in the feed path for the rotation about axes transversely to the feed path, each comprise a drive device for rotatably driving the roller. The driving speed and the driving duration of one of the rollers with respect the other roller can be varied. In addition, a device is provided which can move the first and second sheet conveying rollers transversely with respect to the feed path. Clamping rollers, which, however, are released during the alignment, are arranged upstream from the sheet conveying rollers.

In addition to processing machines, devices for transporting and aligning substrates are known from unrelated technical fields. For example, EP 3 663 242 A1, or also EP 3 272 683 B1, relates to a banknote handling device which carries out a banknote deposit process and/or a dispensing process. A transported bill is aligned transversely to the transport direction and a skewed state is corrected on the path between a collecting station and a dispensing chute. A plurality of transport elements are arranged one behind the other along the transport path and can be axially adjusted based on the substrate being detected by a sensor. EP 3 015 409 A1 also teaches such a device.

DE 10 2008 038 771 A1 shows a device for aligning at least one bill while being transported along a transport segment for use in an automatic teller machine. At least one drive unit displaces a first transport element, which contacts the front side of the bill, together with a second transport element, which contacts the rear side of the bill, transversely to the transport direction of the transport segment. For skew correction, a relative speed is generated between the circumferential speeds of rollers of a roller pair of a transport element.

Likewise, EP 2 801 542 B1 shows a device for aligning a bill on a transfer path which is used in automatic tellers. Activated by a control unit, movable support units are moved in a lateral direction so as to move the bill in a lateral direction. Fixed support units and movable support units successively alternate with one another. However, a processing machine, for example due to the high machine speed or also due to vibrations and oscillations of the machine created, for example, by the processing operation, place special demands on the alignment in order to be able to ensure high-quality processing of the substrates. This is why devices for only transporting and aligning products that are already finished usually cannot be applied to processing machines without design and/or control adaptations.

KR 102209606 B1 discloses a device for correcting meander, comprising a pair of split rolls for transporting strip-shaped substrate. A clutch device is connected to a motor shaft of a driving motor and selectively transmits the driving force of the driving motor to a roll of the pair of split rolls. The clutch is axially adjusted to selectively contact the other roll of the roll pair.

SUMMARY

It is an object of some examples herein to provide a processing machine and a method for activating at least one alignment segment of a processing machine. For example, the processing machine discussed above may include that the at least one alignment segment comprises at least one transport section of the plurality of transport sections, which comprises the at least one dedicated drive for axially adjusting the at least one transport section and the transport sub-sections that can be driven relative to one another at differing speeds in the circumferential direction. At least two first transport sub-sections, following one another in the transport direction, of the at least two transport sections are connected to at least one main drive for driving the at least one first transport sub-section, and at least two second transport sub-sections, following one another in the transport direction, of the at least two transport sections are connected to at least one main drive for driving the at least one second transport sub-section.

Additionally, in some examples, the method discussed above for activating the at least one alignment segment may include that the at least one main drive for driving the at least one first transport sub-section drives at least two first transport sub-sections, following one another in the transport direction of at least two transport sections of the plurality of transport sections and/or that the at least one main drive for driving the at least one second transport sub-section drives at least two second transport sub-sections, following one another in the transport direction, of at least two transport sections of the plurality of transport sections.

A processing machine is created. A method for activating at least one alignment segment of a processing machine is created. Preferably, a method for axially adjusting transport sections of the at least one alignment segment is created.

The processing machine comprises at least one processing unit. The processing machine preferably comprises at least two processing units, which preferably carry out processing operations that differ from one another. Preferably, at least one processing unit, for example a forward processing unit, is designed as an application unit. Preferably, at least one processing unit, for example a succeeding processing unit, is designed as a shaping unit. Preferably, at least one processing unit, preferably designed as a shaping unit, in particular a die-cutting unit, or as an application unit, follows at least one processing unit designed as an application unit in the transport direction of substrate, preferably without further processing units being interposed.

The at least one alignment segment is at least arranged before at least one processing unit of the processing machine. The processing machine comprises the at least one alignment segment. In a preferred embodiment, the at least one alignment segment is preferably arranged between the at least one forward processing unit, preferably the processing unit designed as an application unit, and the at least one succeeding processing unit, preferably the processing unit designed as a shaping unit. Preferably, the at least one processing unit, preferably designed as a shaping unit, in particular a die-cutting unit, or as an application unit, follows the at least one processing unit designed as an application unit in the transport direction of substrate. The substrate is advantageously aligned as close to before a succeeding processing unit as possible, whereby the accuracy of the processing operation is increased. Advantageously, an alignment is carried out between two processing units so as to adjust and/or readjust the alignment of the substrate after at least one first processing operation. Advantageously, the substrate guidance is simplified.

The at least one alignment segment comprises at least one transport section. The at least one alignment segment comprises at least two, preferably at least four, more preferably at least six, in particular a plurality of, transport sections one behind the other and/or following one another in the transport direction. The at least one transport section of the transport sections comprises at least one first transport sub-section and at least one second transport sub-section in the transverse direction. The at least one alignment segment preferably comprises at least one transport unit, preferably at least two transport units. At least one transport unit, preferably of the at least one alignment segment is, preferably at least two transport units are preferably arranged between the at least one processing unit designed as an application unit and the at least one succeeding processing unit, which is preferably designed as a shaping unit, in particular as a die-cutting unit.

Preferably, at least one substrate, in particular sheet, is aligned by the at least one alignment segment. Preferably, an alignment with respect to a skewed position and/or the axial position and/or the position in the circumferential direction relative to a target position is carried out. The accuracy of the alignment of the substrate is advantageously increased while the processing operation is ongoing. Advantageously, the accuracy of the processing operation is thus increased. In this way, the quality of the produced product is advantageously increased. Advantageously, the productivity of the processing machine is increased by the alignment in the at least one alignment segment.

Advantageously, a misregistration of a substrate is corrected while this substrate is being transported along the at least one alignment segment, preferably while being transported by means of the at least one transport unit. Advantageously, the substrate is aligned by the at least one alignment segment in the transport direction and/or in the transverse direction and/or with respect to a skewed position.

An alignment in multiple steps advantageously increases the accuracy of the alignment steps and/or simplifies the activation of the involved components. For example, at least two steps for aligning a substrate are carried out parallel to one another, whereby advantageously faster alignment is achieved.

An alignment of the substrate is advantageously made possible after the substrate has passed through at least one application unit. Advantageously, an alignment of the substrate is carried out, preferably in addition to an alignment in a first unit of the processing machine which, for example, is designed as a substrate feed device, in particular before the at least one shaping unit. In particular, a high accuracy of the processing operation of the substrate is thus achieved by the at least one shaping unit, for example of at least one die-cutting contour, relative to the processing operation of the substrate by the at least one application unit, for example at least one print image.

Advantageously, the alignment of the substrate along the at least one alignment segment is carried out without adversely affecting the processing speed of the processing machine. The processing machine advantageously has a processing speed of at least 8,500 sheets per hour, preferably of at least 9,000 sheets per hour, more preferably of at least 10,000 sheets per hour, more preferably of at least 11,000 sheets per hour, more preferably of at least 12,000 sheets per hour, more preferably of at least 15,000 sheets per hour.

By using the at least one alignment segment in combination with at least one rotary die cutter, the manufacturing costs are advantageously significantly reduced in the direct comparison between production on a flat-bed die-cutter and a rotary die cutter since in particular production management is increased as a result of harmonized format sizes and/or as a result of higher machine speeds and/or since tooling costs are lower.

The at least one alignment segment, preferably the at least one transport unit, in particular the at least one transport section, preferably comprises at least one transport element. In a preferred embodiment, the at least one first transport sub-section and the at least one second transport sub-section each comprise at least one transport element. Each transport section preferably comprises at least one transport element. The substrate is advantageously transported along the transport path by preferably direct contact between the substrate and the at least one transport element.

At least one transport section, in particular the at least one transport element, of the transport sections of the alignment segment is axially adjustable. In this way, the at least one substrate is advantageously aligned in the axial direction, preferably relative to at least one tool of the succeeding processing unit. The at least one alignment segment comprises at least one dedicated drive of at least one transport section of the transport sections. Advantageously, a customized axial adjustment of the transport sections is carried out by the at least one dedicated drive. In particular, the at least one alignment segment comprises at least one dedicated drive for axially adjusting at least one transport section of the transport sections, preferably at least of the at least one transport element. The at least one transport section comprises at least one dedicated drive for axially adjusting the at least one transport section. The at least one transport unit preferably comprises the at least one transport section and at least one further transport section, arranged thereafter and/or therebefore in the transport direction, which each comprise a dedicated drive for the axial adjustment. The at least one dedicated drive is designed so as to axially adjust the at least one transport section of the transport sections. The at least one dedicated drive axially adjusts the at least one transport section of the transport sections.

Advantageously, high accuracy with respect to the positioning of the at least one transport section is achieved by the at least one dedicated drive. Advantageously, the generated movement can be adapted as needed, in particularly with respect to the speed and/or adjustment path. Advantageously, lubrication of a mechanical gear mechanism between the at least one dedicated drive and the at least one transport section is dispensed with. The wear of the mechanical components is advantageously reduced.

The at least one dedicated drive is preferably designed so as to generate an axial force, preferably exclusively an axial force. The at least one dedicated drive is preferably designed so as not to generate torque that generates a rotational movement. The at least one dedicated drive preferably does not generate torque that generates a rotational movement. Advantageously, the accuracy of the adjustment is increased. The wear of the mechanical components is advantageously reduced.

In a preferred embodiment, the at least one alignment segment, preferably the at least one transport unit thereof, comprises at least two, preferably at least four, more preferably a plurality of transport sections, in particular each comprising at least one transport element. The at least two, preferably the plurality of, transport sections are preferably individually axially adjustable or groupwise axially adjustable. The at least two transport sections, preferably the plurality of transport sections, are preferably individually axially adjusted or, alternatively, the at least two transport sections, preferably the plurality of transport sections, are groupwise axially adjusted. In this way, individual alignment of the at least one substrate corresponding to the current position thereof is advantageously achieved. The individual axial adjustment advantageously increases the accuracy of the substrate alignment. The groupwise adjustment advantageously simplifies the activation algorithm and/or reduces the number of required drives. Rapid control with short response times is advantageously achieved by the axial adjustment within groups.

The at least one alignment segment comprises at least one main drive for driving in the circumferential direction, preferably for rotationally, in particular rotatively, driving the at least one transport section. Preferably, the at least one main drive drives all transport sections of a transport unit in the circumferential direction. Advantageously, the at least one main drive enables cost-effective and/or simple driving of the transport sections in the circumferential direction. The at least one alignment segment comprises the at least one main drive for driving in the circumferential direction, preferably for rotationally driving the at least one transport section and the at least one dedicated drive for axially adjusting the at least one transport section. As a result of the at least two drives that are operatively connected to the at least one transport section, these being at least one main drive and at least one dedicated drive, the movement in the circumferential direction, preferably the rotational movement, and the axial movement can advantageously be adjusted independently of one another. This advantageously allows a customized response to the positioning of each substrate that is to be aligned.

The at least one first transport sub-section and the at least one second transport sub-section can be driven, preferably rotationally driven, in particular rotatively driven, relative to one another in the circumferential direction at differing speeds and/or are driven at differing speeds. At least one main drive of the at least one first transport sub-section drives the at least one first transport sub-section at a first speed, while at least one main drive of the at least one second transport sub-section drives the at least one second transport sub-section at a second speed. Advantageously, at least two different speeds can be applied to the at least one substrate within a transport section. Advantageously, a skewed position of the at least one substrate relative to the at least one transport path and/or at least one tool of the succeeding processing unit is thus aligned in a simple manner.

First and second transport sub-sections, in particular first and second transport sub-sections of a transport section, preferably comprise differing main drives. The at least one alignment segment comprises at least one main drive for driving in the circumferential direction, preferably for rotationally, in particular rotatively, driving the at least one first transport sub-section, and/or the at least one alignment segment comprises at least one main drive for driving in the circumferential direction, preferably for rotationally, in particular rotatively, driving the at least one second transport sub-section. The at least one transport section is operatively connected to at least one main drive, the at least one first transport sub-section is preferably operatively connected to the first main drive, and the at least one second transport sub-section is operatively connected to the second main drive. In particular, the at least one main drive generates a movement in the circumferential direction, preferably a rotational, in particular rotative, movement of the at least one transport element.

At least one component of the alignment segment, preferably at least one alignment region of the alignment segment, more preferably at least one transport section, is preferably activated based on ascertained data. Preferably, at least one sensor for substrate alignment is provided along the alignment segment. The at least one alignment segment preferably comprises at least one first sensor for substrate alignment and/or at least one second sensor for substrate alignment and/or at least one third sensor for substrate alignment. For example, as an alternative, at least one sensor for the substrate alignment is arranged at only one position along the transport direction through the processing machine, preferably along the transport direction along the at least one alignment segment. The at least one alignment segment is preferably controlled based on ascertained data, preferably based on the detection of at least one substrate by the at least one sensor for substrate detection. The use of several sensors for substrate alignment at several positions in the transport direction advantageously increases the accuracy of the achievable alignment. A subsequent adjustment of the alignment process is advantageously carried out based on the further sensor detection. At least one sensor for substrate alignment preferably detects at least one image-producing element, preferably at least one printing mark, of the substrate. The alignment is thus advantageously matched to the print image. Advantageously, the accuracy of the alignment is increased compared to an alignment based on a detected edge of the substrate.

The at least one transport section, in particular the at least one transport element, is preferably axially adjusted based on ascertained data, preferably based on the detection of the at least one image-producing element which is preferably designed as a printing mark. The at least one control unit controls by closed loop and/or open loop the at least one dedicated drive for axially adjusting the at least one transport section, preferably based on the ascertained data, preferably based on the detection of the substrate by the at least one sensor for substrate alignment. The activation of the transport sections, and thus in particular the alignment, is advantageously carried out in a customized manner and matched to the particular substrate, in particular the existing positioning thereof.

Preferably, at least one sensor for recognizing a leading edge of substrate is connected to the at least one main drive of at least one transport section of the alignment segment by means of at least one control unit. The activation of the transport sub-sections, and thus in particular the alignment, is advantageously carried out in a customized manner and matched to the particular substrate.

As a preferably additional or separate aspect, the at least one alignment segment comprises at least one, preferably at least two, in particular at least three, in particular three alignment regions. An alignment region referred to as a first alignment region is designed to align a substrate in terms of a skewed position. An alignment region referred to as a second alignment region is designed to align the substrate in terms of axial offset. An alignment region referred to as a third alignment region is designed to align the substrate in the circumferential direction, that is, in the transport direction. The alignment regions of the alignment segment preferably each comprise at least two transport sections following one another in the transport direction. The transport sections of the second alignment region preferably comprise at least the at least one dedicated drive for the axial adjustment. The transport sections of the first and/or third alignment regions preferably comprise at least the at least one main drive for driving in the circumferential direction. The transport sections of the first alignment region preferably comprise the at least two transport sub-sections drivable at differing circumferential speeds. Preferably at least one sensor for substrate alignment, more preferably at least two differing sensors for substrate alignment, are provided, having a data connection to at least one of the drives of at least one of the alignment regions. Advantageously, a particularly precise alignment of the substrate is achieved.

Advantageously, the substrate is aligned in a substrate feed device, preferably by means of at least one fixed or movable stop. Advantageously, the alignment of the substrate by means of the at least one alignment segment is carried out in addition to the alignment in the substrate feed device.

At least one plate cylinder of the succeeding processing unit, which is preferably designed as a shaping unit, preferably a die-cutting unit or as an application unit, preferably comprises at least one drive for axially adjusting the plate cylinder. The plate cylinder preferably additionally comprises at least one drive in the circumferential direction. Advantageously, the relative position of the at least one plate cylinder relative to a substrate to be processed is optimized. Advantageously, an optimal adaptation of the color register is made possible by correctly positioning the plate cylinder in the axial position thereof and/or relative to a master axis value.

Advantageously, at least one sensor for recognizing a leading end, preferably a leading edge, of the substrate is arranged upstream from the at least one processing unit, preferably each processing unit. Preferably, the arrival time of a region of the substrate to be processed and the arrival time of a processing tool of the processing unit at a processing point are adjusted and/or can be adjusted relative to one another, based on this at least one sensor. This sensor is advantageously space-saving, in particular, for example, with respect to image acquisition devices.

Advantageously, the processing machine comprises at least one inspection device, preferably at least one printed image monitoring system and/or at least one color register monitoring system and/or at least one die-cutting monitoring system. The at least one inspection device is preferably connected to at least one drive of the processing machine and/or to at least one sheet diverter for channeling out substrate and/or at least one further component of the processing machine. Preferably, the at least one drive of the processing machine and/or the at least one sheet diverter for channeling out substrate and/or the at least one further component of the processing machine are controlled by open loop and/or closed loop, based on the monitoring of the substrate by the at least one inspection device.

Preferably, the at least one processing unit, preferably the at least one application unit and/or the at least one shaping unit, more preferably each processing unit, in particular an application unit and/or a processing unit succeeding an application unit, comprises at least one drive for axially adjusting the at least one plate cylinder of the processing unit. Preferably, the at least one processing unit, preferably the at least one application unit and/or the at least one shaping unit, more preferably each processing unit, in particular an application unit and/or a processing unit succeeding an application unit, comprises at least one drive in the circumferential direction of the at least one plate cylinder of the processing unit. Advantageously, an adjustment of the plate cylinder of the processing unit in the axial direction and/or in the circumferential direction, preferably the rotational speed thereof, and/or an adjustment for compensating for a skewed position of the plate cylinder are made possible.

BRIEF DESCRIPTION OF THE DRAWINGS

Further advantages are apparent from the following description of the drawings. Exemplary embodiments of the invention are illustrated in the drawings and will be described in greater detail below. The figures show.

DETAILED DESCRIPTION

Figure 1:
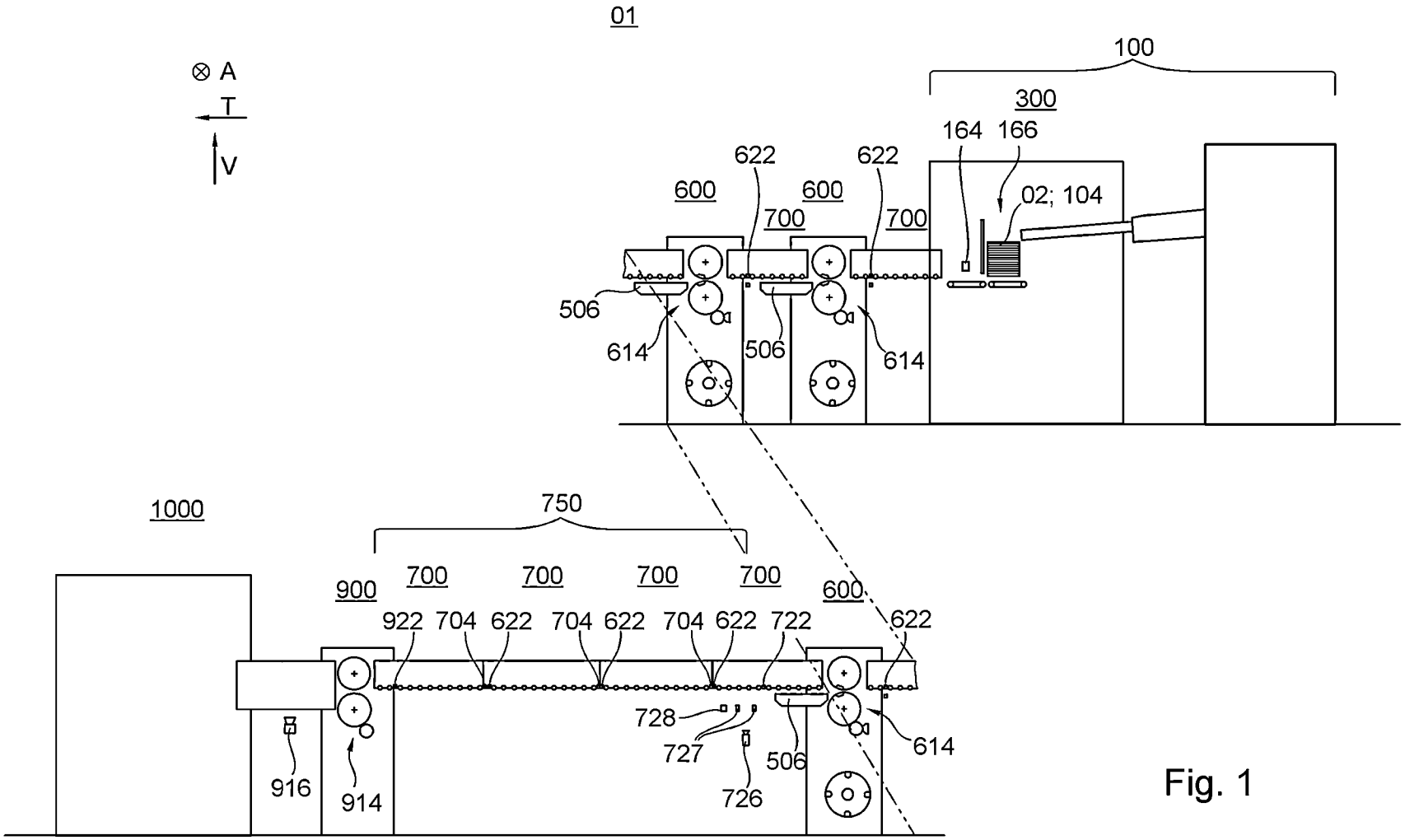
FIG. 1 a schematic representation of a processing machine, which comprises an alignment segment between a last application unit and a shaping unit.
Figure 2:
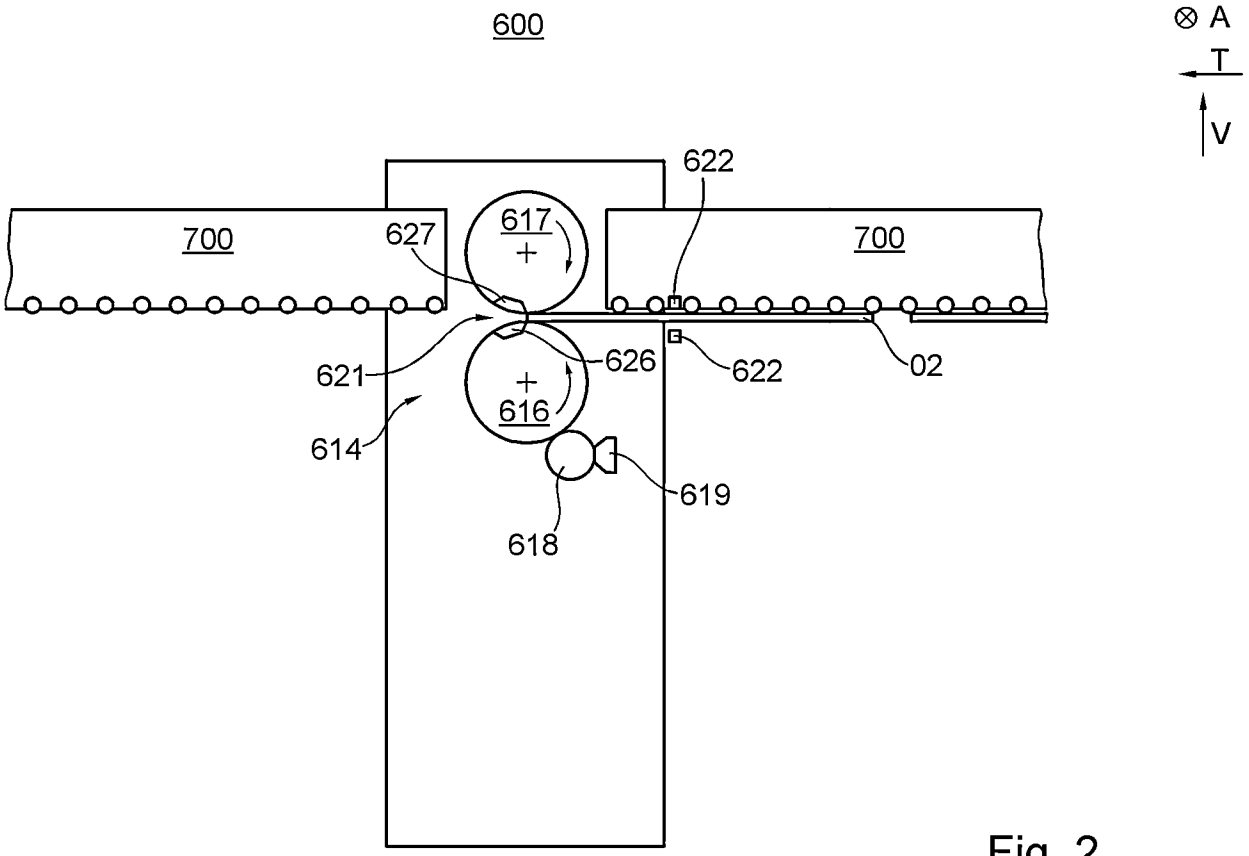
FIG. 2 a schematic representation of an application unit comprising at least one upstream sensor.
Figure 3:
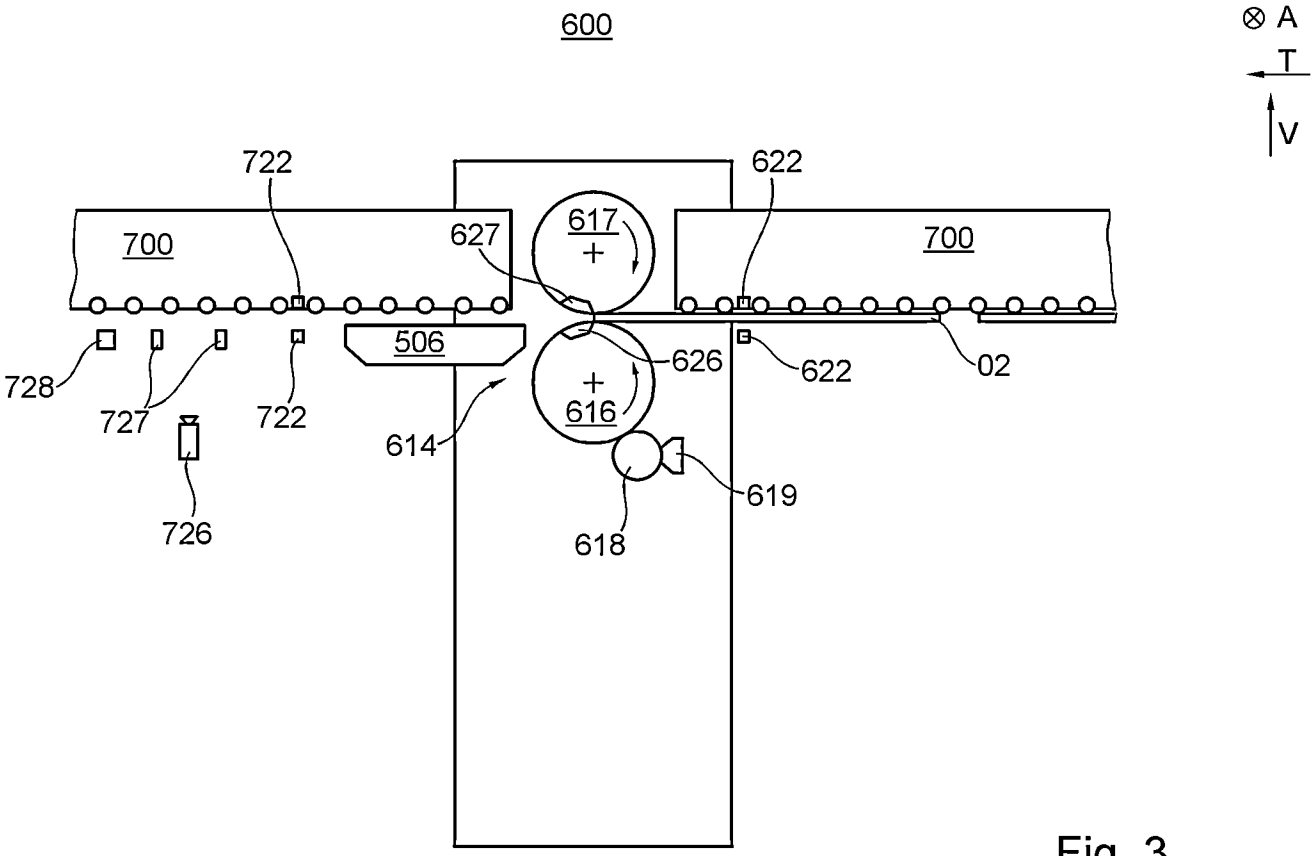
FIG. 3 a schematic representation of an application unit, having a drying device and two inspection devices arranged downstream therefrom.
Figure 4:
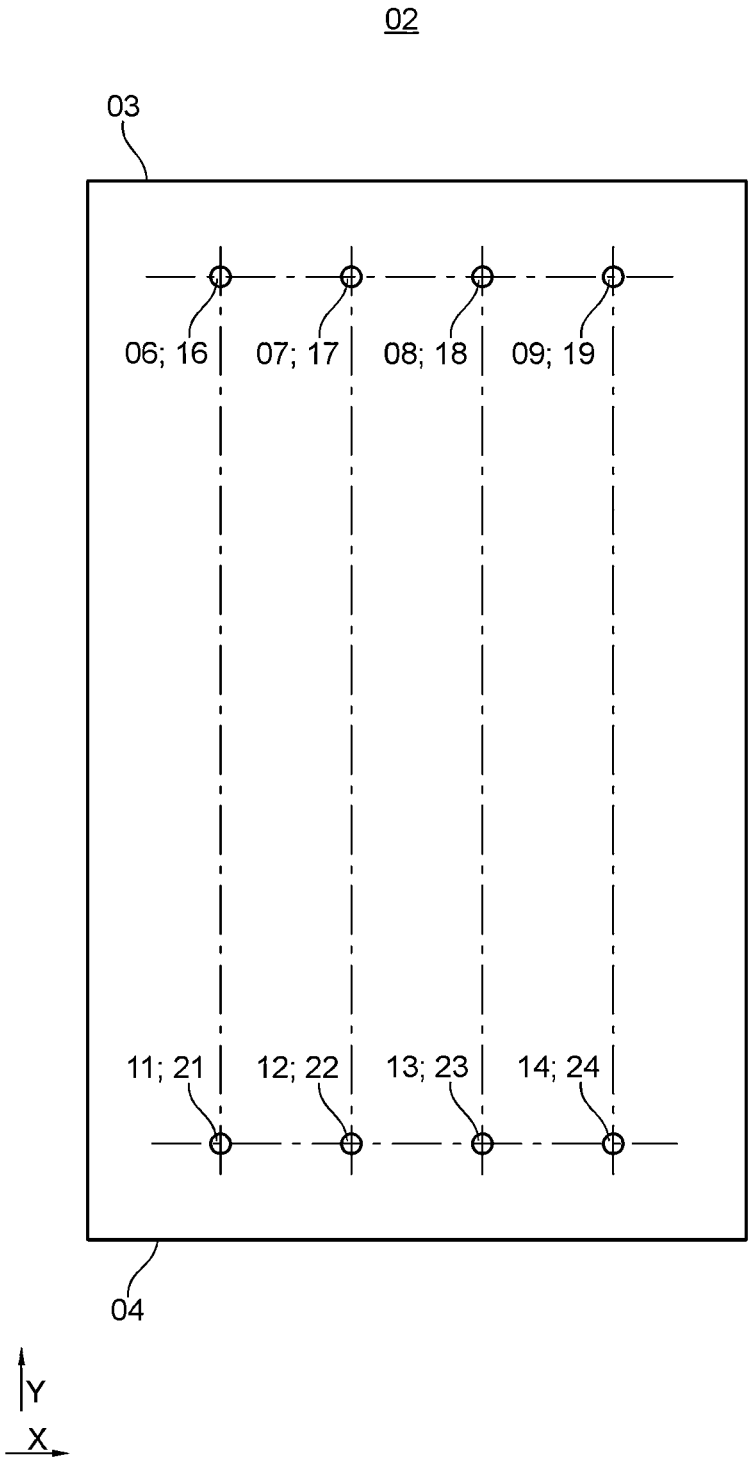
FIG. 4 a schematic representation of a sheet including a first and a second register mark, each arranged in its reference position, for four application mechanisms, for example.
Figure 5:
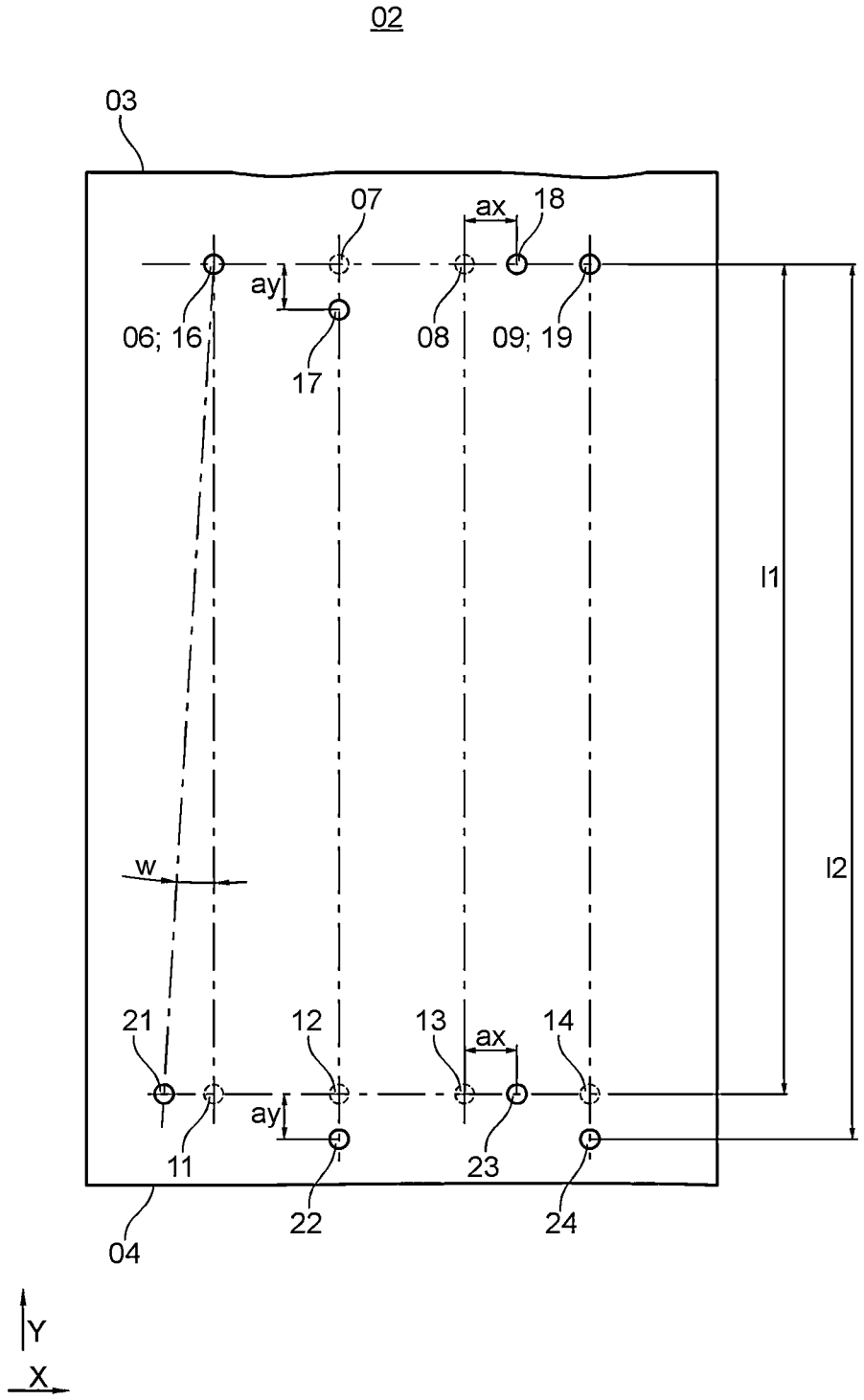
FIG. 5 a schematic representation of a sheet including a first and a second register mark in each case, which deviate from the reference position, for four application mechanisms, for example.
Figure 6:
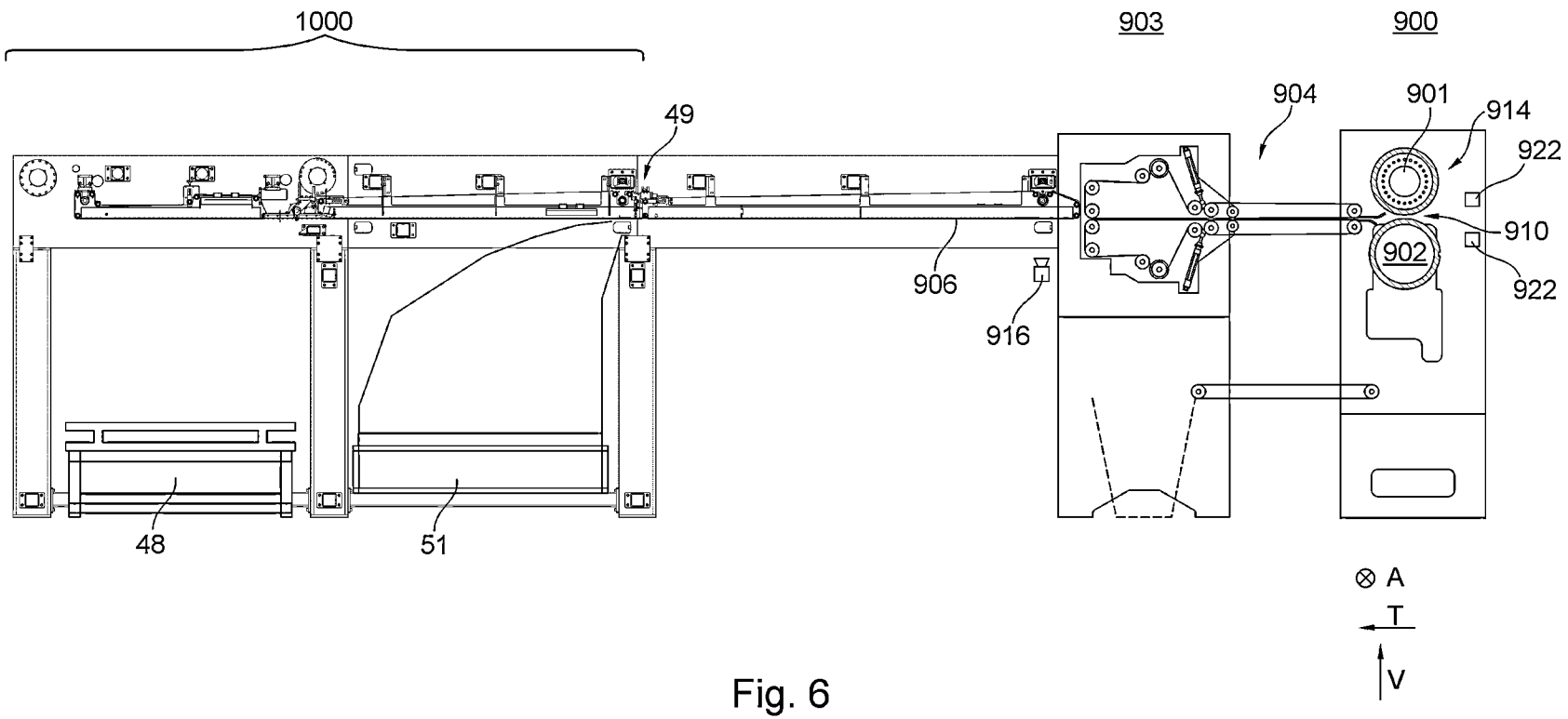
FIG. 6 a schematic representation of a shaping device and of a delivery unit comprising at least one inspection device after the shaping device in the transport direction, wherein a sensor that is arranged upstream from the shaping device is shown.
Figure 7:
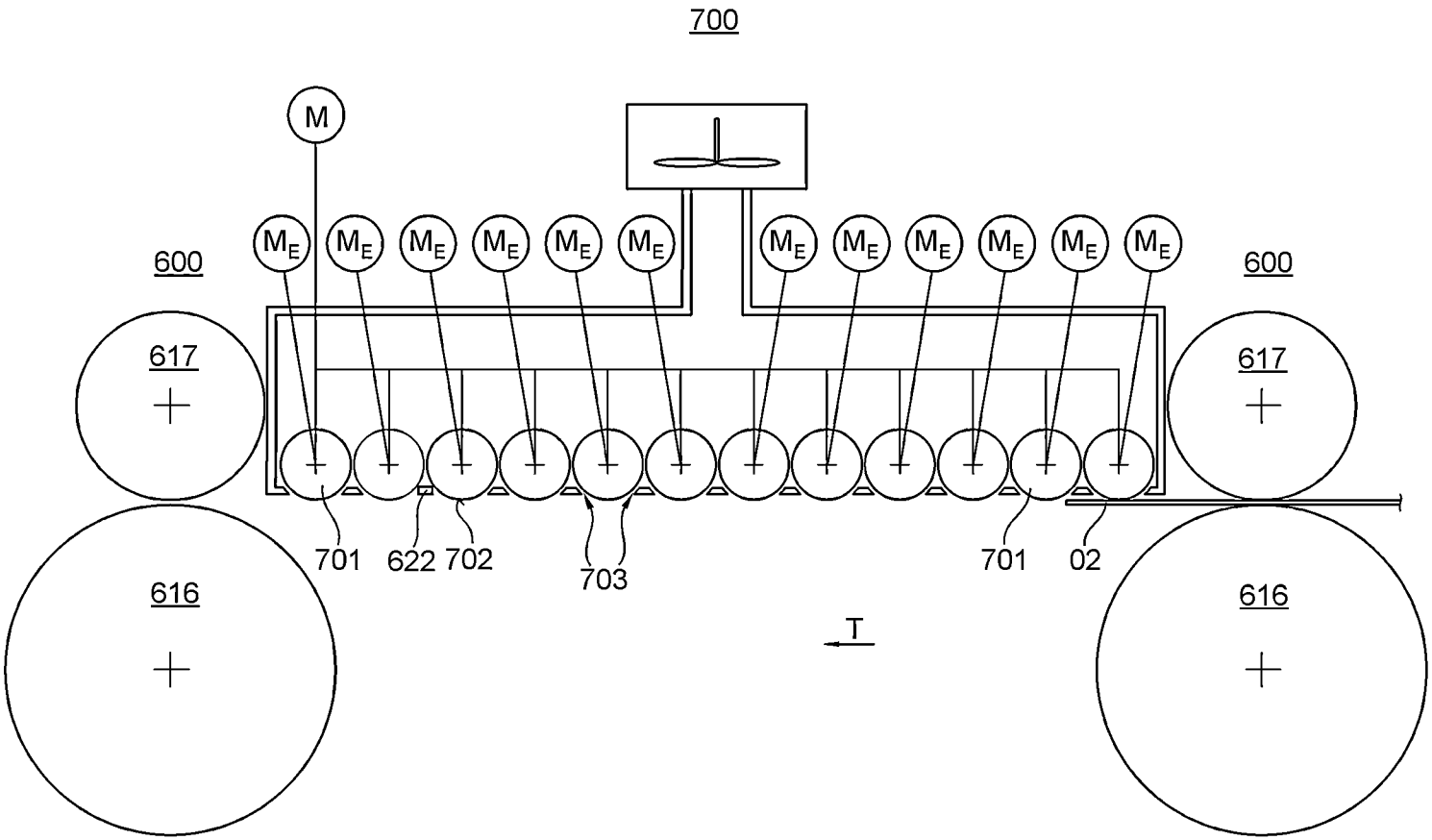
FIG. 7 a schematic representation of an exemplary embodiment of a suction transport means, designed as a roller suction system, between two application units comprising a main drive and several dedicated drives of the transport sections.
Figure 8:
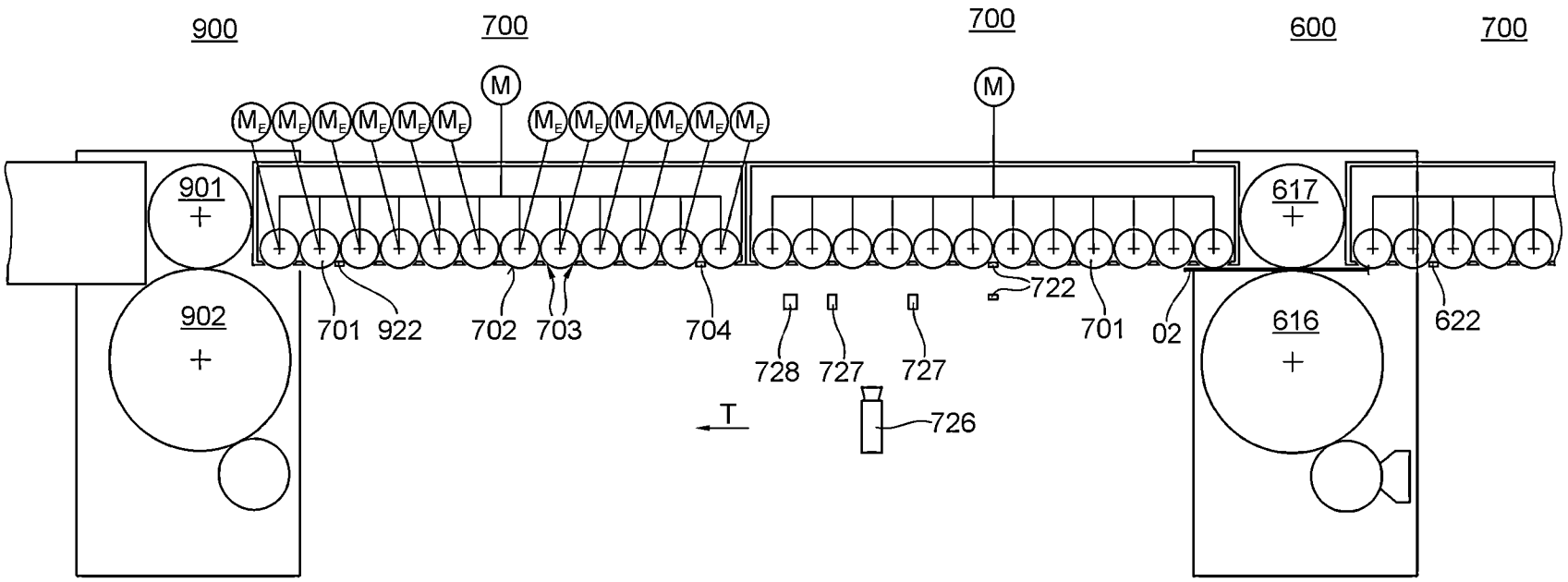
FIG. 8 a schematic representation of an exemplary embodiment of an alignment segment, arranged between an application unit and a shaping unit, comprising a transport unit for aligning substrate, as well as inspection devices, arranged upstream thereof, at a further transport unit.
Figure 9:
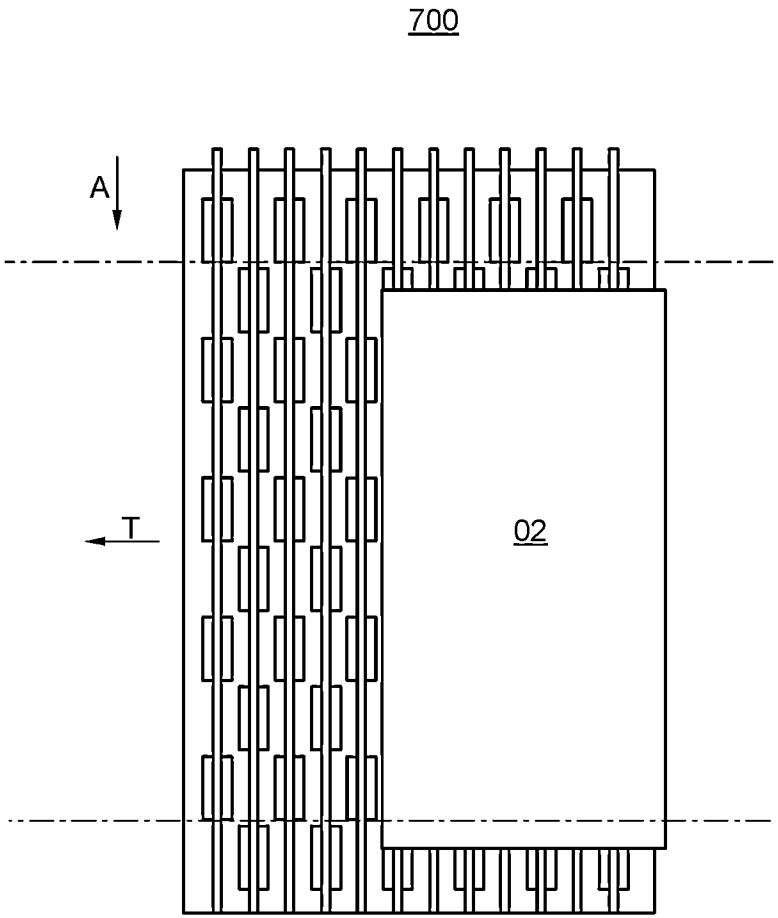
FIG. 9 a schematic representation of a preferred embodiment of an alignment of substrate at an exemplary transport unit of an alignment segment with lateral offset, wherein a substrate with lateral offset arrives at the transport unit.
Figure 10:
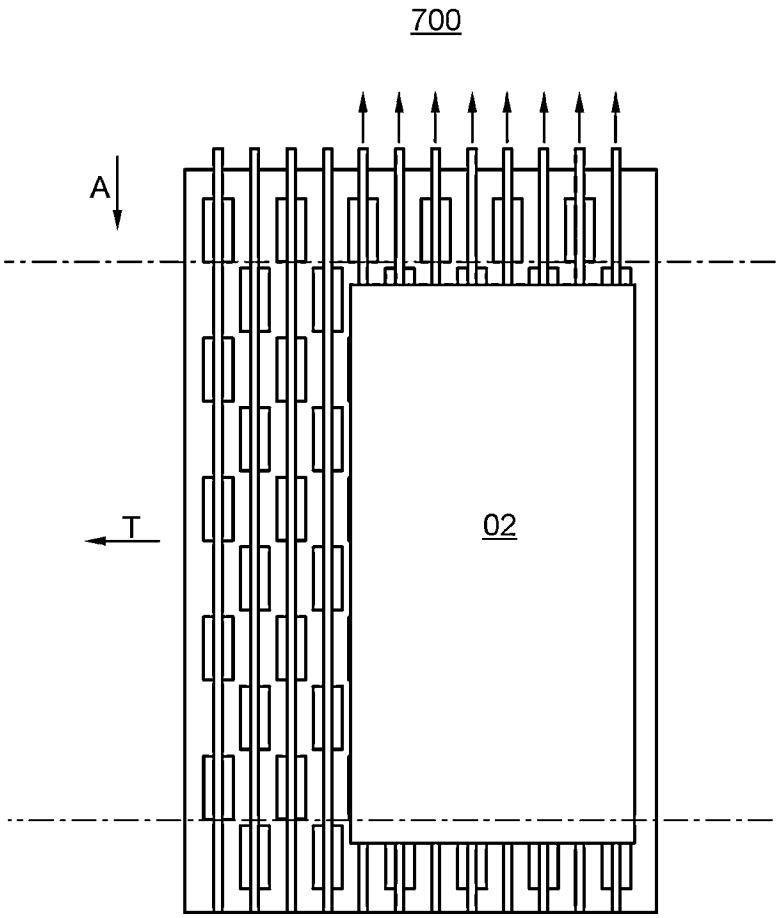
FIG. 10 a schematic representation of the alignment of substrate at a transport unit with lateral offset according to FIG. 9, wherein transport sections in contact with the substrate are being axially adjusted.
Figure 11:
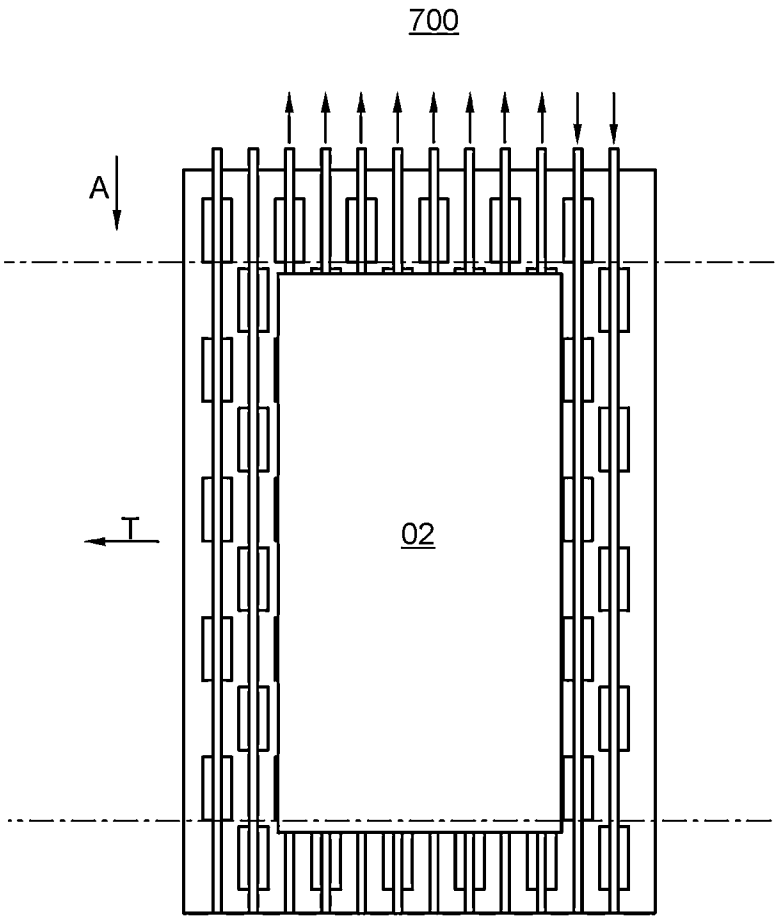
FIG. 11 a schematic representation of the alignment of substrate at a transport unit with lateral offset according to FIG. 9 and FIG. 10, wherein transport sections in contact with the substrate are being axially adjusted, and wherein transport sections no longer in contact with the substrate are returned into a starting position from the adjusted position.
Figure 12:
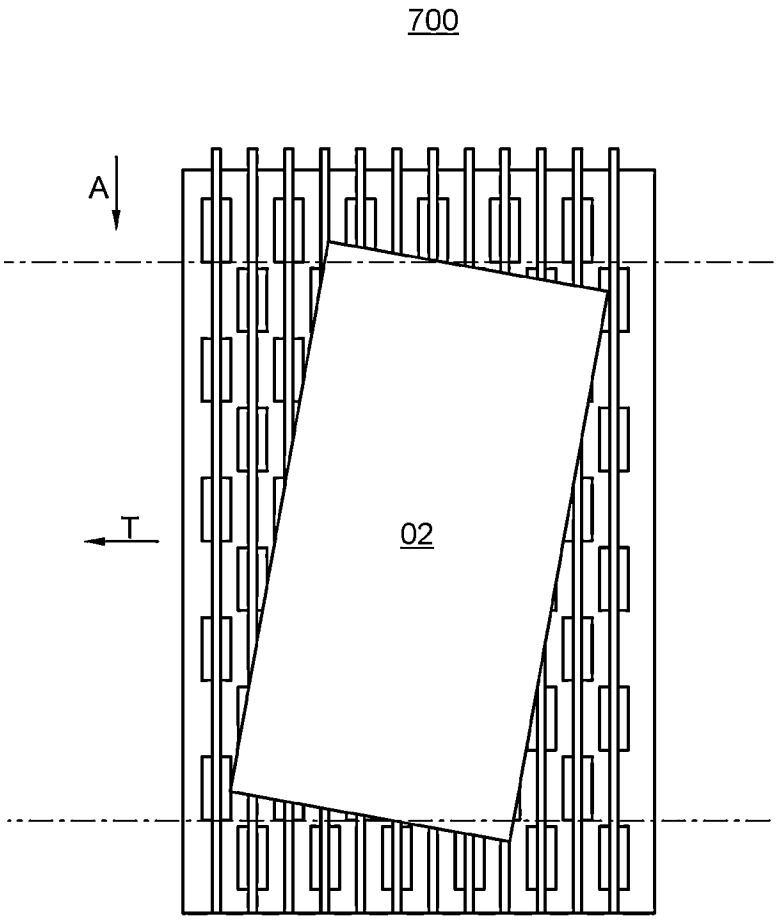
FIG. 12 a schematic representation of a preferred embodiment of an alignment of substrate at an exemplary transport unit of an alignment segment with the substrate in a skewed position, wherein the at least one transport section is coupled to a main drive and wherein a substrate arrives at the transport unit in a skewed position.
Figure 13:
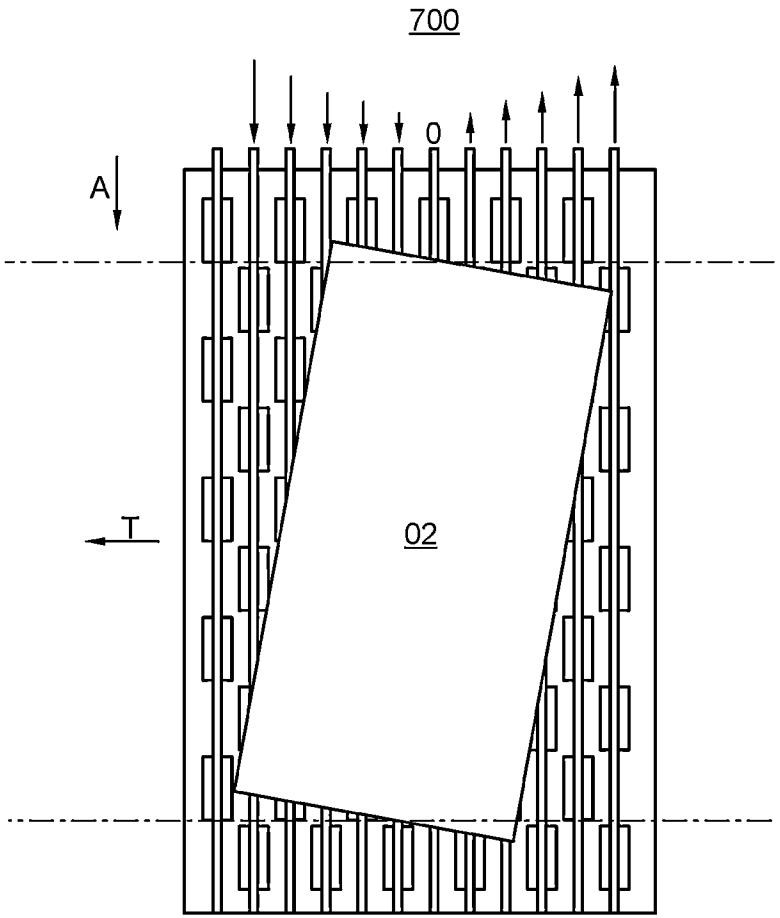
FIG. 13 a schematic representation of the alignment of substrate at a transport unit in the case of a skewed position of the substrate according to FIG. 12, wherein transport sections are being axially adjusted to compensate for the skewed position.
Figure 14:
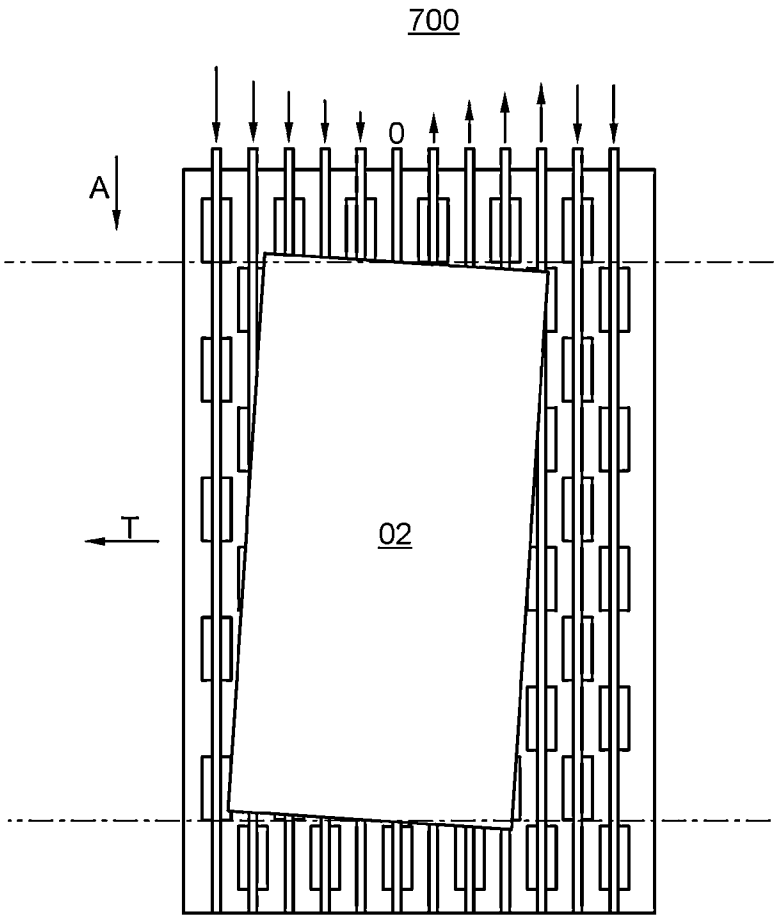
FIG. 14 a schematic representation of the alignment of substrate at a transport unit in the case of a skewed position of the substrate according to FIG. 12 and FIG. 13, wherein transport sections are being axially adjusted to compensate for the skewed position, and wherein a transport section that is no longer in contact with the substrate is returned into a starting position from the adjusted position.
Figure 15:
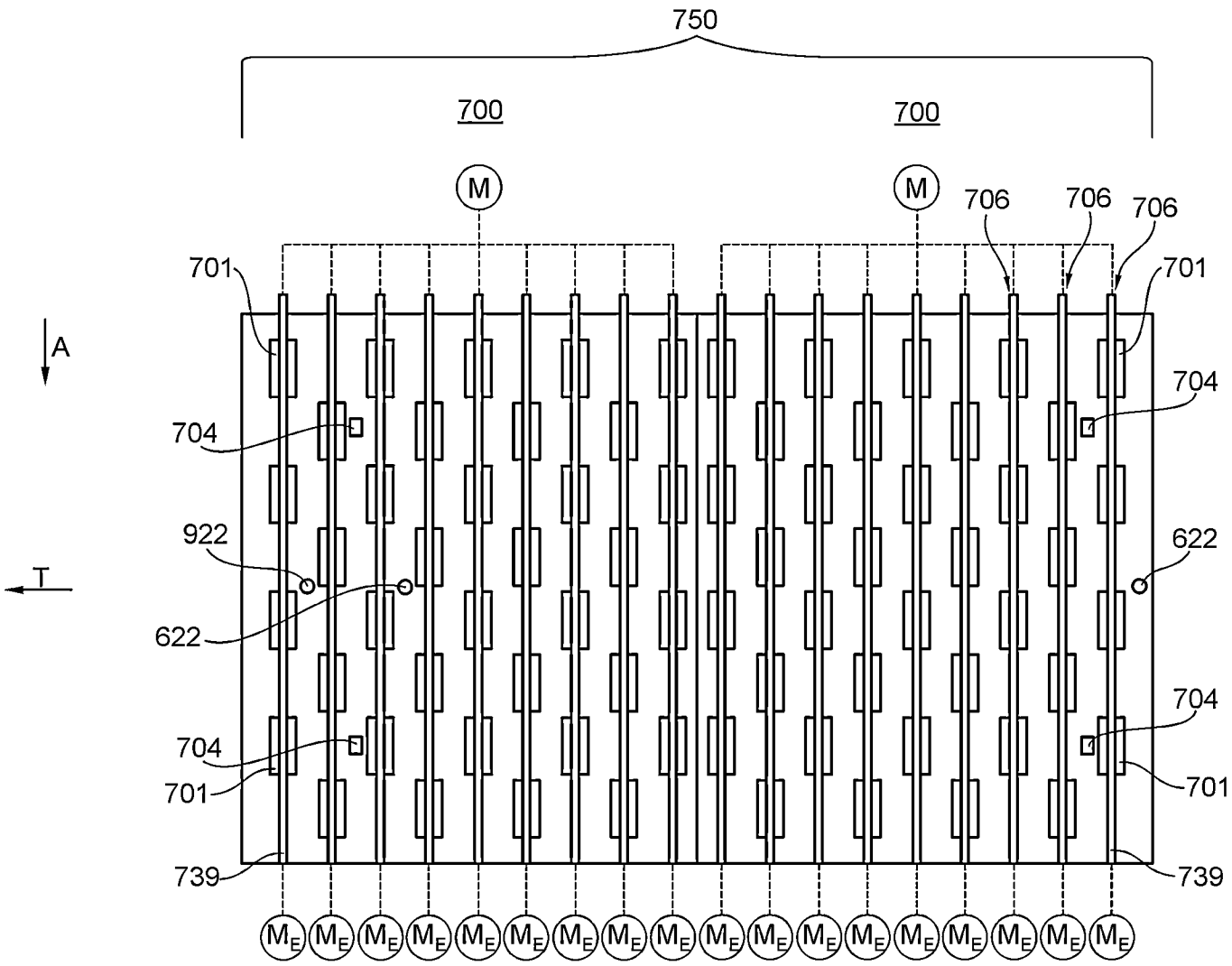
FIG. 15 a preferred embodiment of an alignment segment comprising two transport units for aligning substrate along the transport path with sensors for substrate alignment, wherein each of the transport units comprises a main drive for driving the transport sections in the circumferential direction and the transport sections of the transport units comprise dedicated drives for the axial adjustment.
Figure 16:
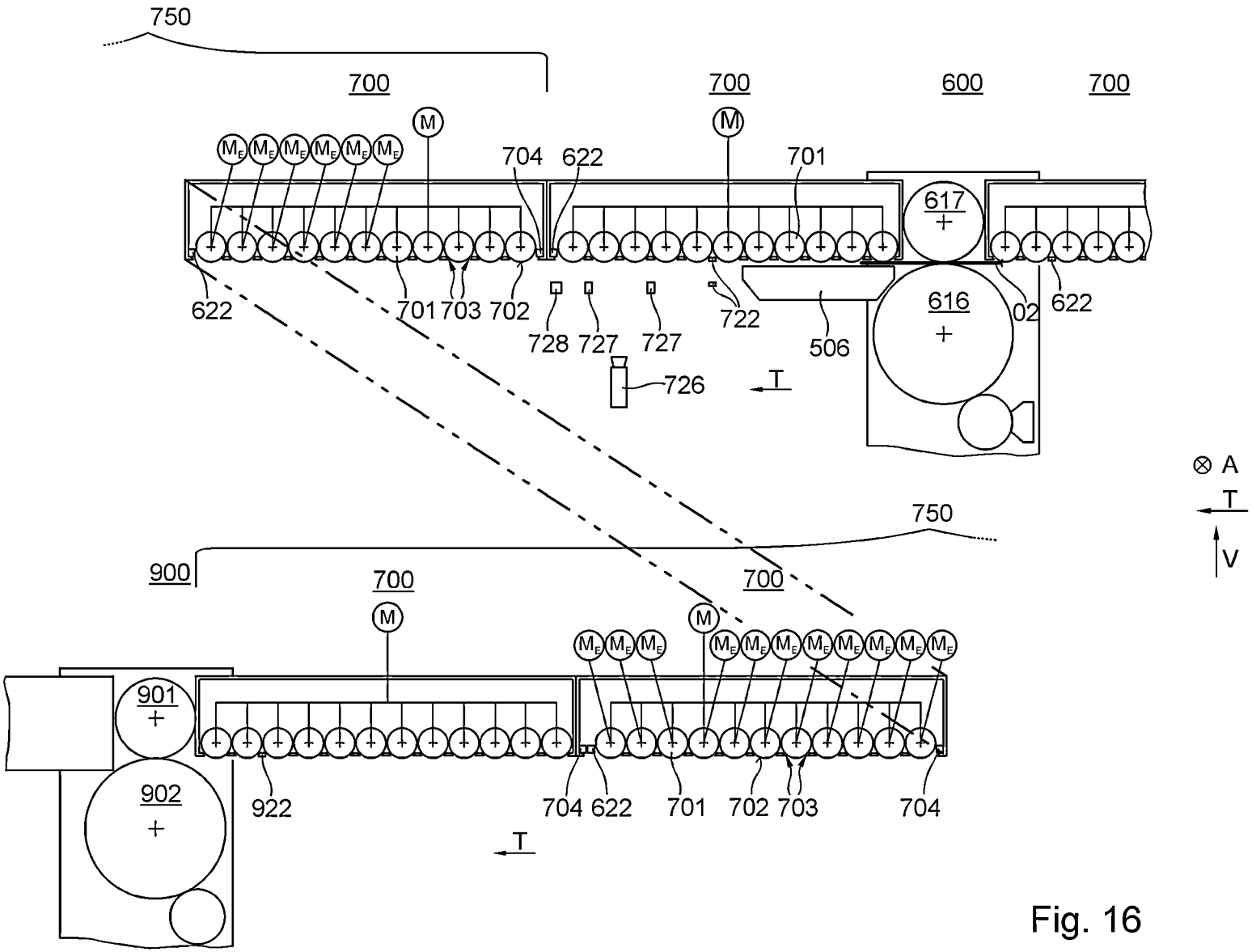
FIG. 16 a schematic representation of a further preferred embodiment of an alignment segment between two processing units comprising several transport units for aligning substrate.
Figure 17:
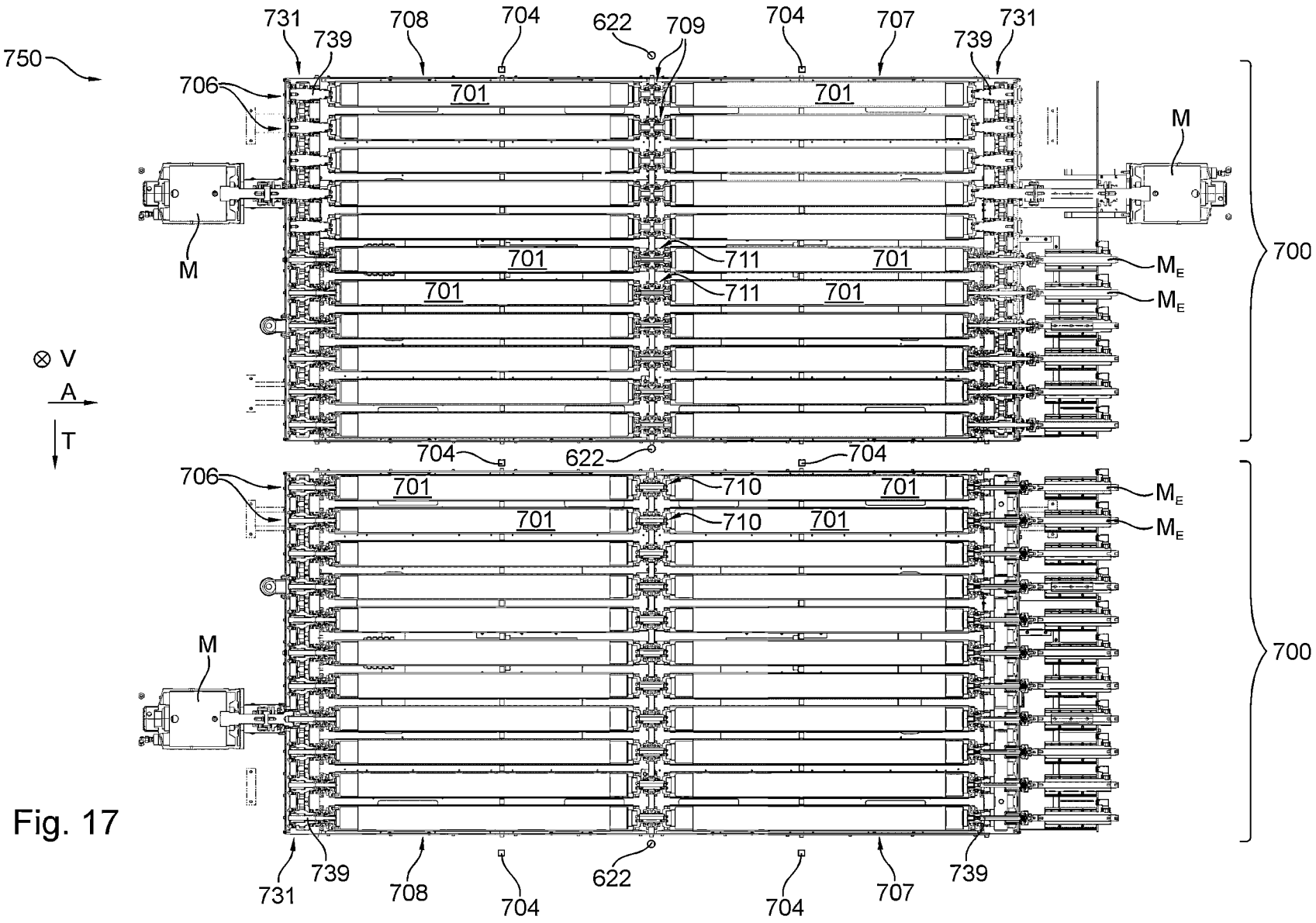
FIG. 17 an illustration of a part of the preferred embodiment of the alignment segment according to FIG. 16, wherein several transport sections comprise respective dedicated drives for the axial adjustment, and wherein at least some of the transport sections comprise two transport sub-sections comprising differing main drives.
Figure 18:
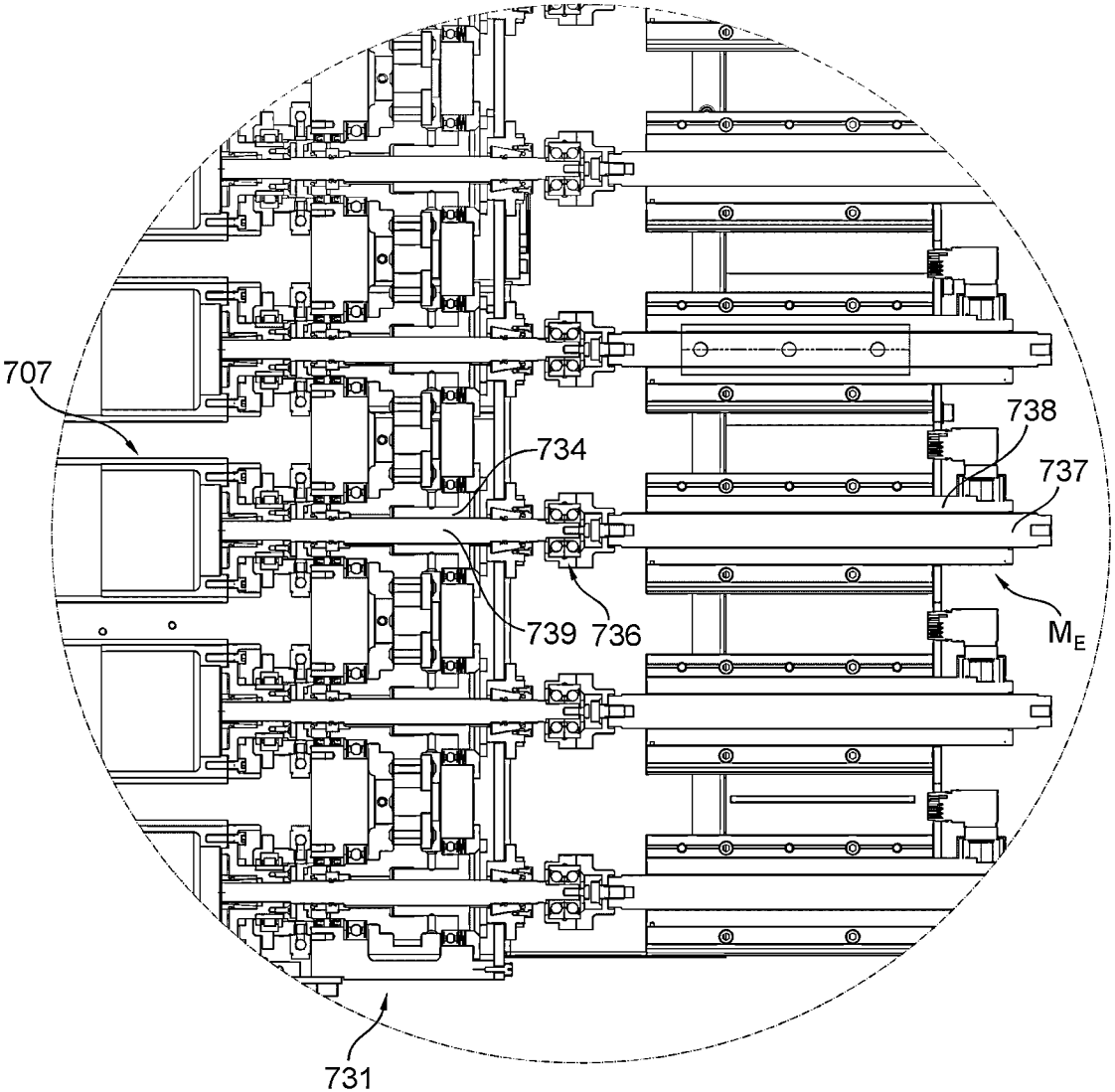
FIG. 18 an enlarged illustration from FIG. 17, which shows a dedicated drive and the operative portion thereof to a transport section.
Figure 19:
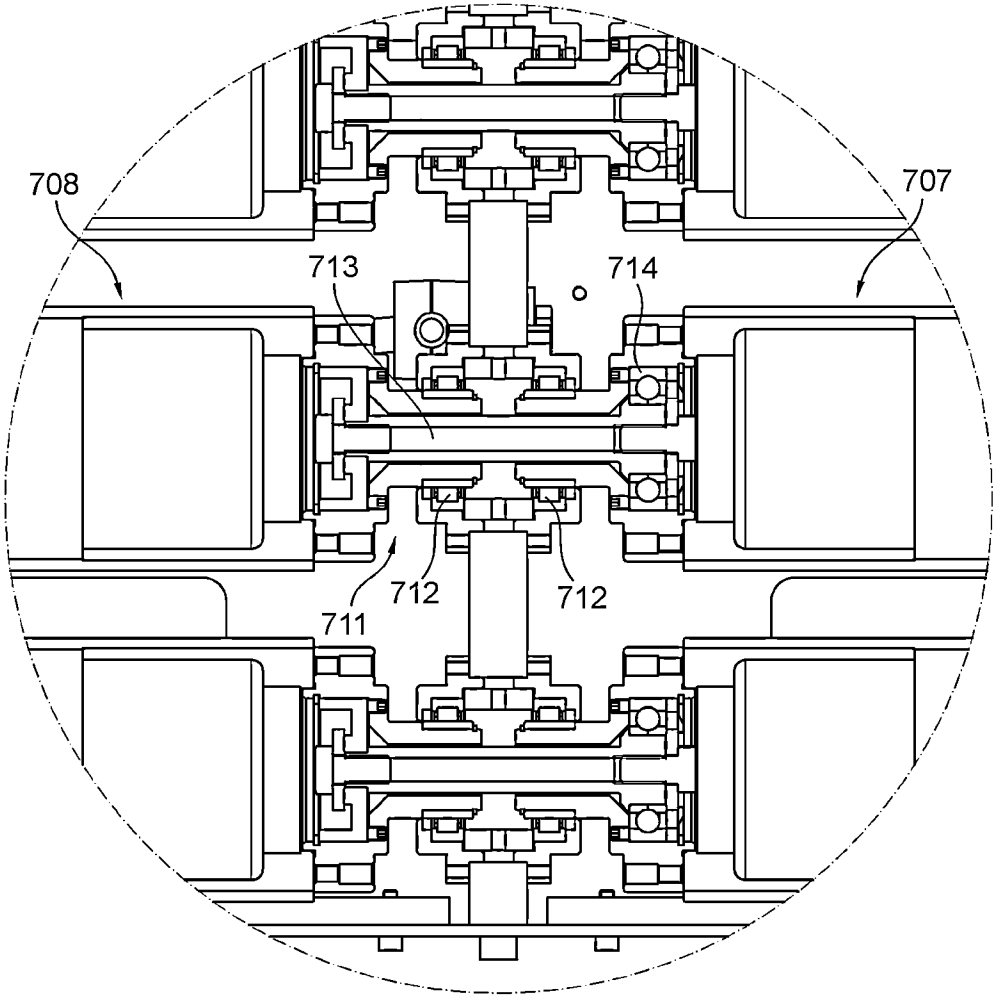
FIG. 19 an enlarged illustration from FIG. 17, which shows a spatial region between two transport sub-sections of a transport section, which is designed so as to transmit an axial movement, but does not transmit the rotational movement from one transport sub-section to the other.
Figure 20:
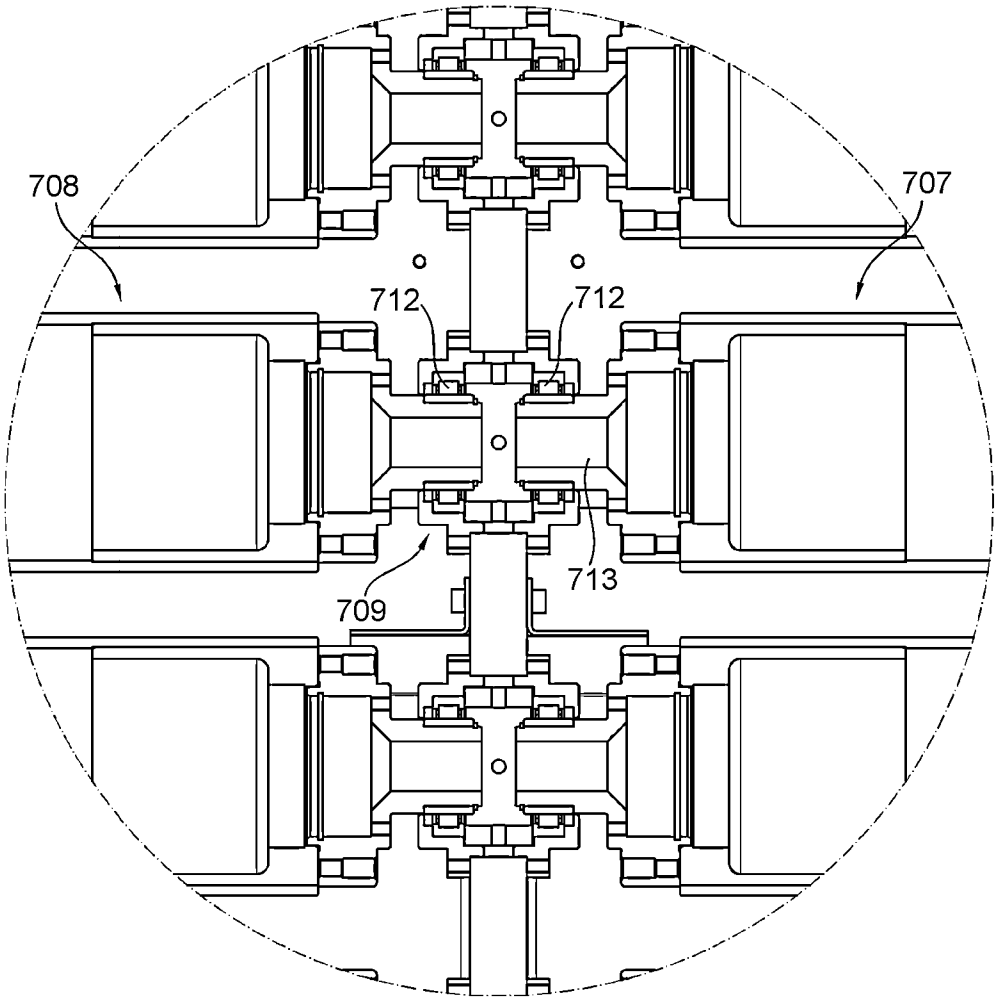
FIG. 20 an enlarged illustration from FIG. 17, which shows a spatial region between two transport sub-sections of a transport section, which does not transmit any rotational movement from one transport sub-section to the other.
Figure 21:
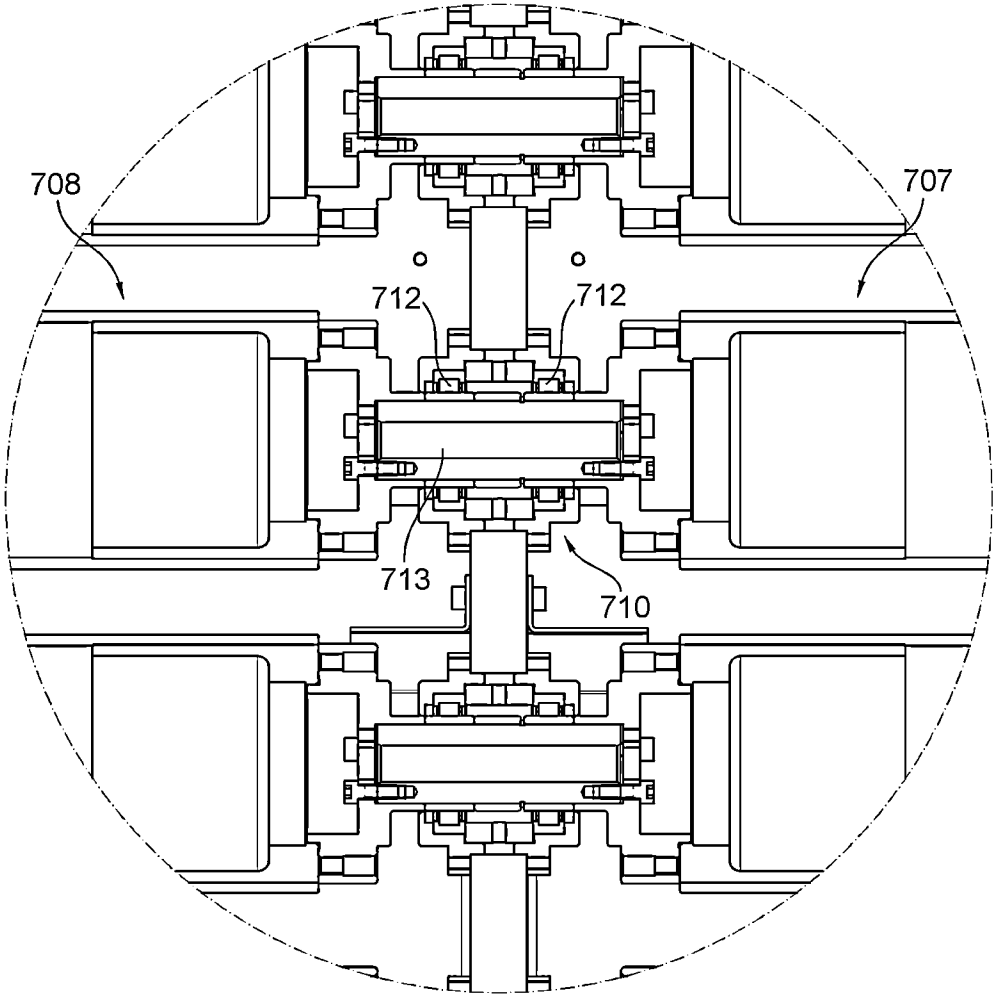
FIG. 21 an enlarged illustration from FIG. 17, which shows a spatial region between two transport sub-sections of a transport section, which transmits a rotational movement and an axial movement from one transport sub-section to the other.
Figure 22:
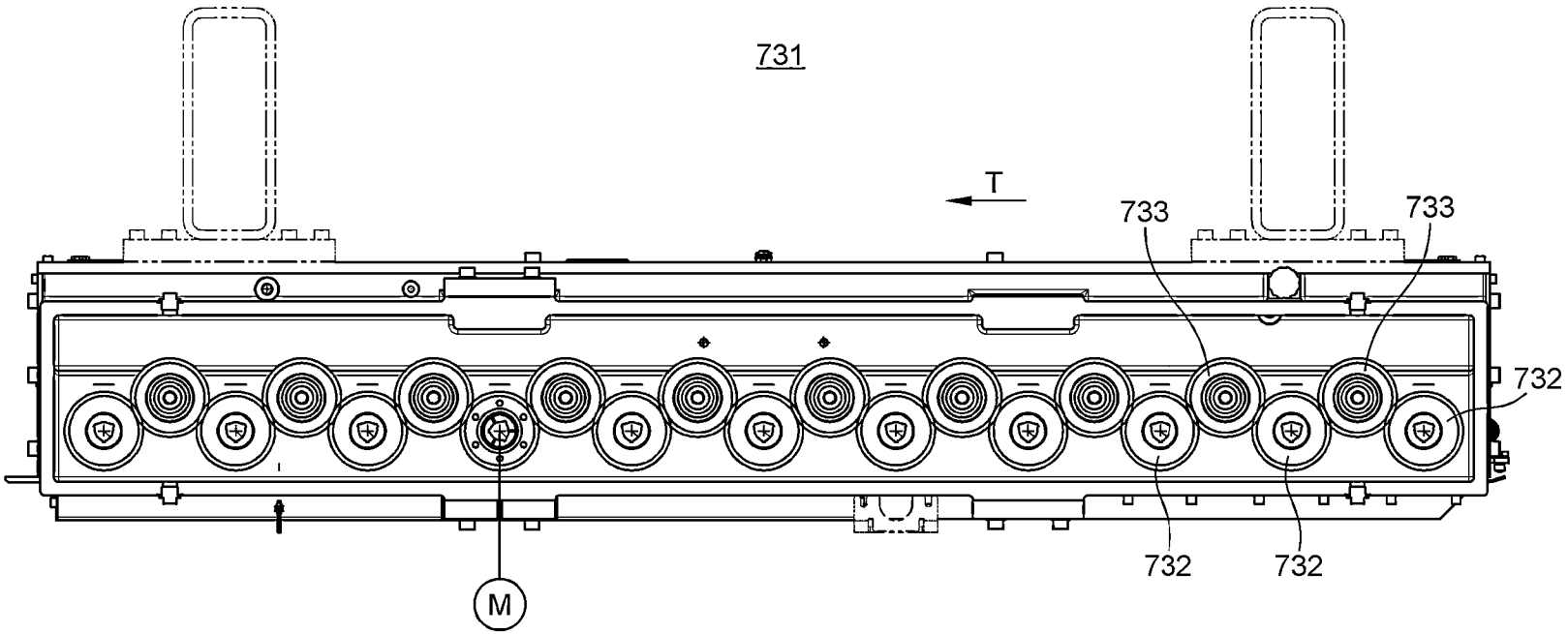
FIG. 22 a schematic representation of a gear train comprising gear wheels and intermediate gear wheels, wherein a main drive engages on an axis of rotation of a gear wheel.
Figure 23:
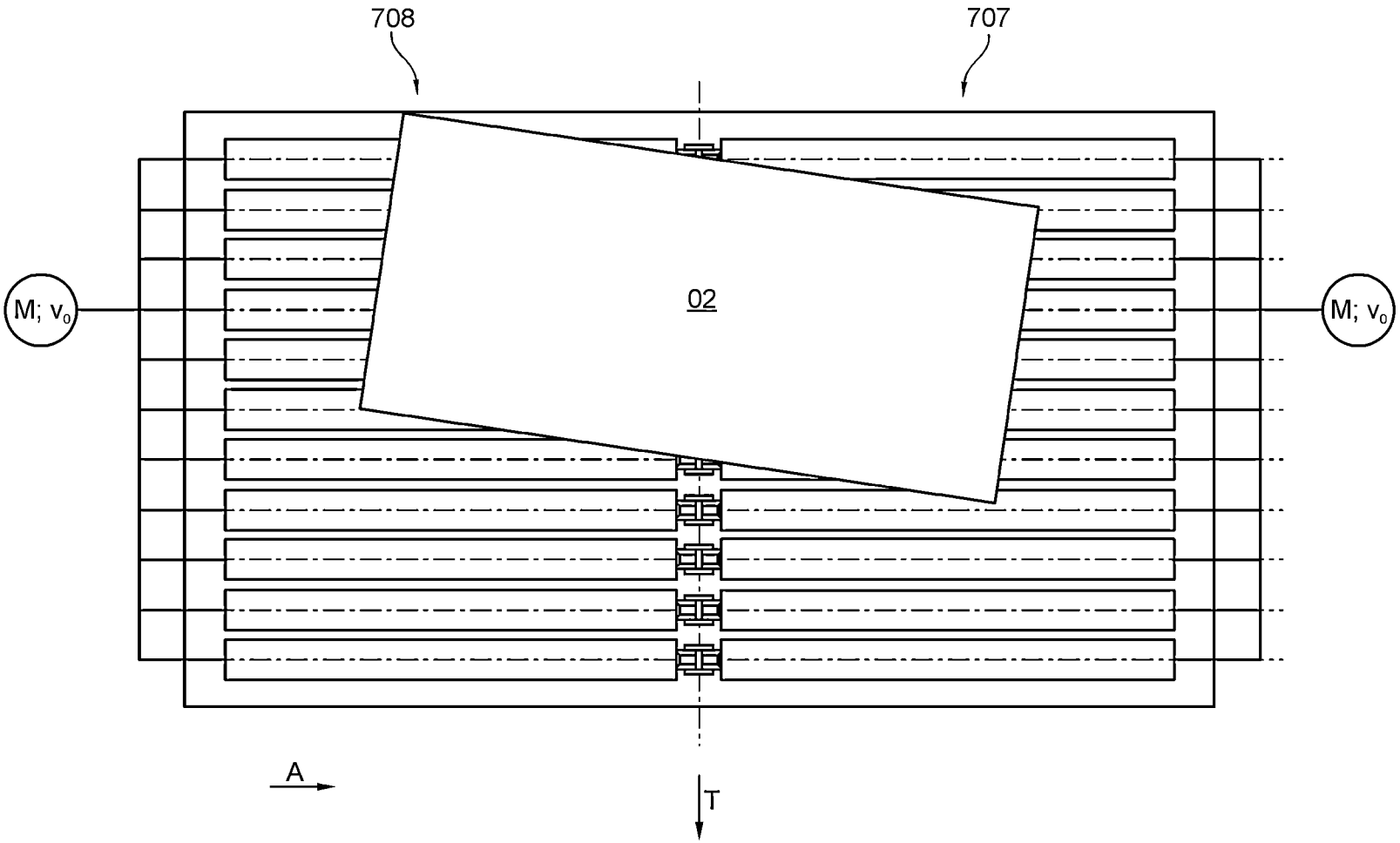
FIG. 23 a schematic representation of a preferred embodiment of an alignment of substrate at an exemplary transport unit of an alignment segment in the case of a skewed position of the substrate, wherein a transport section comprises two transport sub-sections, wherein the transport sub-sections are each coupled to a main drive, wherein the two main drives drive the respective coupled transport sub-sections at an initial speed in the circumferential direction, and wherein a substrate arrives at the transport unit in a skewed position.
Figure 24:
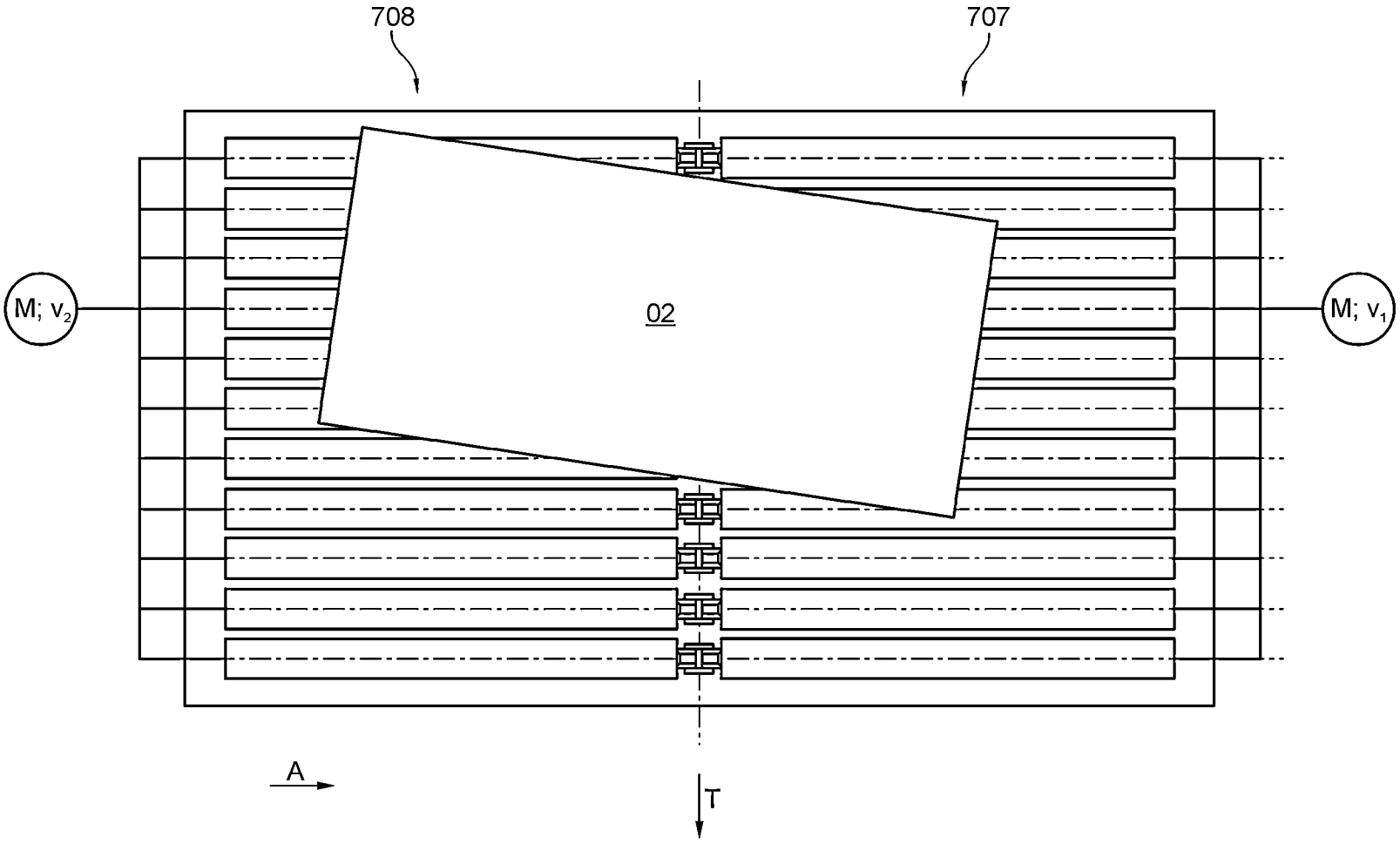
FIG. 24 a schematic representation of the alignment of substrate at a transport unit in the case of a skewed position of the substrate according to FIG. 23, wherein, for the purpose of compensating for the skewed position, the main drive of the first transport sub-sections drives these at a first speed in the circumferential direction, and the main drive of the second transport sub-sections drives these at a second speed in the circumferential direction.
Figure 25:
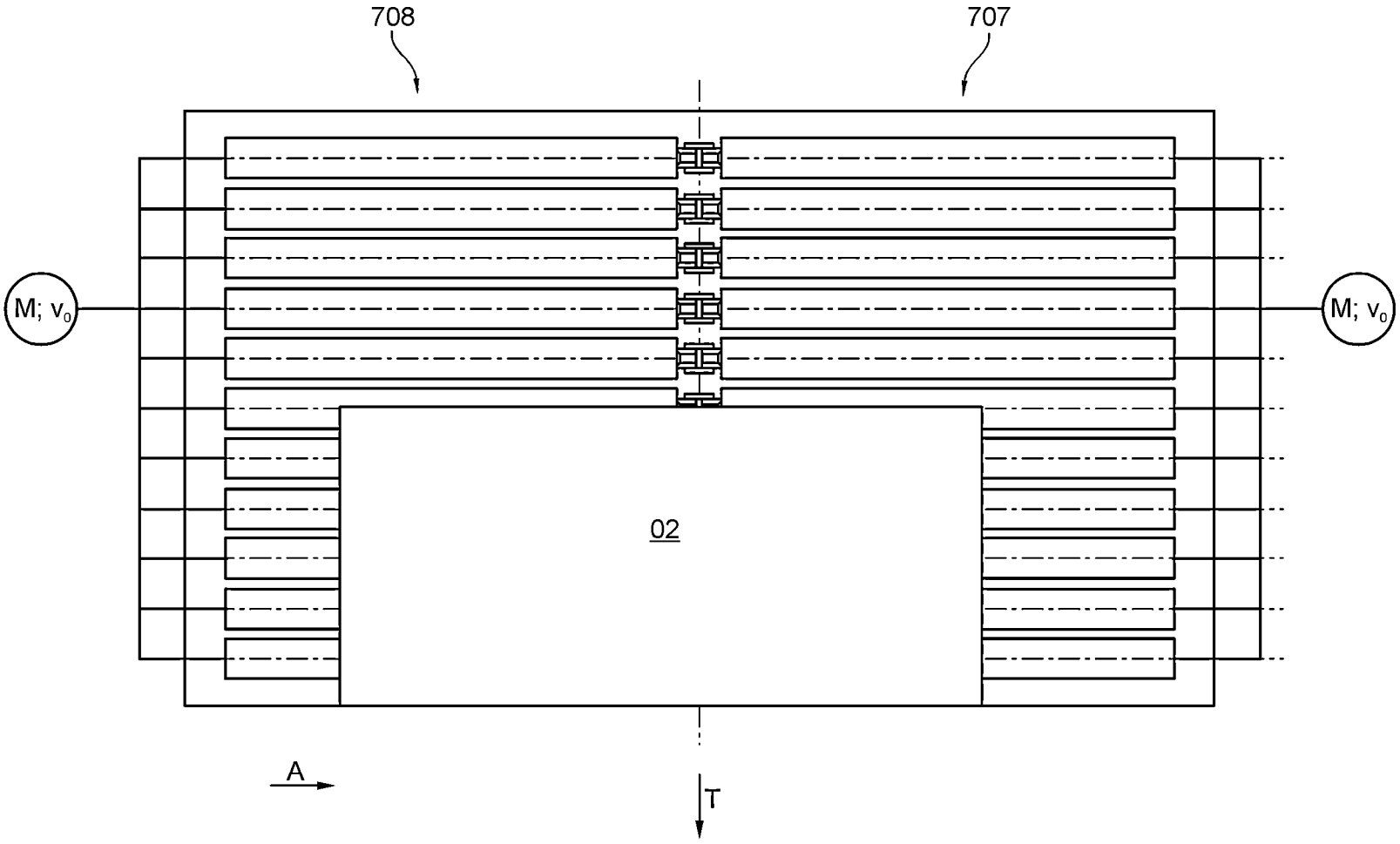
FIG. 25 a schematic representation of the alignment of substrate at a transport unit in the case of a skewed position of the substrate according to FIG. 23 and FIG. 24, wherein the substrate is being transported onwards in a state in which the skewed position thereof has been corrected.
Figure 26:
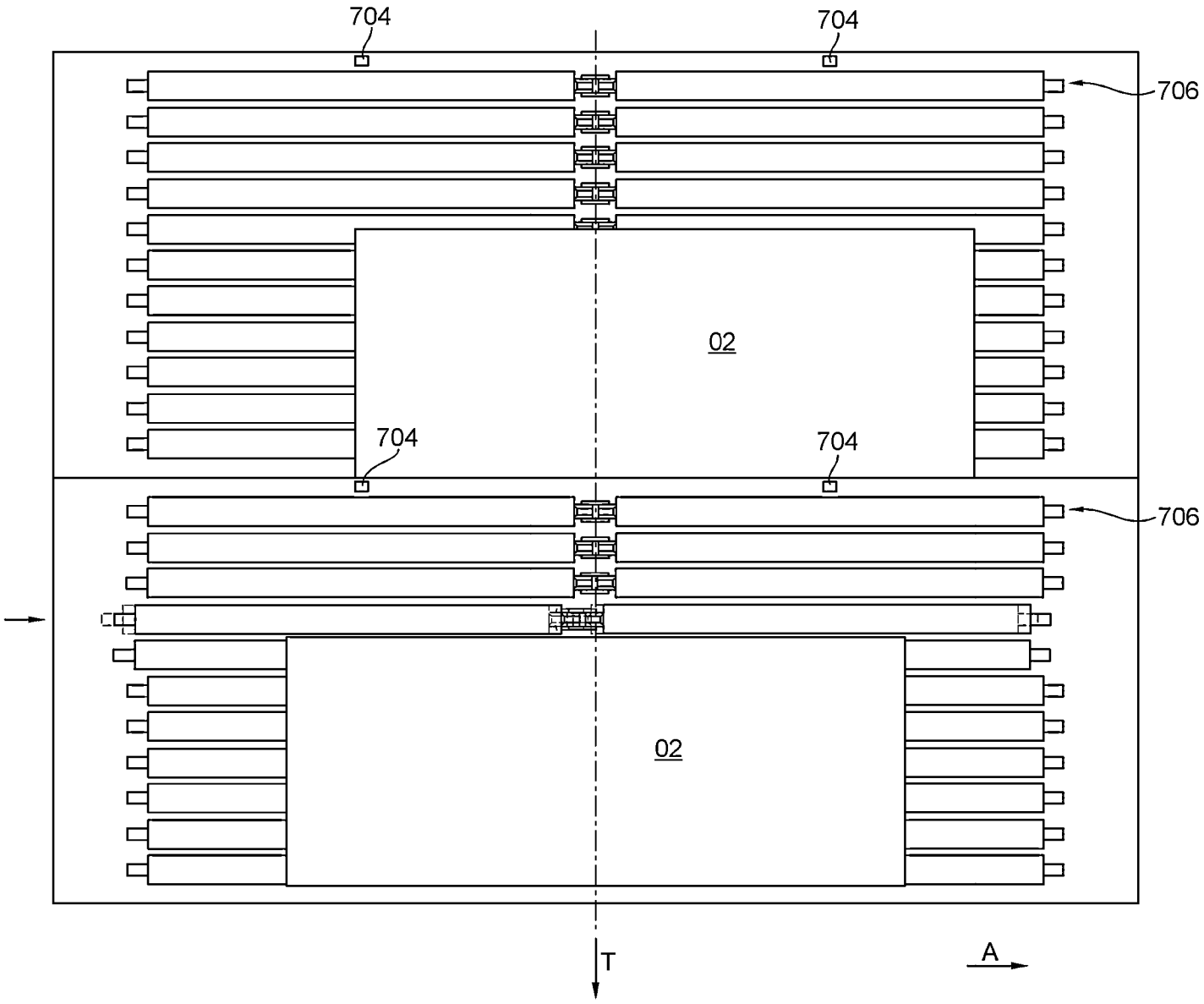
FIG. 26 a schematic representation of a preferred embodiment of an alignment of substrate by an alignment segment in the case of axial offset of the substrate, with a substrate leading in the transport direction already having been aligned, while a succeeding substrate arrives in the at least one detection zone of sensors for substrate alignment, wherein a transport section that is adjusted for aligning the leading substrate carries out a return movement into the basic position thereof.
Figure 27:
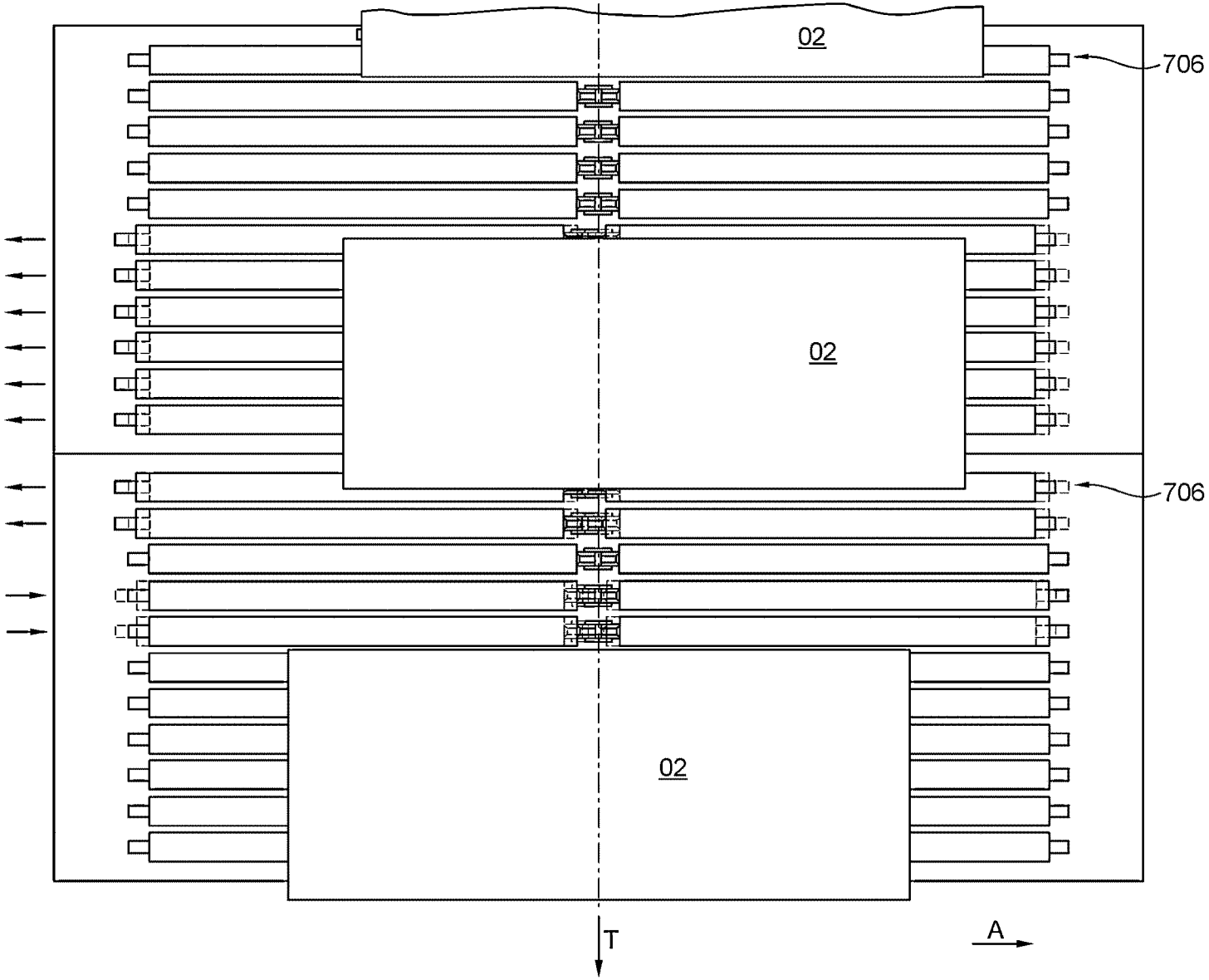
FIG. 27 a schematic representation of the preferred embodiment of the alignment of substrate in the case of axial offset according to FIG. 26, wherein a first group of transport sections starts an adjustment movement, and wherein transport sections of a second group of transport sections which are adjusted for aligning the leading substrate carry out a return movement into the basic position thereof.
Figure 28:
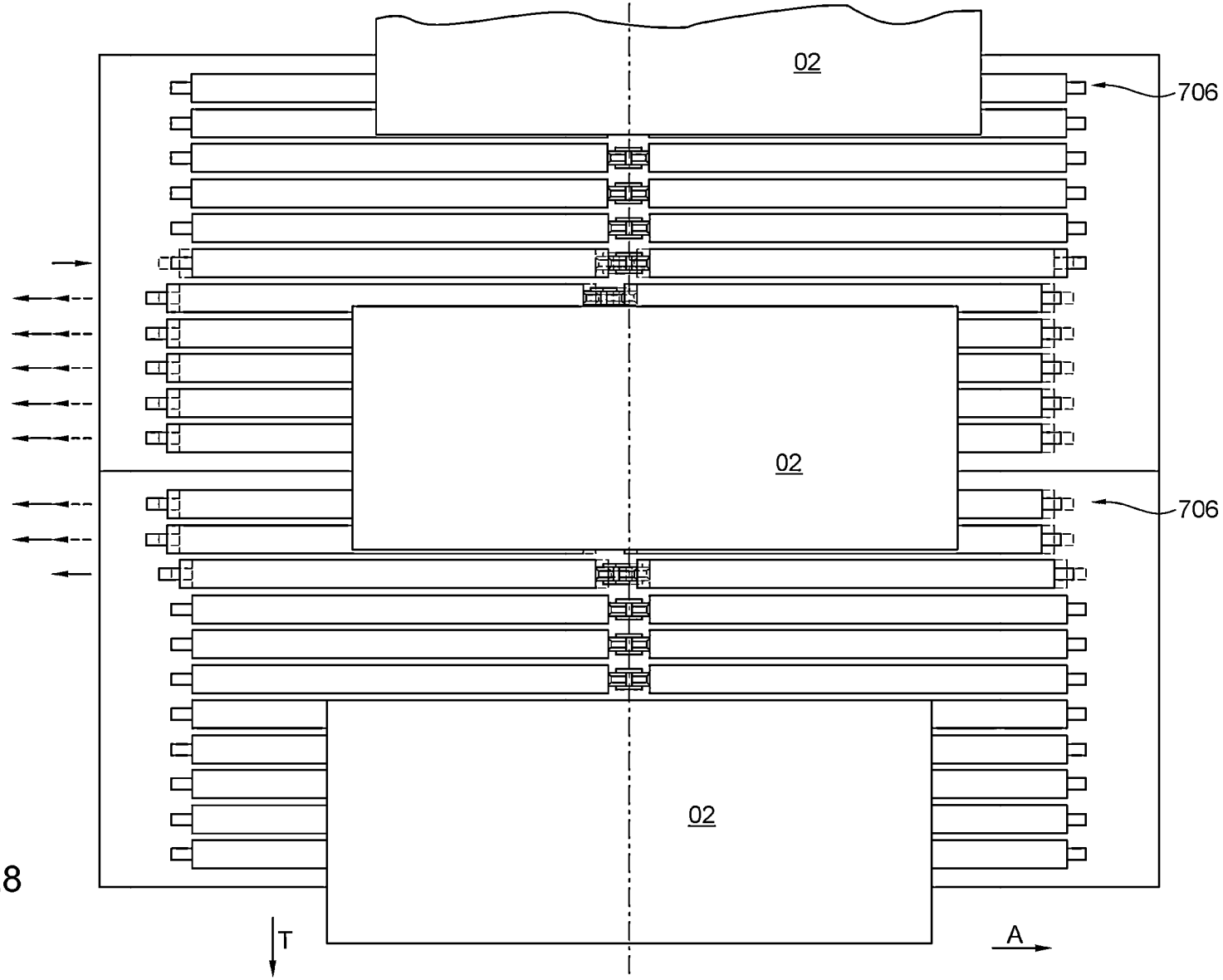
FIG. 28 a schematic representation of the preferred embodiment of the alignment of substrate in the case of axial offset according to FIG. 26 and FIG. 27, wherein a first group of transport sections carries out the adjustment movement, and wherein a previously adjusted, substrate-free transport section of a second group of transport sections carries out a return movement into the basic position thereof.
Figure 29:
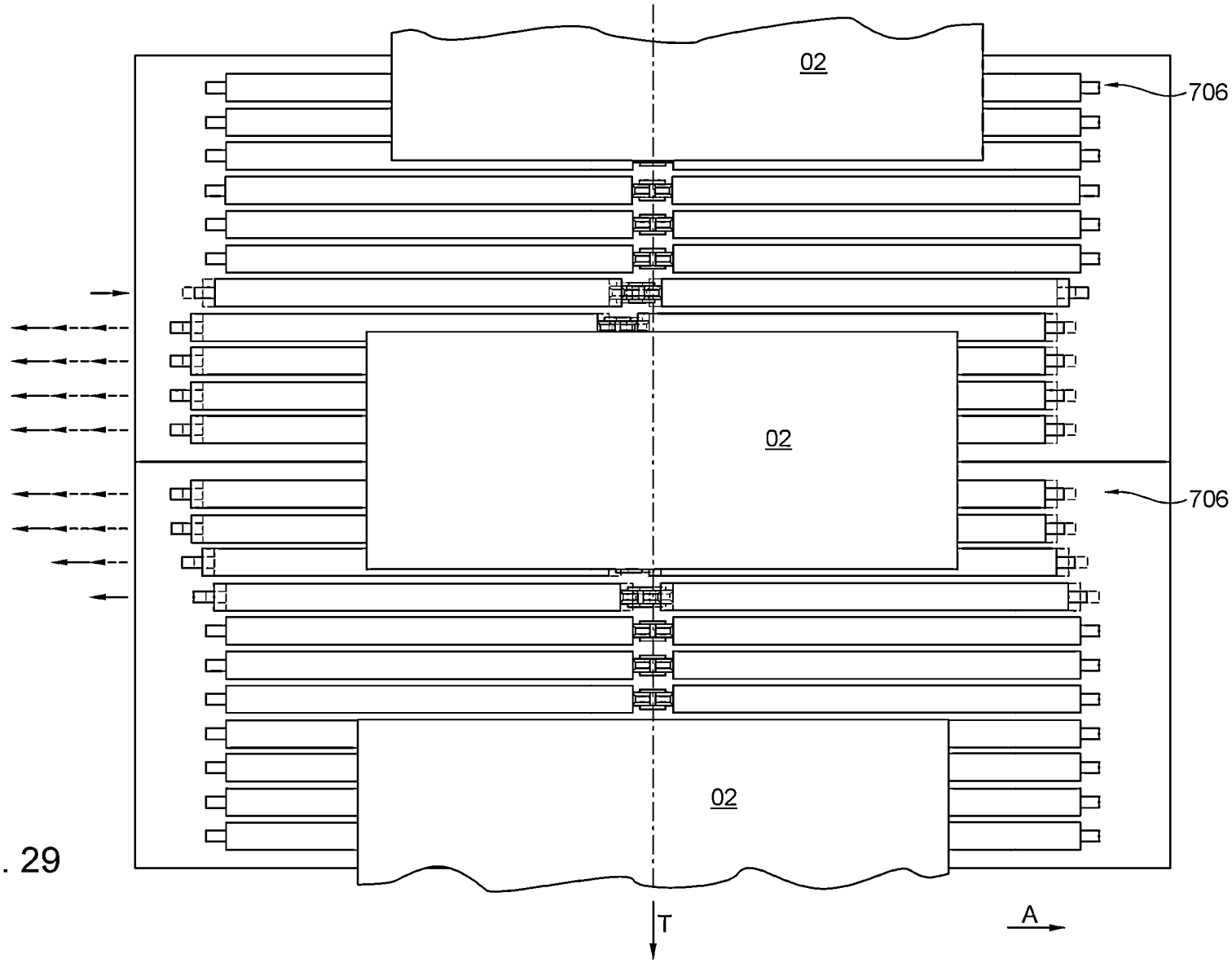
FIG. 29 a schematic representation of the preferred embodiment of the alignment of substrate in the case of axial offset according to FIG. 26, FIG. 27 and FIG. 28, wherein a first group of transport sections carries out the adjustment movement, and wherein a previously adjusted, substrate-free transport section of a second group of transport sections carries out a return movement into the basic position thereof.
Figure 30:
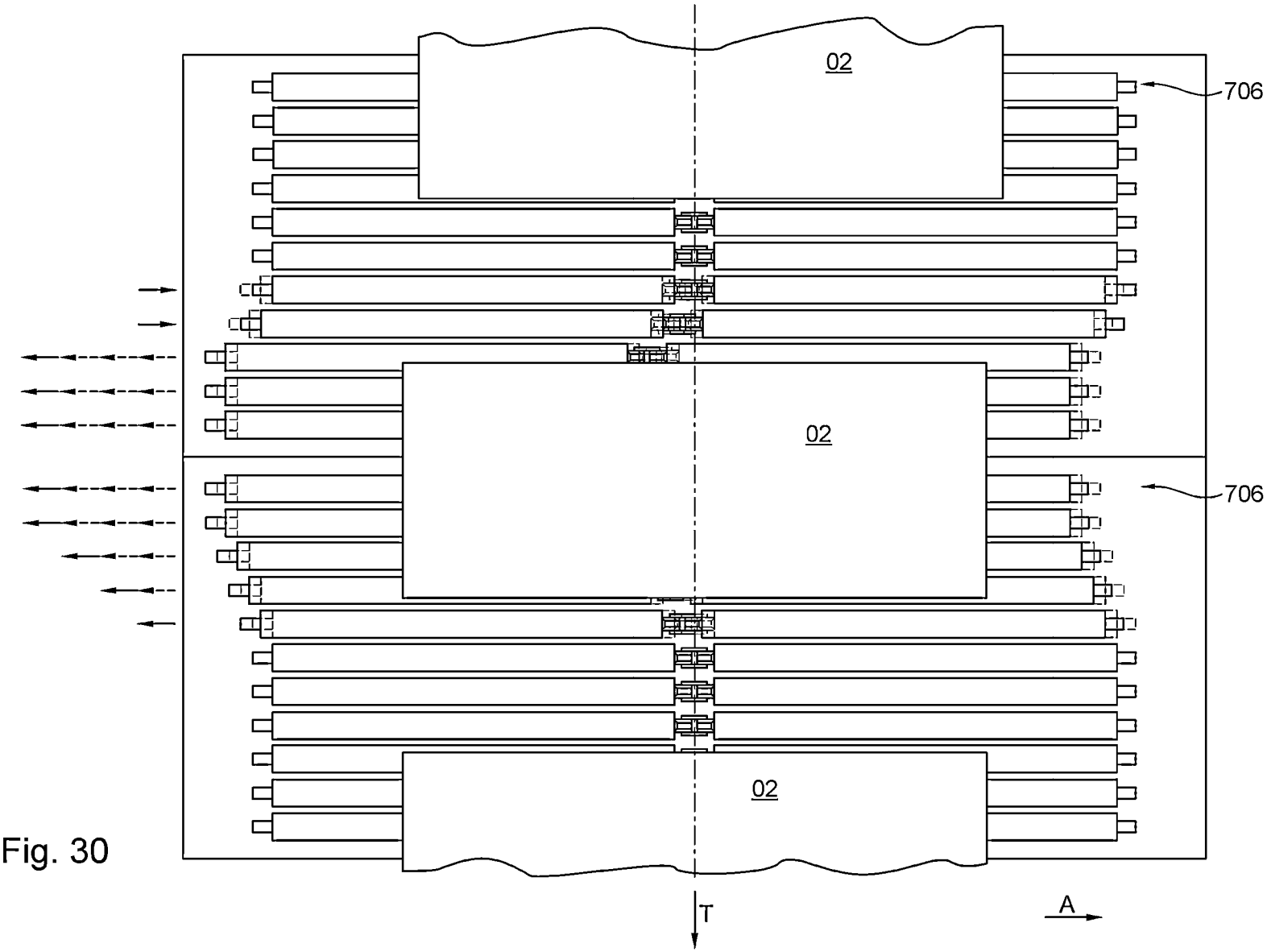
FIG. 30 a schematic representation of the preferred embodiment of the alignment of substrate in the case of axial offset according to FIG. 26, FIG. 27, FIG. 28 and FIG. 29, wherein a first group of transport sections carries out the adjustment movement, and wherein previously adjusted, substrate-free transport sections of a second group of transport sections carry out a return movement into the basic position thereof.
Figure 31:
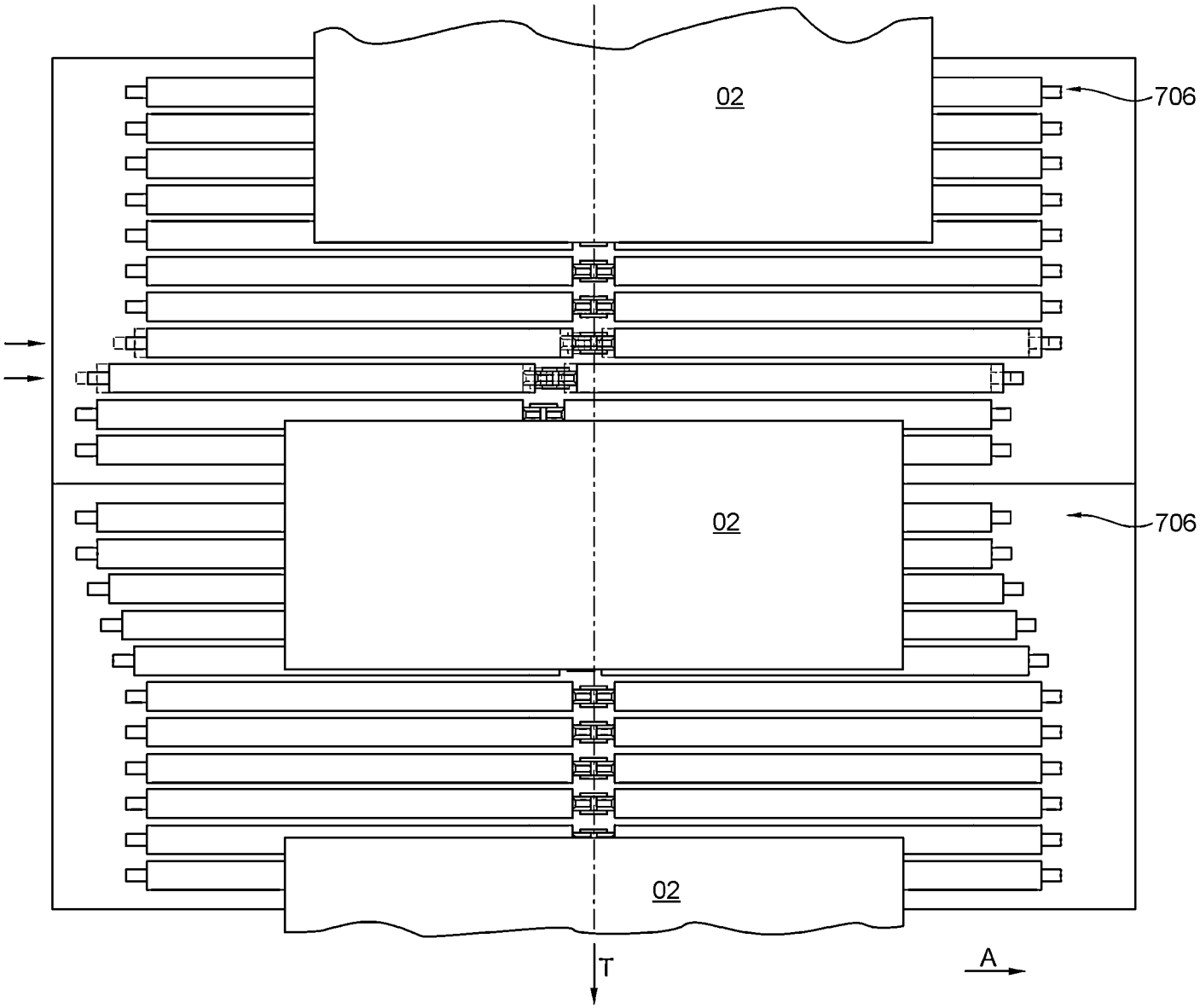
FIG. 31 a schematic representation of the preferred embodiment of the alignment of substrate in the case of axial offset according to FIG. 26, FIG. 27, FIG. 28, FIG. 29 and FIG. 30, wherein the alignment of the substrate is completed and the transport sections comprising the substrate in the active region thereof remain in the adjustment position, and wherein previously adjusted, substrate-free transport sections of a second group of transport sections carry out a return movement into the basic position thereof.

A processing machine 01 is preferably designed as a printing machine 01 and/or as a shaping machine 01, in particular a die-cutting machine 01, more preferably a rotary die-cutting machine. The printing machine 01 is preferably designed as a flexographic printing machine 01.

The processing machine 01 is preferably referred to as a printing machine 01 when it comprises at least one application mechanism 614 designed as a printing unit 614 and/or at least one printing unit 600 designed as a unit 600, in particular regardless of whether it comprises additional units for processing substrate 02. A processing machine 01 designed as a printing machine 01 also comprises, for example, at least one additional such unit 900, for example at least one shaping unit 900, which is preferably designed as a die-cutting unit 900, more preferably as a die-cutting device 900. The processing machine 01 is preferably referred to as a shaping machine 01 when it comprises at least one shaping mechanism 914 and/or at least one shaping unit 900, in particular regardless of whether it comprises additional units 600 for processing substrate 02. The processing machine 01 is preferably referred to as a die-cutting machine 01 when it comprises at least one die-cutting mechanism 914 designed as a shaping mechanism 914 and/or at least one die-cutting unit 900 and/or at least one die-cutting device 900, in particular regardless of whether it comprises additional units 600 for processing substrate 02. A processing machine 01 designed as a shaping machine 01 or die-cutting machine 01 also comprises, for example, at least one further unit 600 for processing substrate 02, for example at least one printing unit 600 and/or at least one printing mechanism 614.

The processing machine 01 comprises at least one processing unit 600; 900. The processing machine 01 preferably comprises at least two processing units 600; 900, which preferably carry out processing operations that differ from one another. Preferably, at least one processing unit 600, for example at least one forward processing unit 600, is designed as an application unit 600. At least one succeeding processing unit 900 is preferably designed as a shaping unit 900. Preferably, the at least one application unit 600 and/or the at least one die-cutting unit 900 are in each case a processing unit 600; 900 of the processing machine 01, preferably for processing substrate 02. Above and below, processing a substrate 02 preferably describes changing at least one property of the relevant substrate 02 with respect to its physical properties and/or material properties, in particular the mass and/or shape and/or appearance thereof. The substrate 02 can be converted into at least one intermediate product that can be further worked and/or into an end product by at least one processing operation. Preferably, the at least one processing unit 600; 900, preferably the at least one application unit 600 and/or the at least one shaping unit 900, comprises at least one plate cylinder 616; 901, preferably exactly one plate cylinder 616; 901. Preferably, the at least one processing unit 600; 900, preferably the at least one application unit 600 and/or the at least one shaping unit 900, more preferably each processing unit 600; 900, in particular an application unit 600 and/or a processing unit 600; 900 following an application unit 600, comprises at least one drive for axially adjusting the at least one plate cylinder 616; 901 of the processing unit 600; 900. The at least one drive for axially adjusting the at least one plate cylinder 616; 901 of the processing unit 600; 900 is preferably designed so as to axially adjust in each case the plate cylinder 616; 901 of the processing unit 600; 900. The plate cylinder 616; 901 of the at least one processing unit 616; 900 is preferably axially adjusted by means of the at least one drive for axially adjusting the plate cylinder 616; 901. Preferably, the at least one processing unit 600; 900, preferably the at least one application unit 600 and/or the at least one shaping unit 900, more preferably each processing unit 600; 900, in particular an application unit 600 and/or a processing unit 600; 900 following an application unit 600, comprises at least one drive in the circumferential direction of the at least one plate cylinder 616; 901 of the processing unit 600; 900. The at least one drive in the circumferential direction of the at least one plate cylinder 616; 901 of the processing unit 600; 900 is preferably designed so as to accelerate and/or decelerate in each case the plate cylinder 616; 901 of the processing unit 600; 900 in the circumferential direction and/or is preferably designed so as to adapt in each case a processing length of the processing unit 600; 900 by accelerating and/or decelerating the plate cylinder 616; 901 in the circumferential direction. The at least one drive in the circumferential direction of the at least one plate cylinder 616; 901 of the processing unit 600; 900 preferably in each case accelerates and/or decelerates the plate cylinder 616; 901 of the processing unit 600; 900 in the circumferential direction. In addition or as an alternative, the at least one drive in the circumferential direction of the at least one plate cylinder 616; 901 of the processing unit 600; 900 in each case preferably adapts a processing length of the processing unit 600; 900 by accelerating and/or decelerating the plate cylinder 616; 901 in the circumferential direction. Preferably, the at least one drive of the plate cylinder 616; 901, preferably at least the axial adjustment and/or the speed in the circumferential direction, is controlled by at least one inspection device 726; 728; 916, preferably the color register monitoring system 728 and/or the die-cutting monitoring system 916.

In a preferred embodiment, the processing machine 01, in particular a sheet processing machine 01, preferably comprises a unit 100 designed as a feeder 100, preferably as a sheet feeder 100, and/or at least one printing mechanism 614 designed as an application mechanism 614 for applying at least one print image onto substrate 02. Thus, if the processing machine 01 comprises at least one printing mechanism 614 and/or at least one printing unit 600, and also comprises at least one shaping mechanism 914 and/or at least one shaping unit 900, it is designed both as a printing machine 01 and as a shaping machine 01. If the processing machine 01 comprises at least one printing mechanism 614 and/or at least one printing unit 600, and also comprises at least one die-cutting mechanism 914 and/or at least one die-cutting unit 900 and/or at least one die-cutting device 900, it is accordingly designed both as a printing machine 01 and as a shaping machine 01, in particular a die-cutting machine 01.

The processing machine 01 is preferably designed as a sheet processing machine 01, that is, as a processing machine 01 for processing sheet-format substrate 02 or sheets 02, in particular sheet-format print substrate 02. For example, the sheet processing machine 01 is designed as a sheet-fed printing machine 01 and/or as a sheet-fed shaping machine 01 and/or as a sheet-fed die-cutting machine 01. The processing machine 01 is further preferably designed as a corrugated cardboard sheet processing machine 01, that is, as a processing machine 01 for processing sheet-format substrate 02 or sheets 02 made of corrugated cardboard 02, in particular sheet-format print substrate 02 made of corrugated cardboard 02. The processing machine 01 is further preferably designed as a sheet-fed printing machine 01, in particular as a corrugated cardboard sheet printing machine 01, that is, as a printing machine 01 for coating and/or printing sheet-format substrate 02 or sheets 02 made of corrugated cardboard 02, in particular sheet-format print substrate 02 made of corrugated cardboard 02. The printing machine 01 is designed as a printing machine 01 that operates according to a printing forme-based printing method, for example.

The processing machine 01 is preferably designed so as to process substrate 02, preferably sheet-format substrate 02. The substrate 02 preferably includes at least one multiple-up. A multiple-up is preferably the region of the substrate 02 that is either designed as a product of the processing machine 01, in particular as an intermediate product for producing an end product, and/or, for example, is further worked and/or is designed to be further workable into a desired or required end product. The desired or required end product here, which is preferably generated by further processing the respective multiple-up, is preferably a folder-type box and/or a packaging. Unless an explicit distinction is made, the term sheet-format substrate 02, in particular print substrate 02, specifically sheet 02, shall generally encompass any flat substrate 02 present in the form of sections, that is, including substrates 02 in tabular form or panel form, i.e., including boards or panels. The sheet-format substrate 02 or sheet 02 thus defined is formed, for example, of paper or paperboard, that is, as a sheet of paper or paperboard, or as sheets 02, boards, or optionally panels made of plastic, cardboard, glass, or metal. More preferably, the substrate 02 is corrugated cardboard 02, in particular corrugated cardboard sheets 02. The at least one sheet 02 is preferably designed as corrugated cardboard 02. A thickness of a sheet 02 shall preferably be understood to mean a dimension orthogonal to a largest surface area of the sheet 02. This largest surface area is also referred to as the main surface area. Preferably, printing fluid is applied at least partially and/or at least on one side of the sheet 02 on the at least one main surface area. The thickness of the sheets 02 is, for example, at least 0.1 mm (zero point one millimeters), more preferably at least 0.3 mm (zero point three millimeters), and still more preferably at least 0.5 mm (zero point five millimeters). Considerably greater thicknesses are also customary, especially in the case of corrugated cardboard sheets 02, for example at least 4 mm (four millimeters) or also 10 mm (ten millimeters) and more. Corrugated cardboard sheets 02 are relatively stable and are therefore not very flexible. Corresponding adjustments of the processing machine 01 therefore facilitate the processing of sheets 02 of great thickness. For example, the sheet-format substrate 02, in particular a sheet 02, has a length of at least 100.0 cm (one hundred centimeters), preferably of at least 120.0 cm (one hundred twenty centimeters), more preferably of at least 130.0 cm (one hundred thirty centimeters), more preferably of at least 150.0 cm (one hundred fifty centimeters). The length preferably describes the length of the substrate 02 along the transport direction T within the processing machine 01. For example, the sheet-format substrate 02, in particular a sheet 02, has a width of at least 100.0 cm (one hundred centimeters), preferably of at least 120.0 cm (one hundred twenty centimeters), more preferably of at least 130.0 cm (one hundred thirty centimeters), more preferably of at least 150.0 cm (one hundred fifty centimeters), still more preferably at least 200 cm (two hundred centimeters), still more preferably at least 250 cm (two hundred fifty centimeters), still more preferably at least 280 cm (two hundred eighty centimeters). The width preferably describes the width of the substrate 02 along the working width, that is, in the transverse direction A, within the processing machine 01.

The respective, preferably at least one, sheet 02 is preferably made of paper or cardboard or paperboard. More preferably, the respective sheet 02 is made of cardboard, preferably corrugated cardboard. According to DIN 6730, paper is a flat material, consisting mainly of fibers derived from vegetable sources, which is formed by the dewatering of a fiber suspension on a sieve. In the process, a card web is created, which is subsequently dried. The basis weight of paper is preferably a maximum of 225 g/m$^2$ (two hundred twenty-five grams per square meter). According to DIN 6730, cardboard is a flat material, consisting mainly of fibers derived from vegetable sources, which is formed by the dewatering of a fiber suspension on a sieve or between two sieves. The fiber structure is compressed and dried. Cardboard is preferably manufactured from cellulose by gluing or pressing and/or. Cardboard is preferably designed as solid board or corrugated cardboard 02. Above and below, corrugated cardboard 02 is cardboard made of one or more layers of corrugated paper that is glued to one layer or between multiple layers of another, preferably smooth, paper or cardboard. The basis weight of cardboard is preferably more than 225 g/m$^2$ (two hundred twenty-five grams per square meter). Above and below, the term paperboard refers to a sheet material that is preferably primed on one side and made of paper, preferably having a basis weight of at least 150 g/m$^2$ (one hundred fifty grams per square meter) and no more than 600 g/m$^2$ (six hundred grams per square meter). Paperboard preferably has high strength relative to paper.

A leading end of a substrate 02 is preferably the region of the substrate 02 leading in the transport direction T which has an extension in the transport direction T of no more than 15%, preferably no more than 10%, more preferably no more than 5%, of the length of the substrate 02 in the transport direction T. The leading edge 03 is preferably part of the leading end. A trailing end of a substrate 02 is preferably the region of the substrate 02 trailing in the transport direction T which has an extension in the transport direction T of no more than 15%, preferably no more than 10%, more preferably no more than 5%, of the length of the substrate 02 in the transport direction T. The trailing edge 04 is preferably part of the trailing end.

The processing machine 01 preferably comprises several units 100; 300; 600; 700; 900; 1000. A unit in this context shall preferably be understood to mean a group of devices that cooperate functionally, in particular in order to carry out a preferably self-contained processing operation of sheets 02. At least two, for example, and preferably at least three, and more preferably all of the units 100; 300; 600; 700; 900; 1000 are designed as modules 100; 300; 600; 700; 900; 1000 or at least each is assigned to such a module. A module in this context shall in particular be understood to mean a respective unit or a structure made up of multiple units, which preferably comprises at least one transport means and/or at least a dedicated drive controllable by open loop and/or closed loop, and/or as an independently functioning module and/or as an individually manufactured and/or separately assembled machine unit or functional assembly. A dedicated drive, controllable by open loop and/or closed loop, of a unit or module shall in particular be understood to mean a drive that is used to power the movements of components of this unit or module and/or that is used to transport substrate 02, in particular sheets 02, through this particular unit or module and/or through at least one operating zone of this particular unit or module and/or that is used to directly or indirectly drive at least one component of the particular unit or module that is intended for contact with sheets 02. The dedicated drive of a unit or module which can be controlled by open loop and/or closed loop is preferably designed to power movements of components of this unit or module and/or designed to effect a transport of substrate 02 and/or designed to directly or indirectly drive at least one component of the particular unit or module which is intended for contact with sheets 02. These drives of the units 100; 300; 600; 700; 900; 1000 of the processing machine 01 are preferably embodied, in particular, as closed loop position-controlled electric motors. A main drive M is preferably connected to at least two components of the processing machine 01 and/or is preferably designed so as to jointly drive the at least two components, preferably at least two differing units or preferably at least two differing transport sections 706, which more preferably are mechanically and/or virtually coupled to one another or can be synchronized with one another. A dedicated drive $M_E$ is preferably designed so as to drive a component, preferably independently of further drives and/or components. A dedicated drive, preferably at least one dedicated drive $M_E$, of a transport section 706, in particular at least one dedicated drive $M_E$ of a transport element 701, is preferably a closed loop position-controlled electric motor, for example, alternatively, rotation angle-controlled. A main drive, preferably at least one main drive M of the transport unit 700, which is preferably connected to at least two transport sections 706, is preferably a closed loop position-controlled electric motor, for example, alternatively, rotation angle-controlled.

Each unit 100; 300; 600; 700; 900; 1000 preferably comprises at least one drive control system and/or at least one drive controller, which is assigned to the respective at least one drive of the particular unit 100; 300; 600; 700; 900; 1000. The drive control systems and/or drive controllers of the individual units 100; 300; 600; 700; 900; 1000 can preferably be operated individually and independently of one another. More preferably, the drive control systems and/or drive controllers of the individual units 100; 300; 600; 700; 900; 1000 are linked and/or can be linked in terms of circuitry, in particular by means of at least one BUS system, to one another and/or to a machine control system of the processing machine 01, in such a way that coordinated open-loop and/or closed-loop control of the drives of several or all units 100; 300; 600; 700; 900; 1000 of the processing machine 01 is and/or can be carried out. Accordingly, the individual units 100; 300; 600; 700; 900; 1000 and/or in particular modules 100; 300; 600; 700; 900; 1000 of the processing machine 01 can be and/or are operated preferably electronically synchronized with one another, at least with respect to the drives thereof, in particular by means of at least one virtual and/or electronic master axis. For this purpose, the virtual and/or electronic master axis is preferably specified, for example by a higher-level machine control system of the processing machine 01. As an alternative or in addition, the individual units 100; 300; 600; 700; 900; 1000 of the processing machine 01 are and/or can be mechanically synchronized with one another, for example, at least with respect to the drives thereof. Preferably, however, the individual units 100; 300; 600; 700; 900; 1000 of the processing machine 01 are mechanically decoupled from one another, at least with respect to the drives thereof.

The spatial area provided for the transport of substrate 02, which the substrate 02, if present, at least temporarily occupies, is the transport path. The transport path is preferably defined by at least one device for guiding the substrate 02 in an operating state of the processing machine 01. Unless described otherwise, each of the units 100; 300; 600; 700; 900; 1000 of the processing machine 01 is preferably characterized in that the section of a transport path provided for a transport of sheets 02, which is defined by the respective unit 100; 300; 600; 700; 900; 1000, is at least substantially flat, and more preferably completely flat. A substantially flat section of the transport path provided for the transport of sheets 02 in this context shall be understood to mean a section that has a minimum radius of curvature of at least two meters, more preferably at least five meters, and still more preferably at least ten meters, and still more preferably at least fifty meters. A completely flat section has an infinitely large radius of curvature and is thus likewise substantially flat and therefore likewise has a minimum radius of curvature of at least two meters. Unless described otherwise, each of the units 100; 300; 600; 700; 900; 1000 of the processing machine 01 is preferably characterized in that the section of the transport path provided for the transport of sheets 02, which is defined by the respective unit 100; 300; 600; 700; 900; 1000, extends at least substantially horizontally, and more preferably exclusively horizontally. This transport path preferably extends in a direction T, in particular in the transport direction T. A substantially horizontal transport path provided for the transport of sheets 02 means in particular that, within the entire region of the particular unit 100; 300; 600; 700; 900; 1000, the provided transport path only has one or more directions that deviate by no more than 30° (thirty degrees), preferably no more than 15° (fifteen degrees), and more preferably no more than 5° (five degrees) from at least one horizontal direction. The transport path provided for the transport of sheets 02 preferably begins at the point where the sheets 02 are removed from a feeder pile 104. In particular, the transport path within the at least one processing unit 600; 900 is preferably at least substantially flat, and more preferably completely flat, still more preferably substantially horizontal, and more preferably exclusively horizontal.

The direction T of the transport path, in particular the transport direction T, is in particular the direction T in which the sheets 02 are transported at the point at which the direction T is measured. The transport direction T provided in particular for the transport of sheets 02 is preferably the direction T that is preferably oriented at least substantially, and more preferably entirely, horizontally and/or that preferably points from a first unit 100; 300; 600; 700; 900; 1000 of the processing machine 01 to a last unit 100; 300; 600; 700; 900; 1000 of the processing machine 01, in particular from a sheet feeder unit 100 or a substrate feed device 100 on the one hand to a delivery unit 1000 or a substrate output device 1000 on the other hand, and/or that preferably points in a direction in which the sheets 02 are transported, apart from vertical movements or vertical components of movements, in particular from a first point of contact with a unit 300; 600; 700; 900; 1000 of the processing machine 01 that is arranged downstream from the substrate feed device 100 or a first point of contact with the processing machine 01 to a last point of contact with the processing machine 01. Regardless of whether the infeed device 300 is an independent unit 300 or module 300 or is a component of the substrate feed device 100, the transport direction T is preferably the direction T in which a horizontal component of a direction points which is oriented from the infeed device 300 to the substrate output device 1000.

A direction A, preferably the transverse direction A, is preferably a direction A that is oriented orthogonally to the transport direction T of the sheets 02 and/or orthogonally to the intended transport path of the sheets 02 through the at least one application unit 600 and/or through the at least one shaping unit 900 and/or through the at least one sheet delivery unit 1000. The transverse direction A is preferably a horizontally oriented direction A. A longitudinal axis of the at least one plate cylinder 616 is preferably oriented parallel to the transverse direction A. The transverse direction A is preferably an axial direction. A working width of the processing machine 01 and/or of the at least one application unit 600 and/or of the at least one shaping unit 900 and/or of the at least one sheet delivery unit 1000 is preferably a dimension that extends preferably orthogonally to the provided transport path of the sheets 02 through the at least one application unit 600 and/or the at least one shaping unit 900 and/or the at least one sheet delivery unit 1000, more preferably in the transverse direction A. The working width of the processing machine 01 preferably corresponds to a maximum width that a sheet 02 may have in order to still be processable by the processing machine 01, that is, in particular a maximum sheet width that can be processed by the processing machine 01. The width of a sheet 02 shall, in particular, be understood to mean the dimension thereof in the transverse direction A. This is preferably independent of whether this width of the sheet 02 is greater than or smaller than a horizontal dimension of the sheet 02 orthogonal thereto, which more preferably represents the length of this sheet 02 in the transport direction T. The working width of the processing machine 01 preferably corresponds to the working width of the at least one application unit 600 and/or of the at least one shaping unit 900 and/or of the at least one sheet delivery unit 1000. The working width of the processing machine 01, in particular sheet processing machine 01, is preferably at least 100 cm (one hundred centimeters), more preferably at least 130 cm (one hundred thirty centimeters), more preferably at least 150 cm (one hundred fifty centimeters), still more preferably at least 160 cm (one hundred sixty centimeters), still more preferably at least 200 cm (two hundred centimeters), and still more preferably at least 250 cm (two hundred fifty centimeters), still more preferably at least 280 cm (two hundred eighty centimeters).

A vertical direction V preferably denotes a direction that is preferably directed from a ground perpendicularly upwardly. The vertical direction V is preferably arranged parallel to the normal vector of a plane spanned by the transport direction T and the transverse direction A. The height of components is preferably in the vertical direction V. For example, in the region of the shaping device 900, the vertical direction V is preferably oriented so as to point from the print substrate 02 arranged in a processing point 910 toward a plate cylinder 901 of the shaping device 900.

A direction X preferably denotes the direction along the lateral extension of the substrate 02. In the case of a substrate 02 that is arranged in the processing machine 01, the direction X is preferably oriented parallel to the transverse direction A, that is, an axial direction. The direction X preferably points from a first side edge of the substrate 02 to a second side edge of the substrate 02 which is located opposite the first side edge. A direction Y preferably denotes the direction along the longitudinal extension of the substrate 02. In the case of a substrate 02 that is arranged in the processing machine 01, the direction Y is preferably oriented parallel to the transport direction T, that is, preferably points in the direction of the transport path. The direction Y preferably points from a trailing edge 04 of the substrate 02 to the leading edge 03 thereof. The leading edge 03 is preferably the edge 03 of the substrate 02 which, along the transport path in the processing machine 01, is the first edge of the substrate 02 to come in contact with the particular units 100; 300; 600; 700; 900; 1000, and in particular with the processing points 621; 910.

The processing machine 01 preferably comprises at least one substrate feed device 100, which more preferably is designed as a unit 100, in particular a substrate feed unit 100, and/or as a module 100, in particular a substrate feed module 100. In particular in the case of a sheet processing machine 01, the at least one substrate feed device 100 is preferably designed as a sheet feeder 100 and/or sheet feeder unit 100 and/or sheet feeder module 100. Preferably, the at least one substrate feed device 100 is the first unit 100 of the processing machine 01, in particular in the transport direction T. The substrate feed device 100 is preferably designed so as to feed substrate 02, preferably sheets 02, to succeeding processing units 600; 900. The substrate feed device 100 preferably separates the substrates 02 so that the substrates 02 are transported consecutively, preferably spaced apart from one another, through the processing machine 01. The at least one substrate feed device 100 preferably comprises at least one acceleration means, preferably at least one primary acceleration means and/or at least one secondary acceleration means, for accelerating the substrate 02 to the processing speed. The at least one substrate feed device 100 preferably comprises at least one front stop and/or at least one lateral stop and/or at least one rear stop, which preferably aligns the at least one substrate 02. For example, at least one stop is fixed or movable, toward the substrate 02 and/or away from the substrate 02. Preferably, the at least one substrate 02 is aligned in the at least one substrate feed device 100 by means of the at least one fixed or movable stop. For example, the processing machine 01 comprises at least one unit designed as a conditioning device, in particular a conditioning unit, which is more preferably designed as a module, in particular as a conditioning module. Such a conditioning device is, for example, designed as a pre-processing device, in particular as a pre-processing device for applying primer, or as a post-processing device, in particular as a post-processing device for applying varnish. The processing machine 01 preferably comprises at least one unit designed as a pre-processing device, in particular a pre-processing unit, which more preferably is designed as a module, in particular as a pre-processing module, and represents a conditioning device. The processing machine 01 preferably comprises at least one post-processing device. The processing machine 01 preferably comprises at least one unit 300, preferably an infeed device 300, which is more preferably designed as an infeed unit 300 and/or infeed module 300. Alternatively, the at least one infeed device 300 is designed as a component of the substrate feed device 100 or of another unit. The substrate feed device 100 preferably comprises the infeed unit 300. The infeed unit 300 preferably comprises the at least one feeder pile 104. The feeder pile 104 preferably comprises a multiplicity of sheets 02, which are preferably present at least temporarily in a stacked manner in a storage area 166. The alignment of the at least one substrate 02 is preferably carried out here. More preferably, the at least one fixed or movable stop for alignment is arranged in the infeed device 300.

The processing machine 01 comprises at least one processing unit 600; 900. The at least one processing unit 600; 900 preferably comprises at least one, preferably exactly one, plate cylinder 616; 901. For example, the processing machine 01 comprises at least one unit, preferably at least two, more preferably at least four, more preferably at least six, for example eight, units 600, for example the application unit 600, which is preferably designed as a module 600, in particular an application module 600. An application unit 600 is preferably one embodiment of a processing unit 600. The at least one application unit 600 is preferably arranged and/or designed based on the function and/or application method. The at least one application unit 600 is preferably used to apply at least one respective application fluid or coating agent over the entire surface area and/or at least a portion of the surface area of the sheets 02. One example of an application unit 600 is a printing unit 600 or printing module 600, which is used in particular for applying printing ink and/or ink onto substrate 02, in particular sheets 02. In particular, the at least one application unit 600 is designed to apply application fluid, preferably printing ink and/or ink, for example over the entire surface area and/or a portion of the surface area of the sheets 02. Above and below, an optionally provided priming unit and/or an optional varnishing unit may also be considered to be such an application unit 600 or printing unit 600. The at least one application unit 600 preferably comprises the at least one application mechanism 614. At least one first application unit 600 in the transport direction T is preferably designed as a priming unit. At least one last application unit 600 in the transport direction T is preferably designed as a varnishing unit. Preferably, at least one, preferably at least four, application units 600, which are preferably arranged downstream from the priming unit and/or which are arranged upstream from the varnishing unit, are designed as a printing unit 600. Above and below, the at least one application unit 600 is preferably referred to as a forward processing unit 600. In particular, at least one succeeding processing unit 900, which is preferably designed as a shaping unit 900, is arranged after the at least one forward processing unit 600, which is preferably designed as an application unit 600. Preferably, at least one substrate 02, in particular sheet 02, is printed and/or coated and/or primed in the at least one forward processing unit 600, which is preferably designed as an application unit 600.

Independently, in particular, of the function of the application fluid that can be applied by the application units 600, these units can preferably be distinguished in terms of the application method thereof. One example of an application unit 600 is a forme-based application unit 600, which comprises, in particular, at least one fixed, physical, and preferably exchangeable printing forme for the application of printing fluid. Forme-based application units 600 preferably operate according to a planographic printing process, in particular an offset planographic printing process, and/or according to a gravure printing process, and/or according to a letterpress printing process, in particular preferably according to a flexographic printing process. The corresponding application unit 600 is preferably a flexographic application unit 600 or flexographic printing unit 600, in particular a flexographic application module 600 or flexographic printing module 600. In another preferred embodiment, the at least one application unit 600 is designed as an offset printing unit 600. For example, the processing machine also comprises different application units 600 of different printing methods, which are preferably arranged one behind the other along the transport direction T. A preferred embodiment of the application mechanism 614 is intended to provide application fluid from beneath onto, for example to print, substrate 02, in particular sheets 02 and/or print substrate 02. In this preferred embodiment of the application mechanism 614, the plate cylinder 616 is preferably arranged beneath the impression cylinder 617. In an alternative embodiment, the sheets 02 are printed from above. The printing unit 600 is then preferably designed in a mirror-inverted order and has design adaptations. The sheets 02 are preferably die-cut on the opposite side of the print image. This is why printing from beneath is the preferred embodiment.

The at least one application unit 600, preferably each application unit 600, preferably comprises at least one drive. The at least one application unit 600, preferably each application unit 600, preferably comprises at least one drive in the circumferential direction of the at least one plate cylinder 616 of the processing unit 600. The at least one drive in the circumferential direction of the at least one plate cylinder 616 of the processing unit 600, preferably of the plate cylinder 616 of the application unit 600, is preferably designed so as to accelerate and/or decelerate in each case the plate cylinder 616 of the processing unit 600, preferably the plate cylinder 616 of the application unit 600, in the circumferential direction. In addition or as an alternative, the at least one drive in the circumferential direction of the at least one plate cylinder 616 of the processing unit 600, preferably of the plate cylinder 616 of the application unit 600, is in each case designed to adapt a processing length of the processing unit 600, preferably a processing length of the plate cylinder 616, by accelerating and/or decelerating the plate cylinder 616 in the circumferential direction. The at least one drive in the circumferential direction of the at least one plate cylinder 616 of the processing unit 600 preferably in each case accelerates and/or decelerates the plate cylinder 616 of the processing unit 600 in the circumferential direction. In addition or as an alternative, the at least one drive in the circumferential direction of the at least one plate cylinder 616 of the processing unit 600 in each case preferably adapts a processing length of the processing unit 600 by accelerating and/or decelerating the plate cylinder 616 in the circumferential direction. The at least one plate cylinder 616 can preferably be accelerated and/or decelerated in the circumferential direction by means of the at least one drive, preferably a dedicated drive. Preferably, the at least one plate cylinder 616 comprises at least one drive, preferably a dedicated drive, more preferably a closed loop position-controlled electric motor, for axially adjusting the plate cylinder 616. The at least one processing unit 600, which is preferably designed as an application unit 600, preferably comprises at least one drive for axially adjusting the at least one plate cylinder 616 of the processing unit 600. The at least one drive for axially adjusting the at least one plate cylinder 616 of the processing unit 600 is preferably designed so as to adjust in each case the plate cylinder 616 of the processing unit 600 axially, preferably in the transverse direction A. The at least one plate cylinder 616 is preferably axially adjustable. The at least one plate cylinder 616 of the at least one application unit 600 is preferably axially adjusted by means of the at least one drive for axially adjusting the plate cylinder 616. The axial adjustment is preferably carried out while the processing machine 01 is being set up for a new processing order. More preferably, the axial adjustment is carried out additionally or alternatively during the processing operation of substrate 02. For example, the axial adjustment is controlled manually by an operator. Preferably, as an alternative, the at least one drive of the plate cylinder 616, preferably at least the axial adjustment, is controlled by the at least one inspection device 726; 728; 916, preferably by the color register monitoring system 728.

The processing machine 01, for example, comprises at least one unit designed as a drying device, in particular a drying unit, which is more preferably designed as a module, in particular as a drying module. As an alternative or in addition, at least one drying device 506 and/or at least one after-drying device, for example, is a component of at least one unit 100; 300; 600; 700; 900; 1000 preferably designed as a module 100; 300; 600; 700; 900; 1000. For example, at least one application unit 600 comprises at least one drying device 506 and/or comprises at least one unit 700 designed as a transport device 700 and/or at least one unit designed as a transport unit 700. For example, the at least one drying device 506 is arranged at a transport unit 700 succeeding the processing unit 600. For example, at least one inspection device 726; 728 is additionally arranged at this transport unit 700. As an alternative, the at least one inspection device 726; 728 is arranged at a further, for example succeeding, transport unit 700. Preferably, at least one drying unit is arranged downstream from at least one application unit 600, preferably at least the last application unit 600 of the processing machine 01, more preferably each application unit 600, in the transport direction T. The drying unit is designed, for example, as an IR radiation dryer, a UV dryer or radiant heat dryer, preferably based on the applied printing fluid, in particular for drying the same.

The processing machine 01 preferably comprises at least one transport device 700, which more preferably is designed as a unit 700, in particular the transport unit 700, and/or as a module 700, in particular as a transport module 700. The transport device 700 is also referred to as a transport means 700. In addition, or as an alternative, the processing machine 01 preferably comprises transport devices 700, for example as components of other units and/or modules. Preferably, the at least one transport device 700 comprises at least one drive, preferably a dedicated drive, for example at least one dedicated drive $M_E$ for axially adjusting at least one transport element 701 and/or at least one main drive, for example at least one main drive M for driving in the circumferential direction, preferably for rotationally, in particular rotatively, driving at least one transport element 701. Preferably, at least one transport unit 700 of an alignment segment 750 comprises the at least one dedicated drive $M_E$. For example, at least one transport unit 700 comprises at least one main drive M between two application units 600, in a preferred refinement additionally at least one dedicated drive $M_E$. Preferably, as an alternative, the at least one transport unit 700 does not comprise a dedicated drive $M_E$ between two application units 600, and only comprises at least one main drive M.

The processing machine 01 preferably comprises at least one shaping device 900, which more preferably is designed as a unit 900, in particular as a shaping unit 900 or die-cutting unit 900, and/or as a module 900, in particular as a shaping module 900 or die-cutting module 900 and/or as a die-cutting device 900. A shaping unit 900 is preferably one embodiment of a processing unit 900. The processing machine 01 preferably comprises at least one shaping unit 900 designed as a die-cutting unit 900. The at least one shaping device 900 is preferably designed as a rotary die-cutting device 900 and/or preferably comprises at least one shaping mechanism 914 or die-cutting mechanism 914, more preferably a rotary die cutting mechanism. A shaping device 900 shall also be understood to mean an embossing device and/or a creasing device. A perforating device is preferably likewise a form of a die-cutting device 900. A die-cutting unit 900 preferably comprises at least one die-cutting tool and/or creasing tool and/or perforating tool and/or embossing tool, wherein preferably at least one die-cutting tool is provided. The at least one die-cutting unit 900 preferably in each case comprises the at least one shaping mechanism 914 preferably designed as a die-cutting mechanism 914. The shaping mechanism 914 designed as a die-cutting mechanism 914 preferably comprises at least one plate cylinder 901 designed as a die-cutting cylinder 901. The plate cylinder 901 of the shaping unit 900 preferably comprises at least one drive assigned thereto, preferably a dedicated drive, and more preferably a closed loop position-controlled electric motor.

Above and below, the at least one shaping unit 900 is preferably referred to as a succeeding processing unit 900. Preferably, at least one substrate 02, in particular sheet 02, is die-cut and/or creased and/or embossed and/or perforated in the at least one, preferably succeeding, processing unit 900, which is preferably designed as a shaping unit 900.

The at least one shaping unit 900, preferably the processing unit 900 following an application unit 600, preferably comprises at least one drive in the circumferential direction of the at least one plate cylinder 901 of the processing unit 900. The at least one drive in the circumferential direction of the at least one plate cylinder 616; 901 of the processing unit 600; 900, preferably of the plate cylinder 901 of the die-cutting unit 900, is preferably designed so as to accelerate and/or decelerate in each case the plate cylinder 616; 901 of the processing unit 600; 900, preferably the plate cylinder 901 of the die-cutting unit 900, in the circumferential direction. In addition or as an alternative, the at least one drive in the circumferential direction of the at least one plate cylinder 616; 901 of the processing unit 600; 900, preferably of the plate cylinder 901 of the die-cutting unit 900, is in each case designed to adapt a processing length of the processing unit 600; 900, preferably a processing length of the plate cylinder 616; 901, by accelerating and/or decelerating the plate cylinder 616; 901 in the circumferential direction. The at least one drive in the circumferential direction of the at least one plate cylinder 901 of the processing unit 900 preferably in each case accelerates and/or decelerates the plate cylinder 901 of the processing unit 900 in the circumferential direction. In addition or as an alternative, the at least one drive in the circumferential direction of the at least one plate cylinder 901 of the processing unit 900 in each case preferably adapts a processing length of the processing unit 900 by accelerating and/or decelerating the plate cylinder 901 in the circumferential direction. The at least one plate cylinder 901 can preferably be accelerated and/or decelerated in the circumferential direction by means of the at least one drive, preferably a dedicated drive.

Preferably, the at least one plate cylinder 901 comprises at least one drive, preferably a dedicated drive, more preferably a closed loop position-controlled electric motor, for axially adjusting the plate cylinder 901. The at least one, preferably succeeding, processing unit 900, which is preferably designed as a die-cutting unit 900, preferably comprises at least one drive for axially adjusting the at least one plate cylinder 901 of the processing unit 900. The at least one drive for axially adjusting the at least one plate cylinder 901 of the processing unit 900 is preferably designed so as to adjust in each case the plate cylinder 901 of the processing unit 900 axially, preferably in the transverse direction A. The at least one plate cylinder 901 is preferably axially adjustable. The at least one plate cylinder 901 of the at least one shaping unit 900 is preferably axially adjusted by means of the at least one drive for axially adjusting the plate cylinder 901. The axial adjustment is preferably carried out while the processing machine 01 is being set up for a new processing order. More preferably, the axial adjustment is carried out additionally or alternatively during the processing operation of substrate 02. For example, the axial adjustment is controlled manually by an operator. For example, as an alternative, the axial adjustment is controlled by the at least one inspection device 726; 728; 916, preferably by the die-cutting monitoring system 916.

The at least one shaping unit 900, preferably the at least one succeeding processing unit 900, preferably comprises at least one drive of at least one anvil cylinder 902 of the processing unit 900. The at least one drive of the anvil cylinder 902 of the processing unit 900 is preferably designed to adapt a processing length of the processing unit 900 by accelerating and/or decelerating the anvil cylinder 902 in the circumferential direction. The at least one drive of the anvil cylinder 902 of the processing unit 900 preferably adapts a processing length of the processing unit 900 by accelerating and/or decelerating the anvil cylinder 902 in the circumferential direction. Advantageously, the at least one plate cylinder 901 of the shaping device 900 is arranged in the vertical direction V above the at least one anvil cylinder 902. Advantageously, gravity is used in the processing operation to support the force application.

The sheet processing machine 01 is preferably characterized in that the at least one separation device 903 for removing at least one scrap piece from at least one sheet 02 is arranged after the at least one shaping point 910 along the transport path provided for the transport of sheets 02. The separation device 903 is preferably designed to entirely remove scrap pieces from the particular sheet 02. The at least one separation device 903 is thus used, in particular, to separate the off-cut pieces, in particular of the former portions of the sheet 02 that were already entirely or partially detached from the sheet 02 and are to be removed from the sheet 02, from multiple-ups, in particular those portions of the sheet 02 that are to continue to be treated as sheets 02 and, if necessary, to be further processed. The at least one separation device 903 is designed as a separation unit 903 and/or as a separation module 903, for example. As an alternative, the at least one separation device 903 is a component of another unit 900 or module 900, in particular of the at least one shaping unit 900 or shaping module 900.

The at least one separation device 903 preferably comprises at least one transport means 904 designed as a separation transport means 904, in particular for transporting sheets 02. The at least one separation transport means 904 is preferably used to transport respective sheets 02 along the transport path provided for the transport of sheets 02 and/or in the direction of transport T while scrap pieces are removed from the respective sheets 02. The scrap pieces are preferably transported in a respective direction that has at least one component which is oriented orthogonally to the transport direction T, preferably counter to a vertical direction V, for example vertically downwardly. Preferably, at least the force of gravity is also utilized to remove such scrap pieces from the particular sheet 02. In this way, it is preferably only necessary to apply a force that severs the respective scrap piece from the respective sheet 02, and the respective scrap piece is then carried away by gravity in a direction that has at least one component which is oriented orthogonally to the transport direction T, preferably downwardly.

The processing machine 01 preferably comprises at least one unit 1000 designed as a substrate output device 1000, in particular a delivery 1000, in particular a sheet delivery 1000, in particular a delivery unit 1000, which is more preferably designed as a module 1000, in particular as a delivery module 1000. The at least one substrate output device 1000 is preferably arranged in the transport direction T after the at least one shaping unit 900, more preferably after the at least one separation device 903, and more preferably subsequent to the at least one transport means 906. The substrate output device 1000 preferably comprises at least one delivery pile carrier 48 and at least one diverted delivery 51. The substrate output device 1000 designed as a delivery 1000 preferably comprises at least one sheet diverter 49, which can preferably be controlled by closed loop and/or open loop, and which is designed to guide sheets 02 either to the delivery pile carrier 48 or the diverted delivery 51. Preferably the products, preferably products that can be further processed into end products, are deposited onto the at least one delivery pile carrier 48. Preferably, at least one sample sheet and/or sheet including wasted paper is deposited in the at least one diverted delivery 51. For example, the at least one sheet diverter 49 controls the transport path so that the processed sheet 02 is either deposited onto the delivery pile carrier 48 or in the diverted delivery 51.

The processing machine 01, for example, comprises at least one unit designed as a post-press processing device, in particular a post-press processing unit, which is more preferably designed as a module, in particular as a post-press processing module. The post-press processing unit is preferably arranged after the at least one shaping device 900 in the transport direction T. For example, the post-press processing unit is arranged after the at least one sheet delivery 1000 in the transport direction T. For example, the at least one post-press processing device is designed in each case as a gluing device and/or folding device.

The processing machine 01 preferably comprises transport means 700; 904; 906 at one or more points. The at least one transport unit 700 is preferably a transport means 700. The at least one transport means 700; 904; 906 is preferably designed so as to move substrate 02, preferably sheets 02, more preferably individual sheets 02, preferably along the transport path through the processing machine 01. Preferably, in each case at least one transport means 700, preferably at least one suction transport means 700, is arranged at least between two consecutive processing units 600; 900. Preferably, the at least one transport means 700; 904; 906 comprises at least one, preferably at least two, more preferably at least five, more preferably at least nine, more preferably at least eleven, transport elements 701. Preferably, the at least one transport element 701 is in contact with the substrate 02, at least if present. The at least one transport element 701 is preferably designed so as to move the substrate 02.

At least one of these transport means 700; 906 is preferably designed as a suction transport means 700; 906, in particular as a suction belt and/or as a suction box belt and/or as a roller suction system and/or as a suction roller. The at least one transport unit 700 is preferably designed as a suction transport means 700. Such suction transport means 700; 906 are preferably used to move substrate 02 forward in a controlled manner and/or to enable movements while the substrate 02 is held against at least one counterpressure surface of the corresponding suction transport means 700; 906. A relative vacuum is preferably used in the process to pull and/or to press the substrate 02, preferably the sheet 02, against at least one transport surface 702. A transporting movement of the substrates 02 is preferably produced by a corresponding, in particular revolving, movement of the at least one transport surface 702. As an alternative or in addition, the substrate 02 is held in the path thereof, for example along the transport path provided for the transport of substrate 02, by the at least one suction transport means 700; 906, and a transporting movement of the substrate 02 is produced in the process by a force that is predefined by another transport means 700; 904; 906 situated upstream and/or downstream, for example. The vacuum is in particular a vacuum relative to an ambient pressure, in particular relative to an atmospheric pressure. The suction transport means 700; 906 shall thus preferably be understood to mean a device that has at least one counterpressure surface, which more preferably is designed as a sliding surface and/or in particular as a movable transport surface 702, and which is at least partially movable, for example, at least in the transport direction T.

The respective suction transport means 700; 906 furthermore preferably comprises at least one vacuum chamber, which more preferably is connected to at least one vacuum source by means of a suction line. The vacuum source comprises a fan, for example. The at least one vacuum chamber has at least one suction opening 703, which is used to apply suction to the substrate 02. Depending on the embodiment of the suction transport means 700; 906 and the size of the substrate 02, the substrates 02 are drawn by suction into a position in which they close the at least one suction opening 703 or are merely drawn by suction against a transport surface 702 in such a way that ambient air can still travel past the substrate 02 and into the suction opening 703. The transport surface 702 has one or more intake openings, for example. The intake openings are preferably used to pass a vacuum from the suction opening 703 of the vacuum chamber to the transport surface 702, in particular without pressure losses or with very low pressure losses. As an alternative or in addition, the suction opening 703 acts on the substrate 02 to be transported in such a way that the same is drawn by suction against the transport surface 702, preferably without the transport surface 702 having any intake openings. At least one deflection means is provided, for example, which directly or indirectly ensures a revolving movement of the at least one transport surface 702. The at least one deflection means and/or the transport surface 702 preferably are self-propelled and/or can be self-propelled, in particular to ensure a movement of the substrate 02 in the transport direction T. Alternatively, the transport surface 702 allows substrate 02 to slide along the transport surface 702.

A first embodiment of a suction transport means 700; 906 is a suction belt. A suction belt shall be understood to mean a device that comprises at least one flexible transport belt, the surface of which serves as a transport surface 702. The at least one transport belt is preferably deflected by deflection means designed as deflection rollers and/or deflecting cylinders and/or is preferably self-contained, in particular such that continuous circulation is enabled. The at least one transport belt preferably has a multiplicity of intake openings. The at least one transport belt preferably covers the at least one suction opening 703 of the at least one vacuum chamber over at least a portion of its circulation path. More preferably, the vacuum chamber is then only connected to a surrounding environment and/or to substrate 02 by way of the intake openings of the at least one transport belt. Support means are preferably provided, which prevent the at least one transport belt from being pulled too far or at all into the vacuum chamber and/or which ensure that the transport surface 702 assumes a desired shape, for example such that it forms a flat surface, at least in the region in which the intake openings are connected to the vacuum chamber. A revolving movement of the at least one transport belt then results in a forward movement of the transport surface 702, with the substrate 02 being held securely on the transport surface 702 precisely in the region where it is situated opposite the suction opening 703 that is covered by the at least one transport belt, with the exception of the intake openings.

A second, preferred, embodiment of the transport means 700; 906, preferably of a suction transport means 700; 906, is a roller suction system. A roller suction system shall be understood to mean a device in which the at least one transport surface 702 is formed of at least sections of lateral surfaces of a multiplicity of transport rollers 701 and/or transport cylinders 701. Preferably, the at least one transport element 701 is designed as at least one transport roller 701 or transport cylinder 701. Thus, each of the transport rollers 701 and/or transport cylinders 701 forms a part of the transport surface 702 that is closed, for example, and/or that circulates as a result of rotation. The roller suction system preferably has a multiplicity of suction openings 703. These suction openings 703 are preferably arranged at least between adjacent transport rollers 701 and/or transport cylinders 701. At least one covering mask is provided, for example, which preferably represents a boundary of the vacuum chamber. The covering mask preferably has the multiplicity of suction openings 703. The covering mask preferably forms a substantially flat surface. The transport rollers 701 and/or transport cylinders 701 are preferably arranged in such a way that they are intersected by this flat surface and more preferably protrude only slightly, for example only a few millimeters, beyond this flat surface, in particular in a direction facing away from the vacuum chamber. The suction openings 703 then preferably have a frame-like configuration, with each opening surrounding at least one of the transport rollers 701 and/or transport cylinders 701. A movement in circumferential direction, preferably a revolving or rotational, preferably rotative, movement of the transport rollers 701 and/or transport cylinders 701 then results in a forward movement of the corresponding parts of the transport surface 702. In the process, substrate 02, preferably a sheet 02, is preferably held securely on the transport surface 702 exactly in the region where it is situated opposite the suction openings 703. Preferably, a line-shaped contact region of the substrate 02 with the at least one transport roller 701 or transport cylinder 701 is present in the region of the transport surface 702. The driving forces are preferably transferred from the at least one transport element 701 to the substrate 02 by friction fit. The transport unit 700 is preferably in each case designed as at least the one suction transport means 700 comprising the at least one roller suction system. The roller suction system is preferably also referred to as a suction box.

A third embodiment of a suction transport means 700; 906 is a suction box belt. A suction box belt shall be understood to mean a device that comprises a plurality of in particular circulating suction boxes, each of which has an outer surface that serves as a transport surface 702.

A fourth embodiment of a suction transport means 700; 906 is at least one suction roller. A suction roller shall be understood to mean a roller which has a lateral surface that serves as a transport surface 702 and has a multiplicity of intake openings, and which has at least one vacuum chamber in the interior thereof, which is connected to at least one vacuum source, for example by means of a suction line.

A fifth embodiment of a suction transport means 700; 906 is at least one sliding suction device. The sliding suction device is preferably designed as a passive transport means and is used, in particular, to establish boundary conditions with respect to a position of a respective substrate 02, without causing the substrate 02 itself to move. The respective sliding suction device preferably includes at least one sliding surface and at least one vacuum chamber and at least one suction opening. The at least one sliding surface then serves as a counterpressure surface and serves as a transport surface 702. In the case of the sliding suction device, the transport surface 702 designed as a sliding surface is preferably not moved. The sliding surface serves as a counterpressure surface against which the corresponding substrates 02 are pressed. The substrates 02 can nevertheless be moved along the sliding surface, in particular to the extent that they are acted upon otherwise by a force that is at least also oriented parallel to the sliding surface. A region between two driven suction transport means 700; 906 can be bridged by means of a sliding suction device, for example.

It is possible for different embodiments of suction transport means 700; 906 to be combined. These suction transport means can, for example, comprise at least one shared vacuum source and/or at least one shared vacuum chamber and/or can cooperate as a suction transport means 700; 906 and/or can be arranged one behind the other and/or side by side. Each such combination is then preferably to be assigned to at least two of the embodiments of suction transport means 700; 906.

Regardless of the embodiment of the particular suction transport means 700; 906, at least two configurations of the particular suction transport means 700; 906 as described below are possible.

In a first, preferred arrangement, a section of the transport path provided for the transport of substrate 02 which is defined by the transport unit 700, and preferably the particular suction transport means 700; 906, is situated beneath the, preferably movable, transport surface 702 of the transport unit 700. This means that the transport surface 702 of the transport unit 700 is located on one side of the surface of the transport path, that is, contacts a substrate 02 from the one side, with transport surfaces 702 of the transport unit 700 preferably only being arranged above the transport path. The transport surface 702 is preferably used as a counterpressure surface and, for example, can be moved, at least partially, at least in the transport direction T. For example, the suction openings 703 or intake openings of the suction transport means 700; 906, at least while these are connected to the at least one vacuum chamber, are preferably at least also or only pointed downwardly and/or the suctioning action thereof is preferably at least also or only directed upwardly. The substrates 02 are then transported, preferably in a hanging state, by the suction transport means 700; 906.

In a second arrangement, a section of the transport path provided for the transport of substrate 02 which is defined by the transport unit 700, and preferably the particular suction transport means 700; 906, is situated above the, in particular movable, transport surface 702. This means that the at least one transport surface 702 of the transport unit 700 is located on one side of the surface of the transport path, that is, contacts a substrate 02 from the one side, with transport surfaces 702 of the transport unit 700 preferably only being arranged beneath the transport path. The transport surface 702 is preferably used as a counterpressure surface and, for example, can be moved, at least partially, at least in the transport direction T. For example, the suction openings 703 or intake openings of the suction transport means 700; 906, at least while these are connected to the at least one vacuum chamber, are preferably at least also or only pointed upwardly and/or the suctioning action thereof is preferably at least also or only directed downwardly. The substrates 02 are then transported, preferably lying flat, by the suction transport means 700; 906.

Above and below, a machine cycle preferably describes a sum of those process steps and/or procedures that take place within the processing machine 01, preferably within a unit 100; 300; 600; 700; 900; 1000, in a consistent order. The relevant process steps and/or procedures are preferably only repeated during the next machine cycle in the same order. A machine cycle preferably has at least one machine phase, in particular at least a plurality of machine phases. For example, a clock-generating drive shaft carries out a complete rotation about the axis of rotation thereof within a machine cycle. The virtual and/or electronic master axis preferably defines the machine cycle. For example, each machine cycle comprises a processing operation of a substrate 02 within a processing unit 600; 900. For example, a substrate 02 is moved within a machine cycle from a first point of the transport path, in the transport direction T, of a transport unit 700 to a last point of the transport path, in the transport direction T, of this transport unit 700. The position of the leading edge 03 of the substrate 02 during the infeed of the substrate 02 into the processing machine 01 preferably takes place in each case at the same point in time within a machine cycle, that is, preferably at the same position in the circumferential direction. For example, printing, transporting and/or die cutting are preferably carried out simultaneously during a machine cycle in differing units 100; 300; 600; 700; 900; 1000 on differing substrates 02. Preferably, each substrate 02 is fed to a machine cycle of the processing machine 01, in particular the first processing unit 600; 900 thereof, preferably from the at least one feeder pile 104 of the substrate feed device 100. Within a machine cycle, a substrate 02 is preferably processed in a processing unit 600; 900. During a machine cycle, a plate cylinder 616; 901 preferably carries out an integer multiple of a revolution of 360°, more preferably exactly a revolution of 360°.

The length of the circumference in the circumferential direction of a plate cylinder 616; 901 is preferably identical to an integer multiple of, preferably one time, a length of a distance along the transport path of substrate 02 which a substrate 02 travels within a machine cycle. The length of the circumference preferably corresponds to the length of a distance between a leading end, in particular the leading edge 03, of a first substrate 02 and the leading end, in particular the leading edge 03, of a further substrate 02 following the same. The length is preferably at least 1000 mm (one thousand millimeters), preferably at least 1300 mm, more preferably at least 1500 mm, more preferably at least 1650 mm, and/or no more than 2500 mm (two thousand five hundred millimeters), preferably no more than 2000 mm, more preferably no more than 1800 mm, more preferably no more than 1700 mm. For example, the length of the circumference in the circumferential direction of a plate cylinder 616; 901 is at least 1670 mm and/or no more than 1680 mm, in particular 1676 mm.

Preferably, at least one transport unit is, for example at least two transport units 700 are arranged in each case between two consecutive processing units 600; 900. Preferably, at least one transport unit 700 is arranged upstream from the first application unit 600 in the transport direction T. Preferably, at least two, preferably at least four, more preferably at least five, transport units 700 are arranged between the last processing unit 600, which is preferably designed as an application unit 600, and at least one unit 900, which is preferably designed as a shaping unit 900. Preferably, at least one processing unit 600; 900, preferably the at least one application unit 600, including the at least one application mechanism 614 designed as a printing mechanism 614, is arranged after the first transport unit 700 in the transport direction T. The at least one application unit 600 is preferably designed so as to apply at least one print image onto the substrate 02. The at least one print image is preferably visible, for example colored. For example, in addition or as an alternative, at least one application unit 600 transfers at least one colorless print image, for example a varnish application, onto the at least one substrate 02. The at least one application unit 600 preferably in each case comprises the at least one printing unit 614 including the plate cylinder 616. The plate cylinder 616 preferably comprises a drive assigned thereto, preferably at least one dedicated drive, preferably at least one closed loop position-controlled electric motor. Preferably, the at least one application unit 600 comprises at least one drive for axially adjusting the at least one plate cylinder 616 of the at least one application unit 600 and/or at least one drive in the circumferential direction of the at least one plate cylinder 616 of the at least one application unit 600. The at least one application unit 600 is preferably embodied as a flexographic application unit 600 or as an offset printing unit 600. The processing machine 01 preferably comprises at least four application units 600, in particular flexographic application units 600. For example, the processing machine 01 comprises at least six, for example eight and/or no more than ten, application units 600, wherein the individual application units 600 preferably at least partially differ in the printing fluid they process and/or a print image element they apply onto the print substrate 02. Preferably, at least one respective transport means 700 is arranged in each case between two application units 600. The at least one printing mechanism 614 is preferably designed as a flexographic printing unit, which is in particular designed according to the principle of the flexographic printing method for applying printing fluid onto the sheet 02. In a preferred embodiment, the application mechanism 614 comprises the at least one plate cylinder 616, at least one impression cylinder 617, more preferably additionally at least one anilox roller 618 and at least one ink fountain 619. The ink fountain 619 preferably includes printing fluid and is designed to dispense the printing fluid to the anilox roller 618. The anilox roller 618 is designed to transfer the printing fluid to at least one printing plate of the plate cylinder 616 for printing a print substrate 02. The plate cylinder 616 and the impression cylinder 617 preferably define a processing point 621 of the application mechanism 614. The processing point 621, which is designed as a press nip 621 and through which sheets 02 can preferably pass through the printing mechanism 614, is preferably defined by an outer cylindrical surface of the plate cylinder 616 and an outer cylindrical surface of the impression cylinder 617. The press nip 621 is preferably the region in which the particular plate cylinder 616 on the one hand and the particular impression cylinder 617 on the other hand are closest to one another.

In a preferred embodiment of the processing machine 01, preferably at least one printing unit 600, preferably each printing mechanism 614, comprises the at least one plate cylinder 616. The at least one plate cylinder 616 of the at least one printing unit 600 comprises at least one working zone. The working zone of the plate cylinder 616 is preferably the region of the cylinder circumference, in particular of the outer cylindrical surface, of the plate cylinder 616, which is designed so as to process at least one substrate 02, that is, preferably makes contact with a substrate 02 at at least one point in time and preferably modifies the shape and/or mass and/or surface structure and/or print thereof in the process. The plate cylinder 616 preferably comprises the at least one printing plate. The plate cylinder 616 more preferably comprises at least the at least one printing plate and at least one mount 626 for the at least one printing plate. The working zone of the plate cylinder 616 is preferably the region of the at least one printing plate, in particular the outer cylindrical surface thereof, which is designed so as to process at least one substrate 02, that is, preferably makes contact with a substrate 02 at at least one point in time and preferably modifies the shape and/or mass and/or surface structure and/or print thereof in the process. The length of the printing plate in the circumferential direction preferably exceeds the length of the working zone, for example, to enable the printing plate to be attached by way of the at least one mount 626. The length of the working zone in the circumferential direction is preferably substantially identical to the length of at least one substrate 02, preferably of exactly one substrate 02. The length of the working zone in the circumferential direction is preferably at least 80%, preferably at least 85%, more preferably at least 90%, more preferably at least 95%, identical to the length of the at least one substrate 02, preferably of the exactly one substrate 02. In the case of the plate cylinder 616 of the printing mechanism 614, the working zone is preferably the processing, preferably printing, region of the plate cylinder 616. The cylinder circumference of the at least one plate cylinder 616 is preferably matched to the length of the at least one substrate 02.

Preferably, at least one substrate 02, preferably exactly one substrate 02, is processed by way of a complete rotation of the at least one plate cylinder 616. During a machine cycle, the plate cylinder 616 preferably carries out an integer multiple of a revolution of 360°, more preferably exactly a revolution of 360°. The working zone is preferably between 20% and 95%, preferably between 30% and 90% of the length in the circumferential direction of the cylinder circumference, in particular of the outer cylindrical surface, of the plate cylinder 616. The remaining cylinder circumference, in particular the remaining outer cylindrical surface, of the plate cylinder 616 in the circumferential direction, which does not correspond to the working zone, preferably forms the processing-free region of the plate cylinder 616. In the case of the plate cylinder 616 of the printing mechanism 614, the processing-free region is preferably the non-printing region of the plate cylinder 616.

The mount 626 of the printing plate is designed as a clamping device, for example. The processing-free region of the plate cylinder 616 preferably comprises the mount 626 of the printing plate. In the circumferential direction of the plate cylinder 616, the processing-free region, preferably the non-printing region, of the plate cylinder 616 preferably has a length that is preferably at least 3%, preferably at least 5%, more preferably at least 8%, and/or no more than 15%, preferably no more than 10%, of the circumferential length of the plate cylinder 616. In a preferred embodiment, the non-printing region corresponds to a cylinder channel of the at least one plate cylinder 616. Preferably, the at least one impression cylinder 617 comprises at least one mount 627.

In the non-printing region of the outer cylindrical surface of the plate cylinder 616, preferably no printing fluid is transferred from the outer cylindrical surface of the plate cylinder 616 onto sheets 02 during a printing operation of the processing machine 01. Printing fluid is preferably only transferred from the plate cylinder 616 onto sheets 02 within the region of the outer cylindrical surface of the plate cylinder 616 which includes the at least one printing plate, in particular within the working zone. Preferably the at least one printing plate, more preferably exactly one printing plate, and the at least one non-printing region, preferably exactly one non-printing region, are arranged one behind the other along the circumferential direction of the outer cylindrical surface of the plate cylinder 616. In the direction of rotation of the plate cylinder 616, the mount 626 is preferably arranged before the printing region of the plate cylinder 616, more preferably a rear edge of the non-printing region of the plate cylinder 616 is arranged before the printing region of the plate cylinder 616 in the direction of rotation of the plate cylinder 616. A forward edge of the printing region of the plate cylinder 616 is preferably identical to the rear edge of the non-printing region of the plate cylinder 616.

In the transport direction T of substrate 02, at least one further processing unit 600; 900 preferably follows the at least one processing unit 600 that is designed as an application unit 600. Preferably, at least one second application unit 600 follows, and preferably at least four further application units 600 follow, a first application unit 600. Preferably, the at least one shaping device 900, preferably the at least one die-cutting unit 900, follows the at least one application unit 600, preferably the last application unit 600 of the application units 600. The at least one succeeding processing unit 600; 900 is thus preferably designed as an application unit 600, preferably comprising a flexographic printing unit, or as a die-cutting unit 900, preferably comprising a rotary die-cutting mechanism.

The at least one shaping device 900 including the at least one shaping mechanism 914 is preferably arranged after the at least one application unit 600, preferably after the last application unit 600, in the transport direction T. The at least one shaping device 900 is preferably designed as a die-cutting device 900 and/or as a rotary die-cutting device 900. For example, exactly one shaping device 900, in particular die-cutting device 900 and/or rotary die-cutting device 900, is provided. The at least one shaping device 900 preferably comprises at least one, and more preferably exactly one, processing point 910 preferably designed as a shaping point 910, which is formed by at least one, and more preferably exactly one plate cylinder 901, in particular designed as a die cylinder 901, on the one hand, and at least one counterpressure cylinder 902, preferably an anvil cylinder 902, on the other hand. The shaping point 910 is preferably the region in which the particular plate cylinder 901 on the one hand and the particular counterpressure cylinder 902 on the other hand are closest to one another. The at least one shaping point 910 is preferably designed as at least one die-cutting point 910.

During die-cutting, the die-cutting cylinder 901 is preferably arranged in the die-cutting position. During a job change, the die-cutting cylinder 901 preferably remains in the die-cutting position thereof, or the die-cutting cylinder 901 is transferred into a backed-away position, preferably in the vertical direction V. During operation of the processing machine 01, at least one tool of the die-cutting cylinder 901, preferably the cutting blade thereof, in the die-cutting position preferably comes in contact with the die-cutting blanket of the anvil cylinder 902. This position of the anvil cylinder 902 is referred to as the die-cutting or working position of the anvil cylinder 902. During operation of the machine 01, the die-cutting cylinder 901 and the anvil cylinder 902 are arranged in the die-cutting position. Preferably, the anvil cylinder 902 comprises at least one drive, for example at least one servo drive. The anvil cylinder 902 is preferably arranged so as to be transferable from the die-cutting position into a backed-away position by means of the servo drive. In a preferred embodiment, the anvil cylinder 902 can be predominantly adjusted in the vertical direction V on a linear guide 953. The backed-away position is a position in which the anvil cylinder 902 is moved out of contact with the die-cutting cylinder 901. The anvil cylinder 902 thus preferably essentially remains in the die-cutting position thereof. The anvil cylinder 902 is preferably only backed away so far that the anvil cylinder 902 makes no contact. The servo drive preferably only backs the anvil cylinder 902 away between 15 and 30 cm. The servo drive preferably has a travel length of no more than 50 cm, and more preferably 30 cm. The die-cutting cylinder 901 and/or the anvil cylinder 902 preferably undergo maintenance, in particular the tool thereof is changed, when the anvil cylinder 902 is arranged in the backed-away position.

The shaping device 900, in particular the shaping mechanism 914, preferably comprises the at least one tool, and more preferably the at least one plate cylinder 901 comprises the at least one tool. In a preferred embodiment, the tool of the shaping device 900, in particular of the shaping mechanism 914, preferably the tool of the plate cylinder 901, is at least temporarily in direct contact with the counterpressure cylinder 902, in particular in the region of the shaping point 910. The at least one plate cylinder 901 is preferably designed as a die-cutting cylinder 901. The at least one tool of the plate cylinder 901 is preferably designed as a shaping tool, in particular die-cutting tool. The at least one plate cylinder 901 designed as a die-cutting cylinder 901 preferably comprises the at least one die-cutting tool, which preferably comprises at least one blade, and more preferably perpendicularly arranged blades. The blades are preferably discontinuously arranged and differ depending on the die-cutting job. The at least one counterpressure cylinder 902 designed as an anvil cylinder 902 preferably comprises a cover or die-cutting blanket. The die-cutting blanket is preferably made of a plastic material and/or rubber and has slightly elastic properties. The die-cutting blanket is preferably made of a plastic material such as polyurethane or the like. The die-cutting blanket, for example, can be easily pushed in and at least partially return to its shape.

The at least one plate cylinder 901 of the shaping device 900 comprises at least one working zone. The working zone of the plate cylinder 901 is preferably the region of the cylinder circumference, in particular of the outer cylindrical surface, of the plate cylinder 901, which is designed so as to process at least one substrate 02, that is, preferably makes contact with a substrate 02 at at least one point in time and preferably modifies the shape and/or mass and/or surface structure and/or print thereof in the process. The at least one plate cylinder 901 preferably has a tool length of the at least one tool thereof by way of which the at least one substrate 02 is processed. The plate length or tool length is between 450 mm and 1600 mm, for example. The at least one plate cylinder 901 designed, in particular, as a die-cutting cylinder 901 preferably comprises the at least one tool designed as a shaping tool, preferably as a die-cutting tool. The at least one tool preferably defines the at least one working zone. The working zone is preferably the region of the plate cylinder 901 which is fitted with processing elements. In a preferred embodiment, the at least one shaping tool is mounted on a mounting plate. A plate cylinder 901 of a shaping unit 900 preferably has several holes and/or bore holes, at which the mounting plate and/or the shaping tool can be directly mounted and/or preferably is mounted. The working zone of the shaping tool is preferably defined as a surface having a position that extends in the radial direction through the tool forms extending furthest to the outside. The shaping tool preferably comprises several processing elements, preferably die-cutting elements. Such die-cutting elements can, for example, be designed as cutting dies. A height of the die-cutting elements is preferably between 10 mm and 30 mm. The working zone preferably has a dimension in the circumferential direction. The working zone preferably extends in the circumferential direction of the plate cylinder 901 from a tool start to a tool end. The tool start is preferably defined by the start of elevations of processing elements and/or die-cutting elements and/or tool parts, in particular cutting dies, which are provided for processing a substrate 02. The tool end is preferably defined by the end, in the circumferential direction, of a last elevation of processing elements and/or die-cutting elements and/or tool parts for processing a substrate 02. The length of the working zone in the circumferential direction is preferably substantially identical to the length of at least one substrate 02, preferably of exactly one substrate 02. The length of the working zone in the circumferential direction is preferably at least 80%, preferably at least 85%, more preferably at least 90%, more preferably at least 95%, identical to the length of the at least one substrate 02, preferably of the exactly one substrate 02. In the case of the plate cylinder 901 of the shaping device 900, the working zone is preferably the processing, preferably die-cutting, region of the plate cylinder 901. The cylinder circumference of the at least one plate cylinder 901 is preferably matched to the length of the at least one substrate 02. Preferably, at least one substrate 02, preferably exactly one substrate 02, is processed by way of a complete rotation of the at least one plate cylinder 901. During a machine cycle, the plate cylinder 901 preferably carries out an integer multiple of a revolution of 360°, more preferably exactly a revolution of 360°. The working zone is preferably between 20% and 95%, preferably between 30% and 90% of the length in the circumferential direction of the cylinder circumference, in particular of the outer cylindrical surface, of the plate cylinder 901. Covering shall in particular be understood to mean the projection of the working zone directly onto the outer cylindrical surface in the radial direction. The remaining cylinder circumference, in particular the remaining outer cylindrical surface, of the plate cylinder 901 in the circumferential direction, which does not correspond to the working zone, preferably forms the processing-free region of the plate cylinder 901. In the case of the plate cylinder 901 of the shaping device 900, the processing-free region is preferably the non-die-cutting region of the plate cylinder 901.

The working zone can preferably be subdivided into several sections having lengths in the circumferential direction. The working zone of the shaping tool preferably comprises several sections having working lengths for processing sections arranged one behind the other on a substrate 02. The number of sections depends on the number of processing sections of the job or the sections on a sheet 02. Accordingly, a section length of the working surface is assigned to each processing length of a section. The at least one plate cylinder 901 preferably has an inner radius between 175 mm and 300 mm. The radius, in particular the radius including the die-cutting elements, is preferably between 190 mm and 350 mm. A circumference of the plate cylinder 901 of the die-cutting mechanism 914, for example, also or alternatively of the plate cylinder 616 of the printing unit 614, is preferably 1600 mm±10%.

The surface of the at least one tool preferably has a curved design. Preferably, the at least one tool, which is preferably designed as a die-cutting tool, has a shell-like design, preferably a half-shell design. The inside diameter of the at least one tool is preferably adapted to the diameter of the surface of the at least one plate cylinder 901 so that the at least one plate cylinder 901 can preferably be fitted with the at least one tool. Preferably, at least two, for example at least three, tools are then arranged on the at least one die-cutting cylinder 901, in particular one behind the other in the circumferential direction of the die-cutting cylinder 901. Preferably, the at least two half-shell shaped tools have the same length in the circumferential direction. Preferably, all positions of the at least one die-cutting cylinder 901 which are intended for tools are fitted with a tool while substrate 02 is being processed.

The processing machine 01 preferably comprises several sensors 164; 622; 704; 722; 726; 728; 922; 916. These are preferably used to detect the at least one substrate 02, preferably the arrival thereof and/or the substrate 02 itself, at certain points of the machine. At least one sensor 164; 622; 704; 722; 726; 728; 922; 916 of the sensors 164; 622; 704; 722; 726; 728; 922; 916 preferably has at least a data connection to at least one control unit. Preferably, a monitoring result of the at least one sensor 164; 622; 704; 722; 726; 728; 922; 916, preferably of all sensors 164; 622; 704; 722; 726; 728; 922; 916, is displayed on at least one monitor and/or the function thereof is monitored via the at least one monitor and/or the at least one sensor 164; 622; 704; 722; 726; 728; 922; 916 is controlled via at least one control console of the processing machine 01.

At least one sensor 164; 622; 704; 722; 726; 728; 922; 916 of the sensors 164; 622; 704; 722; 726; 728; 922; 916 is designed so as to ascertain data. Depending on the configuration of the sensor 164; 622; 704; 722; 726; 728; 922; 916, the data are, for example, image data, data establishing a relationship between a print image and an edge of the substrate 02, data regarding the positioning of the substrate 02, data regarding a positioning of at least one component of the processing machine 01 and/or data regarding a speed of at least one component of the processing machine 01. The ascertained data are preferably transmitted to at least one control unit and/or preferably saved therein. The ascertained data are preferably evaluated in the at least one control unit. At least one component of the processing machine 01, for example at least one transport section 706 and/or at least one plate cylinder 616; 901, is preferably activated based on the ascertained data.

Preferably, preferably depending on the function and/or position, preferably at least one sensor 704; 726; 728; 916 of the sensors 164; 622; 704; 722; 726; 728; 922; 916 is designed as an image acquisition device, preferably as a camera, more preferably as a color camera, more preferably as a line scan camera, more preferably as at least one CMOS sensor and/or at least one CCD sensor. A sensor 704; 726; 728; 916 designed as an image acquisition device preferably inspects the processing result of the substrate 02 and/or at least one section of the substrate 02. The sensor 704; 726; 728; 916 designed as an image acquisition device is preferably an inspection device 704; 726; 728; 916 for inspecting the substrate 02. Preferably, at least one lighting unit 727, for example a line scan lighting unit or a ring lighting unit, is assigned to the at least one sensor 704; 726; 728; 916 designed as an image acquisition device. Preferably, a sensor 704; 726; 728; 916 designed as an image acquisition device records at least one image of the substrate 02, preferably at least one image of the part of the substrate 02 that is located in the detection zone of the sensor 704; 726; 728; 916 during the detection. Preferably, the sensor 704; 726; 728; 916 designed as an image acquisition device sends a signal upon recognizing the passing substrate 02, preferably in the form of an image, to the at least one control unit of the processing machine 01. The control unit preferably evaluates the at least one signal, preferably the at least one image, and/or controls at least one component of the processing machine 01 based on the received signal. Preferably, at least one alignment segment 750 and/or preferably at least one transport section 706 of at least one transport unit 700 is controlled by open loop and/or closed loop by way of at least one signal of the signals. The cylinders of the application units 600 and/or the cylinders of the shaping unit 900 are preferably controlled by open loop and/or closed loop by way of the signals. The processing machine 01 preferably comprises at least one sheet diverter 49 and/or at least one diverted delivery 51 for channeling substrate 02 out of the processing machine 01. If there are deviations in the print quality and/or the die-cutting quality, for example, the sheet diverter 49 is controlled by means of at least one signal of the sensors 726, 728, 916, and the substrate 02 deviating from the target state thereof is deflected in the transport path and preferably transported in this way into the diverted delivery 51.

The at least one application unit 600 is preferably designed so as to apply at least one print image onto the substrate 02. Preferably, at least one sensor 726 of the sensors 704; 726; 728; 916 which are preferably designed as an image acquisition device is designed as a printed image monitoring system 726. Preferably, the substrate 02, preferably the at least one print image of the substrate 02, which more preferably was applied prior to inspection onto the substrate 02 by at least one application unit 600, is inspected by the image acquisition device designed as a printed image monitoring system 726. The printed image monitoring system 726 preferably inspects the substrate 02, preferably each passing substrate 02, for defects of the substrate 02 per se and/or for defects in the processing of the particular substrate 02 and/or for defects of the at least one print image of the particular substrate 02. Defects of the substrate 02 per se are, for example, surface deformations, such as holes or buckling of the surface, and/or the basic color of the substrate 02, for example the color of the substrate 02 without further fluid application during the processing operation in the processing machine 01. Defects of the print image encompass, in particular, missing and/or additional image-producing elements of at least one print image element and, additionally or alternatively, the color of the print image, in particular the ink quality, and/or of the respective print image elements and, additionally or alternatively, spatters of printing fluid, for example in undesirable locations. The at least one inspection device 726 designed as a printed image monitoring system 726 is preferably arranged after the at least one application unit 600, preferably after the last application unit 600, and more preferably additionally before the at least one shaping unit 900. Preferably, the at least one printed image monitoring system 726 is connected, preferably in terms of the control, to the at least one sheet diverter 49 for channeling out substrate 02 and/or to at least one infeed of the substrate feed device 100 and/or to at least one marking device by means of the at least one control unit. If the deviation within a tolerance range of the controlled substrate 02, preferably at least the print image thereof, from a reference is minor, the operation of the processing machine 01 preferably continues. If a serial defect exists, that is, a defect that occurs on several substrates 02 in a row, with respect to a deviation of the controlled substrate 02, preferably at least the print image thereof, from a reference, the infeed for feeding new substrates 02 to be processed into the processing machine 01 is preferably stopped. The substrate 02 is preferably either deposited on a delivery pile carrier 48 or channeled out onto an alternative transport path by means of at least one sheet diverter 49, based on the detection of the substrate 02 by the at least one printed image monitoring system 726. When the substrate 02 meets the target value, and in particular does not show any deviation from the target value within tolerance limits, the substrate 02 is preferably deposited onto the delivery pile carrier 48. Preferably, when the inspected substrate 02 deviates from the reference thereof, for example due to a defect of the substrate 02 per se and/or due to a defect in the processing operation and/or due to a defect of the print image, the substrate 02 is preferably channeled out, preferably by means of the control system of the at least one sheet diverter 49. For example, this substrate 02 is guided onto an alternative transport path and is preferably deposited onto a deposit pile in the diverted delivery 51. For example, in addition or as an alternative, the at least one printed image monitoring system 726 is connected to the at least one marking device, which is preferably arranged along the transport path after the printed image monitoring system 726, by means of the at least one control unit. If the inspected substrate 02 deviates from the reference thereof, the marking device preferably marks the substrate 02, for example at least one multiple-up of the substrate 02 deviating from the reference thereof. This preferably allows the substrate 02, preferably at least the multiple-up, to be separated later from further substrates 02 that correspond to the reference. The substrate 02 is thus preferably either deposited on a delivery pile carrier 48 or channeled out onto an alternative transport path by means of at least one sheet diverter 49 based on the detection of the substrate 02 by the at least one printed image monitoring system 726, and/or an infeed of a substrate feed device 100 is stopped and/or a marking device marks the substrate 02.

Preferably, in addition or as an alternative, at least one sensor 728 of the sensors 704; 726; 728; 916, preferably designed as an image acquisition device, is designed as a color register monitoring system 728. The at least one inspection device 728 designed as a color register monitoring system 728 is preferably arranged after the at least one application unit 600, preferably after the last application unit, and more preferably additionally before the at least one shaping unit 900. The at least one color register monitoring system 728 preferably inspects register marks 16; 17; 18; 19; 21; 22; 23; 24 and/or at least one image-producing element of the substrate 02 for checking the color register and/or the perfecting register. In a preferred embodiment, the at least one color register monitoring system 728 inspects the register marks 16; 17; 18; 19; 21; 22; 23; 24, preferably for checking the color register and/or the perfecting register. For example, as an alternative or in addition to at least one register mark 16; 17; 18; 19; 21; 22; 23; 24, the at least one color register monitoring system 728 inspects at least one image-producing element of the substrate 02, for example at least one partial region of a print image which preferably differs from the surrounding area thereof in terms of color and/or contrast, preferably for checking the color register and/or the perfecting register. Above and below, the term register mark 16; 17; 18; 19; 21; 22; 23; 24 shall be understood to mean a mark for checking the register and/or the color register. Preferably, at least one register mark 16; 17; 18; 19; 21; 22; 23; 24, preferably in each case at least two register marks 16; 17; 18; 19; 21; 22; 23; 24, more preferably in each case exactly two register marks 16; 17; 18; 19; 21; 22; 23; 24, are applied to at least one relevant sheet 02 for each application unit 600 and/or for each application mechanism 614, for example a first register mark 16; 17; 18; 19 and a second register mark 21; 22; 23; 24 per application mechanism 614. In accordance with DIN 16500-2, a register, for example in multicolor printing, exists when individual print image elements and/or image-producing elements and/or color segments are combined in precise alignment to form a single print image. The register is also referred to as a color register. Circumferential registers, lateral registers and diagonal registers are preferably color registers with respect to certain spatial directions.

The register marks 16; 17; 18; 19; 21; 22; 23; 24, for example additionally or alternatively also the at least one image-producing element, are preferably compared to a reference. The reference is, for example, the target position thereof, referred to as a reference position 06; 07; 08; 09; 11; 12; 13; 14. Preferably, initially the at least one, for example two, register marks 16; 21, for example additionally or alternatively also the at least one image-producing element, of a first color, this being the color for register marks, are compared to the target position 06; 11 thereof. The color for register marks preferably corresponds to the application unit 600 having the greatest fluid application onto the substrate 02 during the present processing operation. The color for register marks is preferably a color rich in contrast, for example black or brown or blue. Preferably, the plate cylinder of the color for register marks is set up manually. The position of the color for register marks, preferably the definition of the target position thereof, is preferably aligned relative to the leading edge 03 of the substrate, for example additionally or alternatively relative to the processing of the at least one shaping unit 900. The further register marks 17; 18; 19; 21; 22; 23; 24, preferably additionally or alternatively also the at least one image-producing element, are preferably evaluated with respect to the position thereof relative to this at least one register mark 16; 21, that is, the register mark of the color for register marks. Preferably, the application units 600 are aligned with respect to one another, preferably the application units 600 are aligned with respect to the application unit 600 of the color for register marks, by means of the inspection of the register marks 16; 17; 18; 19; 21; 22; 23; 24, for example additionally or alternatively also the at least one image-producing element. Preferably, a plurality of substrates 02 are evaluated by means of the color register monitoring system 728, and the measurement results thereof are averaged. The application units 600 are preferably aligned based on the averaged measurement results, preferably for the succeeding substrates 02 that are to be processed.

The at least one color register monitoring system 728 is preferably connected to at least one drive by means of at least one control unit. Preferably, the at least one color register monitoring system 728 is connected by means of the at least one control unit to at least one drive for axially adjusting the at least one plate cylinder 616 of the at least one application unit 600 and/or to at least one adjusting device of the position of at least one printing forme of the plate cylinder 616 and/or to at least one drive in the circumferential direction of the at least one plate cylinder 616 of the at least one application unit 600. Preferably, the at least one drive for axially adjusting the at least one plate cylinder 616 of the at least one application unit 600 positions the plate cylinder 616 in the transverse direction A. Preferably, the at least one drive in the circumferential direction of the at least one plate cylinder 616 moves the plate cylinder in the circumferential direction, preferably in a rotational motion. Depending on the inspection by the at least one color register monitoring system 728, the at least one drive of at least one application unit 600 for axially positioning the plate cylinder 616 and/or at least one adjusting device of the position of at least one printing forme of the plate cylinder 616 and/or at least one drive moving the plate cylinder 616 in the circumferential direction is preferably activated by means of the at least one control unit.

A circumferential register preferably describes the alignment of the substrate 02 in the transport direction T. The circumferential register is preferably determined via the position of the register marks 16; 17; 18; 19; 21; 22; 23; 24 in the transport direction T, preferably along the direction Y from the trailing edge 04 to the leading edge 03 of the substrate 02, in particular by a distance ay in the direction Y, preferably by the color register monitoring system 728. In the event of a deviation of the circumferential register, a position in the circumferential direction of the at least one plate cylinder 616 creating the deviation is preferably rotated relative to the master axis value thereof. In this way, a new position of the plate cylinder 616 is preferably assigned to the master axis value. A lateral register preferably describes the alignment of the substrate 02 in the transverse direction A. The lateral register is preferably determined via the position of the register marks 16; 17; 18; 19; 21; 22; 23; 24 in the transverse direction A, preferably along the direction X from a side edge of the substrate 02 to the other side edge, in particular by a distance ax in the direction X, preferably by the color register monitoring system 728. Preferably, at least one, preferably each, plate cylinder 616 comprises at least one drive for laterally adjusting the plate cylinder 616. In the event of a deviation of the lateral register, the plate cylinder 616 creating the deviation is preferably axially adjusted relative to the plate cylinder 616 of the color for register marks. Preferably, the at least one drive adjusts the plate cylinder 616 axially, that is, in the transverse direction A, when a deviation of the lateral register of the relevant plate cylinder 616 is present. A diagonal register preferably describes a skewed position of the substrate 02. The diagonal register is preferably determined via the position of the forward register marks 16; 17; 18; 19 relative to the position of the rear register marks 21; 22; 23; 24 of the same color, in particular by a displacement angle w, preferably by the color register monitoring system 728. In the event of a deviation of the diagonal register, the printing forme of the plate cylinder 616 which created the deviation is preferably aligned. The alignment of the printing forme is preferably carried out by means of a displacement of the trailing edge relative to the leading edge of the printing forme, for example by lifting the printing forme off the plate cylinder 616 by means of blower air. Preferably, the color register monitoring system 728 additionally or alternatively inspects a printing length l2 of the substrate 02, preferably via the position and/or the distance of the forward register marks 16; 17; 18; 19 relative to the position and/or the distance of the rear register marks 21; 22; 23; 24 of the respective same application mechanism, preferably of the same color. The printing length of each color is preferably determined with respect to the printing length of the color for register marks. This actual printed printing length l2 is preferably compared to a reference length l1, the target distance of the register marks defined by the distance of the register marks of the color for register marks with respect to one another. In the event of a deviation of the processing length, preferably the printing length l2, that is, the time period at which the substrate 02 is being processed in the processing point 621 of the application unit 600, the plate cylinder 616 creating the deviation is preferably accelerated and/or decelerated while being in contact with a substrate 02 to be processed. The plate cylinder 616 preferably comprises at least one dedicated drive for this purpose, for adjusting the speed. Preferably, the print image generated by way of the particular plate cylinder 616 is thus stretched or compressed, and in particular adapted to the print image of the color for register marks. The printing length l2 is preferably corrected over the entire substrate 02. For example, in the case of a shortened actual value of the printing length l2 compared to the target value of the printing length l1, the speed of the plate cylinder 616 is increased, and the cylinder is operated at an increased speed compared to the master axis. Over the revolution or the cycle of the plate cylinder 616, a gap arises in the region of the cylinder channel. Due to the changed speed, the phase position with respect to the master axis changes. However, the print image has to be applied with precision in the case of a plate cylinder 616, which is why the arrival time of the substrate 02 has to match precisely again. Accordingly, the plate cylinder 616 has to be decelerated and accelerated again in the gap so as to correct the phase position. In a preferred embodiment, the printing length l2 can also be adapted in sections.

Preferably, in addition or as an alternative, the at least one color register monitoring system 728 is connected, preferably in terms of the control, to the at least one dedicated drive $M_E$ and/or to the at least one main drive M by means of at least one control unit. Depending on the inspection by the at least one color register monitoring system 728, preferably the at least one dedicated drive $M_E$ for axially adjusting the at least one transport element 701 and/or the at least one main drive M for accelerating or for decelerating the at least one transport element 701 in the transport direction T are activated. For example, adjustment values for the axial adjustment of the at least one transport element 701, preferably of the axially adjustable transport elements 701, are defined by means of the at least one color register monitoring system 728 and are adopted for at least two, preferably at least ten, for example at least twenty, substrates 02. Preferably, these defined adjustment values form a basic adjustment, which are preferably added up for each substrate 02 with individual adjustment values, the individual adjustment values preferably being determined based on the individual recognition of the individual substrates 02 by the at least one sensor 704 for substrate alignment which is assigned to the transport unit 700, and in particular to the at least one transport element 701.

For example, the printed image monitoring system 726 and the color register monitoring system 728 are a joint image acquisition device, for example, as an alternative, they are separate image acquisition devices. The printed image monitoring system 726 and/or the color register monitoring system 728 are preferably arranged after the last application unit 600 and before the at least one shaping unit 900. Preferably, no further alignment of the substrate 02 is carried out between the last application unit 600 and the printed image monitoring system 726 or the color register monitoring system 728.

Preferably, in addition or as an alternative, at least one sensor 916 of the sensors 704; 726; 728; 916 preferably designed as an image acquisition device is designed as a die-cut pattern monitoring system 916. The at least one inspection device 916 designed as a die-cutting monitoring system 916 is preferably arranged after the at least one downstream processing unit 900 designed as a die-cutting unit 900. Preferably, the at least one die-cut pattern monitoring system 916 is arranged along the transport path after the at least one shaping unit 900, preferably after the last processing unit 600; 900 of the processing machine 01. The at least one die-cut pattern monitoring system 916 is preferably arranged before the delivery unit 1000. Preferably, the at least one die-cut pattern monitoring system 916 inspects the substrate 02 with respect to die-cut scraps or waste pieces that were not removed and/or with respect to the die-cut contour and/or with respect to the position of the at least one print image relative to the position of the at least one die-cut pattern and/or with respect to the position of the at least one die-cut relative to the edges of the substrate 02 and/or with respect to the wear of the die-cutting tool and/or with respect to the wear of a cylinder cover of the anvil cylinder 902 and/or with respect to a change in the die-cutting length. The die-cutting examples used here can preferably be equally applied to creasing and/or embossing and/or further processing types of the shaping unit 900 corresponding to the particular configuration.

The at least one die-cutting monitoring system 916 is preferably connected, preferably in terms of the control, to the at least one sheet diverter 49 for channeling out substrate 02 and/or to at least one infeed of the substrate feed device 100 and/or to at least one output device creating a quality report and/or to at least one drive for axially adjusting the at least one plate cylinder 901 of the die-cutting unit 900 and/or to at least one drive in the circumferential direction of the at least one plate cylinder 901 of the die-cutting unit 900 and/or to at least one drive of the at least one anvil cylinder 902 of the die-cutting unit 900 and/or to the at least one dedicated drive $M_E$ and/or to the at least one main drive M by means of at least one control unit. The at least one die-cutting monitoring system 916 preferably controls at least one sheet diverter 49 for channeling out substrate 02 and/or at least one infeed of the substrate feed device 100 and/or at least one output device creating a quality report and/or the at least one drive for axially adjusting the at least one plate cylinder 901 of the die-cutting unit 900 and/or at least one drive in the circumferential direction of the at least one plate cylinder 901 of the die-cutting unit 900 and/or at least one drive of the at least one counterpressure cylinder 902 of the die-cutting unit 900 and/or the at least one dedicated drive $M_E$ of the transport unit 700 for substrate alignment and/or the at least one main drive M of the transport unit 700 for substrate alignment by means of at least one control unit, based on the detection of the substrate 02. Preferably in the case of a lateral offset of the plate cylinder 901 relative to the target position thereof, the plate cylinder 901 is preferably laterally adjusted so as to reach the target position. For the axial adjustment of the plate cylinder 901 of the shaping unit 900, the plate cylinder 901 preferably comprises at least one dedicated drive, and preferably a closed loop position-controlled electric motor. For example, the axial adjustment of the plate cylinder 901 of the shaping unit 900 is preferably carried out during the adjustment of the processing machine 01 after a job change. For example, in addition or as an alternative, the axial adjustment of the plate cylinder 901 is preferably in each case carried out for substrates 02 that follow the inspected substrate 02. This is done, for example, after a mean value has been created of the adjustment by the inspection of at least two, for example at least ten, substrates 02.

Preferably, a processing length, preferably the die-cutting length, that is, the time period at which the substrate 02 is being processed in the processing point 910 of the shaping unit 900, is adjusted by the relative speed of the anvil cylinder 902 with respect to the plate cylinder 901. Preferably, in the event of a deviation of the die-cutting length from the target length, the anvil cylinder 902, for example alternatively or additionally the plate cylinder 901, is accelerated and/or decelerated while in contact with at least one substrate 02. The anvil cylinder 902 preferably comprises a dedicated drive for this purpose, for adjusting the speed in the circumferential direction. For example, as an alternative or in addition, the plate cylinder 901 comprises a dedicated drive for adjusting the speed in the circumferential direction. Preferably, the die-cutting length is in each case adjusted for the substrates 02 that follow the inspected substrate 02. For setting the start of the processing operation of a substrate 02 in the processing point 910, the substrate 02 to be processed is preferably accelerated or decelerated by the transport unit 700 arranged upstream from the processing point 910, preferably so that the arrival time of the region of the substrate 02 to be processed coincides with the arrival time of the tool at the processing point 910.

The start of the processing operation of a substrate 02 in the processing point 910 of the shaping device 900 is preferably set based on the detection of the substrate 02, preferably of the leading edge 03 thereof, by the at least one sensor 922 for recognizing the leading edge 03.

Preferably, preferably depending on the function and/or position, at least one sensor 164; 622; 704; 722; 922 of the sensors 164; 622; 704; 722; 726; 728; 922; 916 is designed as a light sensor, preferably comprising at least one photocell, more preferably as a photoelectric sensor and/or as a sensor for contrast recognition and/or as a transmitted light sensor. For example, the light sensor, in particular the at least one light sensor, is designed as a retroreflective sensor. Preferably, a sensor 164; 622; 704; 722; 922 that is preferably designed as a light sensor recognizes a substrate 02 passing along the transport path of the sensor 164; 622; 704; 722; 922, preferably an edge 03; 04, in particular a leading edge 03 and/or trailing edge 04, of the substrate 02 and/or at least one image-producing element of the substrate 02, preferably a printing mark and/or register mark 16; 17; 18; 19; 21; 22; 23; 24 and/or an element of a print image which can be distinguished from the surrounding area thereof. For example, the substrate 02 is recognized as a result of the difference in contrast with respect to the surrounding area of the object to be recognized, for example the edge 03; 04 or the image-producing element with respect to the surface of the substrate 02 surrounding the object. Preferably, the sheet arrival is recognized. Preferably, the sensor 164; 622; 704; 722; 922 designed as a light sensor sends a signal to a control unit of the processing machine 01 upon recognizing the passing substrate 02, in particular the object to be recognized.

At least one sensor 704 of the sensors 164; 622; 704; 722; 726; 728; 922; 916 is preferably designed as a sensor 704 for substrate alignment. This sensor is preferably designed as a light sensor, and in particular as a sensor for contrast recognition. Preferably, the at least one sensor 704 for substrate alignment recognizes at least one image-producing element, preferably a printing mark and/or register mark 16; 17; 18; 19; 21; 22; 23; 24 and/or an element of a print image of the substrate 02 which can be distinguished from the surrounding area thereof. Preferably, the at least one sensor 704 for substrate alignment detects an image-producing element of the substrate 02. At least one alignment segment 750 preferably comprises at least one sensor 704 for substrate alignment.

At least one sensor 164 of the sensors 164; 622; 704; 722; 726; 728; 922; 916, which is preferably designed as a light sensor, is preferably arranged in the substrate feed device 100. For example, the infeed device 300 comprises the at least one sensor 164 designed as a light sensor. Preferably, the at least one sensor 164 of the substrate feed device 100 which is preferably designed as a light sensor recognizes a passing substrate 02, preferably the leading edge 03 thereof and/or the trailing edge 02 thereof. Preferably, the time at which the substrate 02 is recognized is determined. The at least one sensor 164 of the substrate feed device 100 is preferably connected to at least one infeed of the substrate feed device 100 and/or to at least one drive of the processing machine 01. The at least one sensor 164 of the substrate feed device 100 preferably stops at least one infeed of the substrate feed device 100 and/or at least one drive of the processing machine 01 based on the detection of a substrate 02. If the deviation, preferably within a tolerance range, of the time of recognition from a reference value is minor, the substrate 02 is preferably guided to the processing units 600; 900 of the processing machine 01. In the event of a deviation, preferably outside a tolerance range, of the time of recognition from a reference value, the infeed of the substrate feed device 100 is preferably stopped and/or the processing of substrate 02 by the processing machine 01 is stopped.

For example, additionally or alternatively, the sensor 164 of the substrate feed device 100, which is preferably designed as a light sensor, based on the transport direction T is arranged after at least one primary acceleration means, which pulls a substrate 02 from a pile from the storage area 166 thereof and/or accelerates the substrate 02 to a processing speed of the processing units 600; 900, and/or after at least one front stop, which preferably delimits the storage area 166, and/or before at least one secondary acceleration means, which preferably adapts the real transport speed of the substrate 02 by acceleration or deceleration to the processing speed of the processing units 600; 900, and/or in a region of the at least one secondary acceleration means. The at least one sensor 164 is preferably designed so as to control by closed loop and/or controls by closed loop a drive of the at least one acceleration means, preferably at least the secondary acceleration means, based on the detection of the substrate 02, in order to adapt the substrate 02 to the processing speed of the processing units 600; 900. Preferably, the real arrival time of the substrate 02 is determined from the detection of the substrate 02, preferably of the edge 03; 04 thereof and/or of at least one image-producing element, such as a printing mark, by the at least one sensor 164. The real arrival time is preferably compared to a reference, for example the target arrival time based on the machine cycle. Corresponding to the comparison, the at least one secondary acceleration means is preferably controlled by closed loop, preferably accelerated or decelerated, in order to adapt the substrate 02 to the processing speed.

At least one sensor 722, which is preferably designed as a light sensor, for recognizing a substrate 02 passing the sensor 722, preferably for recognizing the leading edge 03 of the substrate 02, of the sensors 164; 622; 704; 722; 726; 728; 922; 916 is preferably assigned to the at least one inspection device 726; 728; 916, preferably arranged upstream along the transport path, more preferably arranged upstream without further units or devices being interposed. For example, at least one sensor 722 is assigned to the printed image monitoring system 726 and/or the color register monitoring system 728, preferably at least one sensor 722 for both systems. For example, at least one sensor 722 is assigned to the die-cutting monitoring system 916. The at least one inspection device 726; 728; 916 is preferably controllable by closed loop and/or open loop by the at least one signal of the at least one sensor 722 and/or is controlled thereby. The time for triggering at least one recording by the at least one inspection device 726; 728; 916 is preferably controllable by closed loop and/or open loop by the at least one signal of the at least one sensor 722 and/or is triggered thereby.

In particular, at least one sensor 622; 922 of the sensors 164; 622; 704; 722; 726; 728; 922; 916 is designed to supply data for setting a start of the processing operation of a substrate 02 in a succeeding processing point 621; 910. The at least one sensor 622; 922 is preferably designed as a photoelectric sensor, preferably as a through-beam photoelectric sensor or retroreflective photoelectric sensor. In the case of through-beam photoelectric sensors, an emitter located in a separate housing emits the light to a separate receiver. When the object breaks the beam of light, it is considered to be detected. In the case of retroreflective photoelectric sensors, the emitter and receiver are accommodated in the same housing. In each case at least one sensor 622; 922, which is preferably designed as a light sensor, for example a photoelectric sensor, is preferably assigned to a respective processing unit 600; 900, preferably application unit 600 or shaping unit 900, preferably arranged before the processing point 621; 910 thereof. Preferably, at least one sensor 622; 922 for recognizing a leading end, preferably a leading edge 03, of a substrate 02 is in each case arranged before each processing unit 600; 900 of the processing machine 01.

This at least one sensor 622; 922 of the sensors 164; 622; 704; 722; 726; 728; 922; 916 is more preferably in each case connected to at least one main drive M of a transport unit 700 arranged before, preferably immediately before, the particular processing unit 600; 900 by means of at least one control unit. Based on the detection of the leading end, preferably the leading edge 03, of the substrate 02 by means of the at least one sensor 622; 922, at least one main drive M of a transport unit 700 arranged before the particular processing unit 600; 900 preferably accelerates and/or decelerates the at least one transport element 701 of this at least one transport unit 700. The arrival time of the substrate 02 at the processing point 621; 910 of the particular processing unit 600; 900 is thus preferably individually matched to the arrival time of the tool processing the substrate 02 at the processing point 621; 910, preferably for each processing unit 600; 900 of the processing machine 01, by way of an acceleration and/or a deceleration of the substrate 02.

In addition or as an alternative, the at least one sensor 622; 922 of the sensors 164; 622; 704; 722; 726; 728; 922; 916 is preferably designed to recognize the leading end, preferably the leading edge 03, of the substrate 02 passing the sensor 622; 922. Each of the at least one sensor 622; 922 for recognizing the leading end, preferably the leading edge 03, of the substrate 02, which in each case is preferably assigned to a processing unit 600; 900, is preferably arranged at least before a last transport element 701 in the transport direction T, more preferably before the last two transport elements 701, more preferably the last three transport elements 701, more preferably the last four transport elements 701, of the at least one transport unit 700 before the at least one succeeding processing unit 600; 900, to which the respective sensor 622; 922 is preferably assigned. For example, two sensors 622; 922 are arranged parallel to one another, along the transport path, before the processing unit 600; 900, and preferably before the processing point 621; 910 thereof. Preferably, each of the at least one sensor 622; 922 that is preferably designed as a light sensor is preferably arranged at the transport unit 700 arranged upstream from the processing point 621; 910, preferably without further units 100; 300; 600; 700; 900; 1000 being interposed. The particular sensor 622; 922 is preferably arranged in such a way that at least a portion of the transport device 700, in particular at least a portion of the relevant transport means 700, is arranged between the particular sensor 622; 922 and the relevant processing point 621; 909 of the relevant unit 600; 900. In a preferred embodiment of the transport device 700, the transport means 700 is designed as an upper suction transport means 700, in particular as the at least one roller suction system. Preferably, at least one transport section 706, preferably at least one transport roller 701 and/or at least one transport cylinder 701, more preferably additionally no more than three transport rollers 701 and/or three transport cylinders 701, of the upper suction transport means 700, are then arranged between the particular sensor 622; 922 and the processing point 621; 909 of the relevant unit 600; 900, based on the transport direction T. The sensor 622; 922 is in each case preferably arranged at the same coordinate, based on the transverse direction A. The sensors 622; 922 are preferably in each case arranged one behind the other in the transport direction T, preferably aligned with one another. An arrangement of the sensors 622; 922 in the transport direction T, in each case aligned with one another, preferably ensures that the same position of the leading edge 03 of the particular sheet 02 can be detected by the particular sensors 622; 922.

The at least one sensor 622; 922 for recognizing the leading end, preferably the leading edge 03, of the substrate 02 is preferably connected, preferably in terms of the control, to the at least one main drive M, preferably at least one main drive M of at least one transport section 706 and/or at least one main drive M of at least one alignment segment 750 and/or at least one main drive M of at least one transport unit 700, by means of at least one control unit. The at least one sensor 622; 922 for recognizing the leading end, preferably the leading edge 03, of the substrate 02 is preferably connected, preferably in terms of control, to the at least one main drive M of at least a third alignment region of the at least one alignment segment 750, by means of the at least one control unit. In the event of a correction of the color register in the transport direction T and/or in the event of a correction of the die-cutting register in the transport direction T, the arrival time of the at least one substrate 02 at the processing point 621; 910 of the processing unit 600; 900 assigned to the sensor 622; 922 is preferably adjusted relative to the arrival time of a starting region of a region of the plate cylinder 616; 901 of the processing unit 600; 900 processing the substrate 02 by means of the at least one main drive M. Preferably, the at least one main drive M, corresponding to the detection of the substrate 02, preferably based on the detection of the leading end, preferably the leading edge 03, of the substrate 02 by means of the at least one sensor 622; 922 accelerates and/or decelerates the at least one transport element 701, preferably at least the last transport element 701 of the transport unit 700, which is preferably the last transport element 701 along the transport path before the processing point 621; 910, more preferably the last two transport elements 701, more preferably the last three transport elements 701, more preferably the last four transport elements 701, more preferably all transport elements 701 of the transport unit 700. The arrival time of a region of the substrate 02 to be processed at the processing point 621; 910 is thus preferably set relative to the arrival time of the region of the plate cylinder 616; 901 processing the substrate 02, these preferably being matched to one another. As a result of the closed-loop control by means of the at least one sensor 622; 922 assigned to the particular processing unit 600; 900, the arrival time at the processing point 621; 910, preferably the position of the leading end, preferably of the leading edge 03, of the substrate 02, in particular the assigned master axis value, preferably coincides with the arrival time, preferably with the position of the forward edge of the working zone, preferably of the printing region, of the plate cylinder 616; 901, in particular of the assigned master axis value.

At least one transport unit 700 is preferably arranged between the at least one processing unit 600 that is designed as an application unit 600 and the at least one succeeding processing unit 600; 900. Hereafter, it preferably applies that these processing units 600; 900 are arranged consecutively, without further processing units 600; 900 being interposed, along the transport path. For example, in the case that the succeeding processing unit 900 is designed as a die-cutting unit 900, preferably at least two, more preferably at least three, for example four or five, transport units 700 are arranged, preferably immediately following one another, along the transport path between the processing unit 600; 900 designed as an application unit 600 and that designed as a die-cutting unit 900.

The processing machine 01 comprises at least one alignment segment 750 for aligning substrate 02. The at least one alignment segment 750 is arranged before at least one processing unit 600; 900 of the processing machine 01. In a preferred embodiment, the at least one alignment segment 750 is arranged between two processing units 600; 900. More preferably, the at least one alignment segment 750 is arranged between the at least one forward processing unit 600, preferably the at least one processing unit 600 designed as an application unit 600, and the at least one succeeding processing unit 900, preferably the at least one processing unit 900 designed as a shaping unit 900. The at least one alignment segment 750 is preferably designed so as to align the at least one substrate 02, in particular sheet 02. The alignment segment 750 advantageously increases an accuracy of the processing operation of the substrate 02 in processing units 600; 900 succeeding the alignment segment 750.

The at least one alignment segment 750 comprises at least one transport section 706. In particular, the at least one alignment segment 750 comprises at least two, preferably at least ten, more preferably at least twenty, more preferably a plurality of, transport sections 706 following one another in the transport direction T. The at least one alignment segment 750 comprises at least two transport sections 706 following one another in the transport direction T. The at least one alignment segment 750 comprises at least two, preferably at least five, more preferably at least nine, more preferably at least eleven, preferably at least twenty, for example twenty-two, transport sections 706 in the transport direction T one behind the other, preferably following one another. Following one another preferably denotes that no further objects of the same type are interposed.

The at least one alignment segment 750 preferably comprises at least one alignment region, preferably at least two alignment regions, more preferably at least three alignment regions. An alignment region is preferably a section of the alignment segment 750 along the transport path of substrate 02 in which a substrate 02 is aligned with respect to at least one parameter. Parameters shall preferably be understood to mean the skewed position of substrate 02, an axial offset of substrate 02, and an offset in the circumferential direction of the substrate 02. At least one preferably first alignment region is preferably designed as an alignment region for aligning substrate 02 in terms of a skewed position. At least one preferably second alignment region is preferably designed as an alignment region for aligning substrate 02 in terms of an axial offset. At least one preferably third alignment region is preferably designed as an alignment region for aligning substrate 02 in terms of an offset in the circumferential direction. Each of the at least one alignment region, in particular the at least one alignment region for aligning a skewed position and/or the at least one alignment region for aligning an axial offset and/or the at least one alignment region for aligning an offset in the circumferential direction, preferably comprises at least two transport sections 706 following one another in the transport direction T.

In a preferred embodiment, the alignment regions of the alignment segment 750 are arranged one after the other in the transport direction T. This advantageously increases the accuracy of the individual alignment steps compared to alignments with respect to various parameters taking place at the same time. The second alignment region preferably follows the first alignment region in the transport direction T. The third alignment region preferably follows the second alignment region in the transport direction T. In a particularly preferred embodiment with respect to the accuracy of the alignment, the at least one alignment region for aligning a skewed position is arranged in the transport direction T before the at least one alignment region for aligning an axial offset, and the at least one alignment region for aligning an axial offset is arranged in the transport direction T before the at least one alignment region for aligning an offset in the circumferential direction.

For example, in addition or as an alternative, at least one alignment region is designed for aligning at least two parameters, that is, for aligning the skewed position and/or for aligning an axial offset and/or for aligning an offset in the circumferential direction.

For example, in addition or as an alternative, at least two alignment regions of the alignment segment 750 are arranged so as to at least partially overlap one another along the transport direction T, more preferably are parallel to one another along the transport direction T. For example, at least one transport section 706 is assigned to the at least two alignment regions. For example, this shortens the required length of the alignment segment 750 and/or reduces the required components. For example, the alignment of a skewed position is carried out parallel to the alignment of an axial offset and/or parallel to the alignment of a substrate in the circumferential direction. Or the alignment of an axial offset is carried out parallel to the alignment of a substrate in the circumferential direction. This advantageously shortens the required length of the alignment segment 750. Preferably, conversely, the partially overlapping alignment regions preferably differ from one another by at least one transport section 706.

Within the at least one first alignment region, an alignment of the at least one substrate 02 in terms of skew is preferably carried out. The length of the distance along the at least one alignment segment 750 in the transport direction T of the at least one first alignment region preferably at least corresponds to the length of a working zone in the circumferential direction of the at least one plate cylinder 616; 901 of the at least one processing unit 600; 900, preferably of at least the plate cylinder 616 of at least one application unit 600 of the application units 600. Preferably, the length of the distance along the at least one alignment segment 750 in the transport direction T of the at least one first alignment region at least corresponds to the length of a working zone in the circumferential direction of the at least one plate cylinder 616; 901 of the at least one processing unit 600; 900, preferably of at least the plate cylinder 616 of at least one application unit 600 of the application units 600, and additionally to at least another 5%, preferably at least 10%, more preferably at least 15%, of the length of a processing-free region in the circumferential direction of the at least one plate cylinder 616; 901. In a further preferred embodiment, the length of the distance along the at least one alignment segment 750 in the transport direction T of the at least one first alignment region at least corresponds to the length of the cylinder circumference in the circumferential direction of the at least one plate cylinder 616; 901 of the at least one processing unit 600; 900, preferably of at least the plate cylinder 616 of at least one application unit 600 of the application units 600, that is, in other words, the cylinder circumference of a plate cylinder 616. The length of the distance along the at least one alignment segment 750 in the transport direction T of the at least one first alignment region is preferably at least 15%, preferably at least 20%, more preferably at least 30%, of the length of the at least one alignment segment 750. For example, the at least one first alignment region comprises at least five, preferably at least eight, more preferably at least ten, and/or no more than twenty, preferably no more than fifteen, for example no more than eleven, transport sections 706 of the at least one alignment segment 750. The at least one first alignment region preferably comprises the first transport section 706, in the transport direction T, of the transport sections of the at least one alignment segment 750.

Within the at least one second alignment region, an alignment of the at least one substrate 02 in terms of the axial offset is preferably carried out. The length of the distance along the at least one alignment segment 750 in the transport direction T of the at least one second alignment region is preferably at least 30%, preferably at least 40%, more preferably at least 50%, more preferably at least 60%, of the length of the at least one alignment segment 750. In a further preferred embodiment, the length of the distance along the at least one alignment segment 750 in the transport direction T of the at least one second alignment region at least corresponds to the length of the cylinder circumference in the circumferential direction of the at least one plate cylinder 616; 901 of the at least one processing unit 600; 900, preferably of at least the plate cylinder 616 of at least one application unit 600 of the application units 600, that is, in other words, the cylinder circumference of a plate cylinder 616; 901. For example, the at least one second alignment region comprises at least six, preferably at least ten, more preferably at least fifteen, more preferably at least seventeen, and/or no more than thirty, preferably no more than twenty-five, for example no more than twenty, transport sections 706 of the at least one alignment segment 750. For example, the at least one second alignment region comprises at least one, preferably at least three, for example six, transport sections 706 of the at least one first alignment region. Preferably, these transport sections 706 assigned to the first alignment region and the second alignment region are those transport sections 706 of the at least one second alignment region which are arranged in the transport direction T before the at least one second sensor 704 for substrate alignment.

Within the at least one third alignment region, an alignment in the circumferential direction of the at least one substrate 02 is preferably carried out. The length of the distance along the at least one alignment segment 750 in the transport direction T of the at least one third alignment region preferably at least corresponds to the length of a working zone in the circumferential direction of the at least one plate cylinder 616; 901 of the at least one processing unit 600; 900, preferably of at least the plate cylinder 616 of at least one application unit 600 of the application units 600. Preferably, the length of the distance along the at least one alignment segment 750 in the transport direction T of the at least one third alignment region at least corresponds to the length of a working zone in the circumferential direction of the at least one plate cylinder 616; 901 of the at least one processing unit 600; 900, preferably of at least the plate cylinder 616 of at least one application unit 600 of the application units 600, and additionally to at least another 5%, preferably at least 10%, more preferably at least 15%, of the length of a processing-free region in the circumferential direction of the at least one plate cylinder 616; 901. In a further preferred embodiment, the length of the distance along the at least one alignment segment 750 in the transport direction T of the at least one third alignment region at least corresponds to the length of the cylinder circumference in the circumferential direction of the at least one plate cylinder 616; 901 of the at least one processing unit 600; 900, preferably of at least the plate cylinder 616 of at least one application unit 600 of the application units 600. The length of the distance along the at least one alignment segment 750 in the transport direction T of the at least one third alignment region is preferably at least 6%, preferably at least 10%, more preferably at least 20%, more preferably at least 30%, of the length of the at least one alignment segment 750. For example, the at least one third alignment region comprises at least two, preferably at least five, more preferably at least eight, more preferably at least ten, and/or no more than twenty, preferably no more than fifteen, for example no more than eleven, transport sections 706 of the at least one alignment segment 750. The at least one third alignment region preferably comprises the last transport section 706, in the transport direction T, of the transport sections of the at least one alignment segment 750.

Preferably, the at least one alignment section 750 comprises at least one transport unit 700, preferably at least two transport units 700 arranged one behind the other, preferably following one another, in the transport direction T, and more preferably at least three transport units 700 arranged one behind the other in the transport direction T. The at least one transport unit is, in particular the at least two transport units 700 are, preferably designed according to the embodiment of the transport means 700 as a suction transport means 700, more preferably as a roller suction system. The at least two transport units 700 arranged one behind the other in the transport direction T preferably each comprise at least two transport sections 706 of the transport sections 706. The at least two transport units 700, preferably the at least three transport units 700, preferably each comprise at least nine, for example at least eleven, transport sections 706. Preferably, the at least one transport unit is, preferably the at least two, more preferably the at least three transport units 700 of the alignment segment 750 are arranged between the processing unit 600 designed as an application unit 600 and the at least one succeeding processing unit 600; 900, preferably shaping unit 900, for aligning substrate 02. For example, at least one transport unit 700 is in each case assigned to an alignment region of the alignment regions. Preferably, as an alternative, each of the transport sections 706 of the transport units 700 of the alignment segment 750 is assigned to at least one alignment region of the alignment regions.

A substrate 02, preferably sheet 02, is preferably transported within the at least one alignment segment 750 in a plane, preferably horizontally, more preferably horizontally in a hanging state. A section of the transport path provided for a transport of substrate 02, which is defined by the at least one alignment segment 750, preferably by the at least one transport section 706, more preferably by the at least one transport unit 700, more preferably at least the at least one transport unit 700 for substrate alignment, is preferably located beneath the transport surface 702 of the at least one transport element 701 of the alignment segment 750, in particular the transport section 706 thereof and/or the transport unit 700 thereof. The transport surfaces 702 of the transport sections 706 of the alignment segment 750 are preferably located in the vertical direction V above the transport path of substrate 02. The at least one transport unit 700 for substrate alignment preferably transports the at least one substrate 02 in a hanging state.

The substrate 02 is preferably transported in a hanging state along the at least one alignment segment 750. The central axes of the transport sections 706, preferably the central axes of the at least two transport sections 706 following one another in the transport direction T, in particular the central axes of the transport sections 706 of the plurality of transport sections 706 following one another in the transport direction T, more preferably all transport sections 706 of the alignment segment 750, are preferably located in one plane. The plane is preferably horizontal. In addition or as an alternative, a transport path of substrate 02 is preferably located beneath the central axes of the transport sections 706, preferably of the at least two transport sections 706 following one another in the transport direction T, in particular of the transport sections 706 of the plurality of transport sections 706 following one another in the transport direction T. Preferably, the transport path within the at least one alignment segment 750 is exclusively arranged beneath the transport sections 706 of the at least one alignment segment 750. In other words, the at least two, preferably all, transport sections 706 are arranged on one side of, preferably above, the transport path of substrate 02. Advantageously, a hanging transport of substrate 02 thus takes place, and advantageously the print image of the substrate 02 is protected in the process. The central axis preferably describes the axis of rotation of the at least one transport element 701, that is the shaft 739 of the transport section 706.

The at least one alignment segment 750 is preferably arranged downstream from at least one transport unit 700 which comprises the at least one printed image monitoring system 726 and/or the at least one color register monitoring system 728. Preferably, the at least one, preferably the at least two, transport units 700 for aligning substrate 02 are arranged downstream from at least one transport unit 700 which comprises the at least one printed image monitoring system 726 and/or the at least one color register monitoring system 728. Preferably, first the color register and/or the printed image of the substrate 02 are monitored, and thereafter the substrate 02 is aligned along the transport path between the processing unit 600 designed as an application unit 600 and the at least one succeeding processing unit 600; 900, preferably shaping unit 900. The inspection of the substrate 02 is thus advantageously not affected by alignment processes. Advantageously, a high quality of the inspection result is achieved.

The at least one alignment segment 750, preferably the at least one transport unit 700, which is more preferably arranged between the processing unit 600 designed as an application unit 600 and the at least one succeeding processing unit 600; 900, which is more preferably designed to align substrate 02, in particular the at least one transport section 706, preferably comprises the at least one transport element 701. The at least one transport section 706 of the transport sections 706 preferably comprises at least one transport element 701, which is preferably designed as at least one transport roller 701 or as at least one transport cylinder 701. Each transport section 706 preferably comprises at least one transport element 701, which is preferably designed as at least one transport roller 701 or as at least one transport cylinder 701. Preferably, the at least one alignment segment 750, in particular the at least one transport unit 700, which is preferably designed to align substrate 02, comprises a plurality of transport elements 701, preferably at least two, more preferably at least five, more preferably at least nine, more preferably at least eleven. The transport elements 701 of the plurality of transport elements 701 are preferably arranged one behind the other in the transport direction T and/or spaced apart from one another in the transport direction T. The at least one transport unit 700, which is preferably arranged between the processing unit 600 designed as an application unit 600 and the at least one succeeding processing unit 600; 900, which is more preferably designed to align substrate 02, is preferably designed as a suction transport means 700, preferably a roller suction system.

A transport section 706 is preferably a region of the at least one alignment segment 750 in the transport direction T. The transport sections 706 are preferably exclusively arranged one behind the other, in particular following one another, in the transport direction T along the alignment segment 750. The transport elements 701 of a transport section 706 are preferably arranged one behind the other in the transverse direction A and/or the transport elements 701 thereof are activated together and/or the transport elements 701 thereof are axially adjustable together. Preferably, the at least one transport element 701 forms, preferably all transport elements 701 that can be groupwise axially adjusted together form, a transport section 706. Preferably, the at least one transport section 706 comprises at least one transport element, preferably at least two transport elements 701. The at least two transport elements 701 of a transport section 706 are preferably arranged one behind the other in the transverse direction A, that is, preferably parallel to one another in the transport direction T.

The at least one transport section 706 preferably comprises at least one shaft 739, at which the at least one transport element 701 is arranged. The at least one shaft 739 preferably forms the axis of rotation of the at least one transport element 701. Each of the at least one transport element 701 is preferably designed as at least one transport roller 701 or at least one transport cylinder 701. The axis of rotation of the at least one transport roller 701 or transport cylinder 701 is preferably axially oriented, that is, directed in the transverse direction A. Above and below, a roller shall preferably be understood to mean a cylindrical body, in which the outer cylindrical surface thereof preferably extends by no more than twice the diameter in the direction of the axis of rotation of the roller. Above and below, a cylinder is thus preferably a cylindrical body, in which the outer cylindrical surface extends by more than twice the diameter thereof in the direction of the axis of rotation of the cylinder. For example, as an alternative, the at least one transport element 701 is designed as at least one belt, preferably at least one suction belt. In a preferred embodiment, several transport elements 701, preferably transport rollers 701, for example at least three, preferably at least four, are arranged along the shaft 739, that is, in the transverse direction A. These are in each case spaced apart from one another, for example.

The at least one alignment segment 750 comprises at least one main drive M. The at least one main drive M preferably generates a torque and/or is designed so as to generate a torque. The at least one alignment segment 750 comprises the at least one main drive M for driving in the circumferential direction, preferably for rotationally, in particular rotatively, driving the at least one transport section 706, preferably the at least two transport sections 706. Preferably, the at least one transport unit 700, which is preferably designed to align substrate 02, comprises the at least one main drive M. Preferably, each transport unit 700 of the alignment segment 750 comprises at least one main drive M, for example at least one main drive M is provided in each case per transport unit 700. The at least one main drive M is preferably designed so as to generate the movement in the circumferential direction, preferably the rotational, in particular rotative, preferably revolving, movement, of the at least one transport element 701. In particular, the at least one main drive M is designed so as to generate the torque for generating a movement in the circumferential direction, preferably a rotational movement, of at least one transport sub-section 707; 708 of the at least one transport section 706. Preferably, at least one control unit is provided, which activates the at least one main drive M.

The at least one main drive M is preferably designed as a linear drive and/or an electric motor and/or a torque motor, preferably closed loop position-controlled. A torque motor is preferably a multi-pole electric drive, which has high rotational speeds at relatively low rotational speeds compared thereto. In particular, the at least one main drive M comprises at least one stator and at least one rotor. The at least one main drive M advantageously allows torque to be easily transmitted to the at least one transport section.

The at least one main drive M is preferably designed so as to generate a movement of the at least one transport element 701, which moves the at least one substrate 02 in the transport direction T. The substrate 02 is preferably moved in the transport direction T by means of a movement in the circumferential direction, preferably a rotational, in particular rotative, movement, of the at least one transport section 706, in particular of the at least one transport element 701, generated by the at least one main drive M.

The at least one transport section 706 is, more preferably at least two transport sections 706, more preferably all transport sections 706 of the transport unit 700 are, connected to the at least one main drive M. Being connected to a drive preferably describes being drivable and/or driven by this drive.

The at least one main drive M is preferably operatively connected to the at least one transport sub-section 707; 708 of the at least one transport section 706 by way of at least one gear train 731. This means that the at least one main drive M is preferably mechanically coupled to the at least one transport sub-section 707; 708. The at least one main drive M preferably drives at least one transport sub-section 707; 708 of the at least one transport section 706 by way of at least one gear train 731. The at least one main drive M is preferably designed so as to drive the at least one gear train 731 with at least one gear wheel 732. The gear train 731 preferably comprises at least two gear wheels 732 and at least one intermediate gear wheel 733 bringing the gear wheels 732 into operative connection. Preferably, at least one transport section 706, preferably at least one first transport sub-section 707 and/or at least one second transport sub-section 708, in particular the shaft 739 thereof, are arranged in each case at the at least one gear wheel 732.

In a preferred refinement, at least one transport element 701 of a transport section 706 is driven in the circumferential direction, preferably rotationally, while at least one further transport element 701 or, for example, at least one supporting roll of the transport section 706 is arranged, for example by way of at least one bearing arrangement, in a freewheeling manner on the at least one shaft 739.

If at least two, preferably at least three, transport units 700 of the alignment segment 750 are present, these preferably each comprise at least one main drive M. For example, at least one first transport unit 700 of the alignment segment 750 comprises at least two main drives M. For example, at least one second transport unit 700 of the alignment segment 750 and/or at least one last transport unit 700 of the alignment segment in the transport direction T, for example a third transport unit 700, each comprise a main drive M. For example, in the case of three transport units 700 of the at least one alignment segment 750, the first transport unit 700 comprises two main drives M, while the second transport unit 700 and the third transport unit 700 each comprise a main drive M.

At least two, more preferably at least four, more preferably at least six, transport sections 706 of the transport sections 706 of the first alignment region of the at least one alignment segment 750 for aligning a skewed position comprise the at least one first transport sub-section 707 and the at least one second transport sub-section 708 in the transverse direction A. In particular, the first alignment region for aligning the skewed position of substrate 02 comprises at least two main drives M, preferably at least one main drive M for driving the at least one first transport sub-section 707 and at least one main drive M for driving the at least one second transport sub-section 708.

For example, the second alignment region and/or the third alignment region each comprise at least one, preferably one, main drive M for driving the at least one first transport sub-section 707 and the at least one second transport sub-section 708.

In a first preferred embodiment, at least one transport section 706 of the transport sections 706 of the alignment segment 750, preferably at least one first transport sub-section 707 and at least one second transport sub-section 708, is coupled to a main drive M. Preferably, at least two transport sections 706 of the transport sections 706 of the alignment segment 750, preferably of the at least one transport unit 700, which are arranged one behind the other, in particular following one another, in the transport direction T, are coupled to the main drive M and/or are driven in the circumferential direction by the main drive M. In particular, the transport sections 706 of the third alignment region for aligning an offset in the circumferential direction are preferably designed in accordance with the first preferred embodiment. For example, at least one transport section 706 of the second alignment region for aligning an axial offset is designed in accordance with the first preferred embodiment.

In the first preferred embodiment of the at least one transport section 706, the plurality of transport elements 701, preferably at least two transport elements 701 of the alignment segment 750, preferably of the at least one transport unit 700, which are arranged one behind the other in the transport direction T, are coupled to the at least one main drive M and/or are driven in the circumferential direction by way of the at least one main drive M. The at least two transport sections 706 are preferably connected to one another via the at least one gear train 731, preferably by means of at least one gear mechanism, preferably having straight teeth. The plurality of transport elements 701, preferably at least two transport elements 701 arranged one behind the other in the transport direction T, are preferably connected to one another via the at least one gear train 731, preferably by means of the at least one gear mechanism, preferably having straight teeth. The at least one main drive M is preferably designed so as to drive the gear train 731. Preferably, at least one gear wheel 732 of a gear train 731 is in each case arranged at the at least one transport section 706, in particular at the at least one transport element 701, more preferably at the shaft 739 comprising the at least one transport roller 701 or transport cylinder 701 arranged thereon. The at least one main drive M preferably engages directly on the at least one shaft 739 of a transport section 706. The torque is preferably transmitted to the further driven transport sections 706, in particular to at least the shafts 739 thereof, by means of the gear train 731. The straight teeth preferably enable an axial adjustment of the gear wheels 732, thus advantageously an axial adjustment of the transport elements 701 arranged at the gear wheels 732, relative to one another. For example, as an alternative, the gear wheels 732 of the at least one gear train 731 are designed so as to have a fixed position in the transverse direction A and are preferably not axially adjusted. For this purpose, for example, the at least one transport section 706, preferably the at least one shaft 739 thereof, has at least one coupling 734 to the particular gear train 731, which preferably transmits the torque, but not an axial movement. The at least one coupling 734 between the at least one transport section 706, in particular the shaft thereof, and the particular gear train 731 is preferably designed as a linear bearing, also referred to as a ball bushing, preferably as a torque-resistant ball bushing 734. All transport elements 701 of the plurality of transport elements 701 are thus preferably coupled to the at least one main drive M. The at least two transport sections 706 are preferably driven at the same speed in the transport direction T by the at least one main drive M. Preferably, all transport elements 701 of the plurality of transport elements 701, preferably the at least two transport elements 701 arranged one behind the other in the transport direction T, are driven at the same speed in the transport direction T by the at least one main drive M.

In a second preferred embodiment of the at least one transport section 706, each of the at least one transport section 706 of the transport sections 706 of the at least one alignment segment 750 preferably comprises at least two transport sub-sections 707; 708. In particular, the transport sections 706 of the first alignment region for aligning a skewed position are designed in accordance with the second embodiment. The at least two transport sections 706 of the first alignment region for aligning a skewed position preferably each comprise the at least one first transport sub-section 707 and the at least one second transport sub-section 708 in the transverse direction A. Each transport sub-section 707; 708 preferably comprises a shaft 739. Preferably, the at least one transport section 706 of the transport sections 706 comprises at least one first transport sub-section 707 and at least one second transport sub-section 708 in the transverse direction A. The at least two transport sub-sections 707; 708 are preferably arranged one behind the other in the transverse direction A, that is, preferably parallel to one another in the transport direction T. The transport sub-section 707; 708 preferably refers to an axial region of the relevant transport section 706. The at least one first transport sub-section 707 and the at least one second transport sub-section 708 preferably each comprise at least one transport element, for example at least two transport elements 701.

Preferably, at least one spatial region 709; 710; 711 connecting the at least two transport sub-sections 707; 708 is provided between at least two transport sub-sections 707; 708, in particular between at least two transport elements 701, of the at least one transport section 706. The spatial region 709; 710; 711 preferably comprises a section of the at least one shaft 739 and/or at least one coupling rod 713 and/or at least one bearing arrangement 712. For example, the at least one transport section 706 preferably comprises at least two transport sub-sections 707; 708, in particular at least two transport elements 701, which are preferably connected to one another by means of at least one coupling rod 713 and/or are arranged on a shared shaft 739. Preferably, the at least two transport sub-sections 707; 708, preferably the at least two transport elements 701, are driven together in the circumferential direction, preferably rotationally, in particular rotatively, and/or are axially moved. For example, the spatial region 709; 710; 711 comprises the at least one bearing arrangement 712, in particular for bracing the shaft 739, between the at least two transport sub-sections 707; 708, preferably between at least two transport elements 701.

In particular in the case of the second preferred embodiment of the at least one transport section 706, the at least one alignment segment 750 comprises at least one main drive M for driving in the circumferential direction, preferably for rotationally driving, the at least one first transport sub-section 707 and/or at least one main drive M for driving in the circumferential direction, preferably for rotationally driving, the at least one second transport sub-section 708. The at least one transport sub-section 707; 708 of the at least one transport section 706 is thus in each case coupled to a main drive M.

The at least one first transport sub-section 707 and the at least one second transport sub-section 708, in particular of the first alignment region for aligning a skewed position, can be driven, preferably rotationally driven, at differing speeds relative to one another in the circumferential direction and/or are driven at differing speeds in the circumferential direction. In particular in the case of the second preferred embodiment of the at least one transport section 706, the at least one main drive M of the at least one first transport sub-section 707 and the at least one main drive M of the at least one second transport sub-section 708 are preferably different main drives M. In this way, differing speed profiles of the at least two transport sub-sections 707; 708 relative to one another can preferably be generated. The at least one main drive M of the at least one first transport sub-section 707 is designed so as to drive or drives the at least one first transport sub-section 707 at a first speed, while the at least one main drive M of the at least one second transport sub-section 708 is designed so as to drive or drives the at least one second transport sub-section 708 at a second speed. Preferably, the first and second speeds at least temporarily differ from one another. A substrate 02 is thus preferably driven at at least two speeds that differ relative to one another by means of the at least one transport section 706. For example, a skewed position of the at least one substrate 02 relative to the transport path and/or relative to a tool of the succeeding processing unit 600; 900 is thus compensated for.

Above and below, the driving in the circumferential direction of a body preferably denotes a movement of the body in the transport direction T. In the case of a cylindrical body, above and below, the driving in the circumferential direction preferably denotes a rotational movement of the body, wherein the direction of rotation of the body is based on a point facing the transport path of substrate 02, preferably in the transport direction T. A substrate 02 is then preferably transported in the transport direction T. In other words, the body is radially driven. This preferably means that a substrate 02, during the alignment thereof in the circumferential direction with respect to its position, that is the positioning at a certain point in time, is oriented in the transport direction T.

In the second embodiment of the at least one transport section 706, the at least one first transport sub-section 707 of the at least one transport section 706 is connected to the at least one main drive M for driving the at least one first transport sub-section 707 and, in addition or as an alternative, the at least one second transport sub-section 708 of the at least one transport section 706 is connected to the at least one main drive M for driving the at least one second transport sub-section 708. In the second preferred embodiment of the at least one transport section 706, at least two, preferably at least five, more preferably at least nine, for example at least eleven, first transport sub-sections 707, arranged one behind the other, and in particular following one another in the transport direction T, of at least two, preferably at least five, more preferably at least nine, for example at least eleven, transport sections 706 of the transport sections 706 are connected to the at least one main drive M for driving the at least one first transport sub-section 707. In addition or as an alternative, at least two, preferably at least five, more preferably at least nine, for example at least eleven, second transport sub-sections 708, arranged one behind the other, and in particular following one another in the transport direction T, of at least two transport sections 706 of the transport sections 706 are connected to the at least one main drive M for driving the at least one second transport sub-section 708. The first transport sub-sections 707 of the transport sections 706 of the first alignment region are preferably connected to the at least one main drive M for driving the at least one first transport sub-section 707. The second transport sub-sections 708 of the transport sections 706 of the first alignment region are preferably connected to the at least one main drive M for driving the at least one second transport sub-section 708. The at least one main drive M for driving the at least one first transport sub-section 707 drives at least two first transport sub-sections 707, following one another in the transport direction T, of at least two transport sections 706 of the transport sections 706 and/or the at least one main drive M for driving the at least one second transport sub-section 708 drives at least two second transport sub-sections 708, following one another in the transport direction T, of at least two transport sections 706 of the transport sections 706, in particular the respective shaft 739 thereof. For example, the at least one main drive M in each case drives at least four, preferably at least eight, for example eleven, consecutive first or second transport sub-sections 707; 708. For example, at least 20%, preferably at least 30%, of the first or second transport sub-sections 707; 708 of the alignment segment 750 are driven by at least one shared main drive M in the circumferential direction. For example, the alignment segment 750 thus comprises at least two, preferably at least three main drives along the transport direction, which each drive at least 20% of the first and/or second transport sub-sections 707; 708.

Preferably, all respective transport sub-sections 707; 708 which are each connected to the at least one main drive M are, preferably rotationally, driven together in the circumferential direction by the at least one main drive M, in particular the shafts 739 thereof. The at least one main drive M is preferably operatively connected to the at least one respective transport sub-section 707; 708 via at least one gear train 731, preferably at least one gear mechanism, for example having straight teeth or helical teeth. This means that the at least one first transport sub-section 707 is coupled to the one main drive M for driving the at least one first transport sub-section 707, and the at least one second transport sub-section 708 is coupled to the one main drive M for driving the at least one second transport sub-section 708, that is, a main drive M different therefrom. Preferably, at least one gear wheel 732 of the gear train 731 is in each case arranged at the at least one transport sub-section 707; 708, preferably at the shaft 739 thereof. The at least one main drive M preferably engages directly on the shaft 739 of a transport sub-section 707; 708. The torque is preferably transmitted to the shafts 739 of the further driven transport sub-sections 707; 708 by means of the gear train 731. In a preferred embodiment, the gear wheels 732 of the at least one gear train 731 are designed so as to have a fixed position in the transverse direction A and are preferably not axially adjusted. For this purpose, for example, the at least one transport section 706, in particular the relevant transport sub-section 707; 708, preferably the shaft 739 thereof, has at least one coupling 734 to the particular gear train 731, which preferably transmits the torque, but not an axial movement. The at least one coupling 734 between the at least one transport sub-section 707; 708, in particular the shaft 739 thereof, and the particular gear train 731, in particular the at least one gear wheel 732 thereof, is preferably designed as a linear bearing, also referred to as a ball bushing, preferably as a torque-resistant ball bushing 734.

In the case of the second preferred embodiment of the at least one transport section 706, the at least one first transport sub-section 707 is preferably connected to the at least one second transport sub-section 708, in particular the shafts 739 thereof, by at least one spatial region 709, 711 which is preferably designed as a coupling 709; 711. The at least one first transport sub-section 707 is preferably coupled to the at least one second transport sub-section 708 by the at least one spatial region 709; 711, preferably by at least one spatial region 709; 711 designed as a coupling 709; 711. The coupling 709 and/or the coupling 711 preferably comprise at least one coupling rod 713.

Preferably, the spatial region 709; 711, preferably the at least one coupling 709; 711, of at least one transport section 706 of the transport sections 706 is designed so as not to transmit torque from one transport sub-section 707; 708 to the at least one respective other. The at least one coupling 709; 711 of at least one transport section 706 of the transport sections 706 preferably does not transmit any torque. For example, the spatial region 709; 711 comprises at least one bearing arrangement 712, in particular for bracing the at least one shaft 739, in particular the at least two shafts 739 of the at least two transport sections 706, between the at least two transport sub-sections 707; 708, preferably between at least two transport elements 701. In the case of the second preferred embodiment of the at least one transport section 706, the design of the at least one coupling 709; 711 preferably differs depending on whether or not the at least one transport section 706 is designed so as to be axially adjustable.

In a preferred embodiment of the spatial region 709 which is preferably designed as a coupling 709, the at least one spatial region 709 is preferably additionally designed so as not to transmit an axial movement from one transport sub-section 707; 708 to the respective other. The spatial region 709 preferably designed as a coupling 709 preferably only serves to brace and/or support the at least one shaft 739 of the at least one transport section 706. Transport sections 706 of the first alignment region, which preferably exclusively belong to the first alignment region and/or which preferably do not additionally belong to the second alignment region, preferably comprise this spatial region 709 which is preferably designed as a coupling 709. For example, the at least one spatial region 709, preferably the at least one coupling 709, preferably serves to support the shaft 739 of the at least one first transport sub-section 707 and to support the shaft 739 of the at least one second transport sub-section 708 without force transmission and without torque transmission between the at least two shafts 739 among each other. If a coupling rod 713 of the coupling 709 is present, the coupling rod 713 of the at least one coupling 709 preferably in each case comprises at least one floating bearing for the at least one first transport sub-section 707 and for the at least one second transport sub-section 708. A transport section 706 without axial adjustment preferably comprises the at least one spatial region 709, preferably the at least one coupling 709.

In a further preferred embodiment of the spatial region 711 preferably designed as a coupling 711, the at least one spatial region 711 of at least one transport section 706 of the transport sections 706 is preferably designed so as to transmit or transmits an axial movement from the at least one first transport sub-section 707 to the at least one second transport sub-section 708 and/or vice versa. The at least one spatial region 711 preferably designed as a coupling 711 is preferably only designed so as to transmit an axial force from the at least one first transport sub-section 707 to the at least one second transport sub-section 708 and/or vice versa. Transport sections 706 of the second alignment region, which preferably additionally belong to the first alignment region and/or which are preferably arranged within a transport unit 700 together with at least one transport section 706 of the first alignment region, preferably comprise this spatial region 711 designed as a coupling 711. The at least one coupling 711 preferably comprises at least one coupling rod 713, which preferably can transmit and/or transmits an axial movement from one transport sub-section 707; 708 to the respective other. Preferably, a transport section 706 having axial adjustment comprises the spatial region 711 which is preferably designed as a coupling 711, preferably at least when this transport section 706 additionally belongs to the first alignment region. The at least one coupling 711 of at least one transport section 706 of the transport sections 706 preferably transmits an axial movement from the at least one first transport sub-section 707 to the at least one second transport sub-section 708 and/or vice versa. Preferably, differing speeds of the transport sub-sections 707; 708 of this transport section 706 relative to one another are made possible in the process, in particular by activation by differing main drives M.

At least the spatial region 710 is preferably designed so as to transmit torque from the at least one first transport sub-section 707 to the at least one second transport sub-section 708, in particular by way of the at least one shaft 739. If a dedicated drive $M_E$ is assigned, the transport sub-sections 707; 708 comprising the spatial region 710 are preferably axially adjustable together by this drive. In this way, this at least one transport section 706 is driven or can be driven in the circumferential direction by the main drive M and in the axial direction by a dedicated drive $M_E$.

At least one transport section 706 of the transport sections 706 of the at least one alignment segment 750 is axially adjustable, preferably regardless of the design with respect to the at least one main drive M for driving in the circumferential direction. In particular, the at least two transport sections 706 of the second alignment region for aligning an axial offset are axially adjustable. The at least one transport section 706 of the transport sections 706, preferably of at least the second alignment region, is preferably axially adjusted. Preferably, at least one substrate 02 is axially aligned as a result of the axial adjustment, in particular the at least one sheet 02 which is in direct contact with at least one transport element 701 of the axially adjusted transport section 706. Preferably, at least two, more preferably at least four, more preferably at least six, more preferably at least eleven, more preferably at least fifteen, for example seventeen, more preferably all, transport sections 706 of the at least one alignment segment 750 are axially adjustable. The transport sections 706 of the second alignment region are preferably axially adjustable.

In a preferred embodiment, the at least one alignment segment 750 comprises at least two differing transport sections 706, wherein at least one of the transport sections 706 comprises the at least one dedicated drive $M_E$ for axially adjusting the at least one transport section 706, and at least one transport section 706 of the transport sections 706 which differs therefrom comprises the transport sections 707; 708 drivable relative to one another at differing speeds in the circumferential direction. As an alternative or in addition, the at least one alignment segment 750 comprises at least one transport section 706, which comprises the at least one dedicated drive $M_E$ for axially adjusting the at least one transport section 706 and the transport sub-sections 707; 708 drivable relative to one another at differing speeds in the circumferential direction. In this way, the length of the alignment segment 750 is advantageously optimized and/or the accuracy of the alignments is increased.

In a preferred embodiment, at least one, preferably at least three, for example five, transport sections 706 of the alignment segment 750 without axial adjustment are arranged upstream in the transport direction T from the axially adjustable transport sections 706 of the alignment segment 750. These transport sections 706 without axial adjustment are preferably part of the first alignment region. At least at least one transport element 701 of the at least one transport unit 700, which is preferably designed to align substrate 02, is preferably axially adjustable. The at least one transport element 701, preferably the at least one shaft 739 comprising the at least one transport roller 701 or transport cylinder 701 arranged thereon, is preferably axially adjustable.

Axially adjustable preferably describes a change in position along the transverse direction A, in particular the position in the transverse direction A relative to a tool of a succeeding processing unit 600; 900. In the process, preferably the at least one transport section 706, preferably at least one transport element 701 of the transport section 706, is or is being transferred along the transverse direction A from a first position into a second position having a different coordinate in the transverse direction A.

The at least one axially adjustable transport section 706 of the at least one alignment segment 750 preferably has a basic position and at least one adjustment position. Preferably, at least two transport sections 706 of the transport sections 706 which follow one another in the transport direction T each have the basic position and at least one adjustment position. Preferably, at least the at least two, preferably the at least four, more preferably at least six, more preferably at least eleven, more preferably at least fifteen, for example seventeen, more preferably all, transport sections 706, which comprise at least one dedicated drive $M_E$ for the axial adjustment, each have the basic position and at least one adjustment position.

Preferably, at least the at least two, preferably the at least four, more preferably at least six, more preferably at least eleven, more preferably at least fifteen, for example seventeen, more preferably all, transport sections 706 of the second alignment region each have the basic position and at least one adjustment position. The at least one adjustment position is preferably in each case offset relative to the basic position in the transverse direction A, that is, is preferably axially adjusted. In the adjustment position, the at least one transport section 706 is arranged so as to be offset in the transverse direction A relative to the basic position thereof. The basic position is preferably the position of the transport section 706 which the transport section 706 has prior to an axial adjustment, preferably in which the same is arranged centrally in the transverse direction A. The at least one adjustment position is preferably the position which the transport section 706 has in an adjusted state. The distance between the basic position and the adjustment position is preferably in each case dependent on the activation by the at least one control unit. Preferably, depending on the direction of the adjustment movement, the adjustment position is arranged before or after the basic position in the transverse direction A.

The at least one axially adjustable transport section 706 of an alignment segment 750 comprises the at least one dedicated drive $M_E$. Preferably, the at least two, preferably the at least four, more preferably at least six, more preferably at least eleven, more preferably at least fifteen, for example seventeen, transport sections 706 of the second alignment region for aligning an axial offset in each case comprise the at least one dedicated drive $M_E$ for the axial adjustment. In other words, preferably each of the at least two axially adjustable transport sections 706 comprises a dedicated drive $M_E$. The at least one dedicated drive $M_E$ axially adjusts the at least one transport section 706 of the transport sections 706. Each of the at least two transport sections 706 having a basic position and at least one adjustment position is preferably adjusted by at least one dedicated drive $M_E$ for the axial adjustment from the basic position into the adjustment position thereof and/or vice versa. The dedicated drive $M_E$ thus preferably adjusts the at least one transport section 706 from the basic position into the adjustment position and from the adjustment position into the basic position, that is, in the transverse direction A at one point in time and counter to the transverse direction A at a point in time different therefrom.

The at least one transport section 706 of the transport sections 706 can preferably be axially adjusted individually by at least one dedicated drive $M_E$. As an alternative, at least two transport sections 706 of the transport sections 706 can preferably be axially adjusted groupwise by at least one dedicated drive $M_E$. The at least one transport section 706 of the transport sections 706 is preferably axially adjusted individually by at least one dedicated drive $M_E$, or at least two transport sections 706 of the transport sections 706 are axially adjusted groupwise by at least one dedicated drive $M_E$. The plurality of transport elements 701, which are preferably arranged one behind the other in the transport direction T, are preferably individually axially adjustable or groupwise axially adjustable. Individually preferably describes that each transport element 701 of the plurality of transport elements 701 is axially adjustable, preferably independently of further transport elements 701 of the plurality of transport elements 701. Groupwise preferably describes that at least two, preferably at least three, for example four, transport elements 701 of the plurality of transport elements 701 are axially adjustable together, that is, with a simultaneous movement and/or by the same axial distance, preferably independently of further transport elements 701 of the plurality of transport elements 701. Each of the transport sections 706 preferably comprises a dedicated drive $M_E$ for the axial adjustment. Preferably, all transport elements 701 and, for example, additionally all supporting rolls of a transport section 706 can be axially adjusted together. Transport elements 701 of differing transport sections 706 can be preferably be axially adjusted individually. Preferably, as an alternative, the groupwise adjustable transport elements 701 are arranged one behind the other in the transport direction T and/or so as to be adjacent to one another, preferably without transport elements 701 that can be adjusted independently thereof being interposed.

Preferably in the case of the second preferred embodiment, the at least one dedicated drive $M_E$ is preferably designed so as to axially adjust the at least one first transport sub-section 707 and the at least one second transport sub-section 708 of the at least one transport section 706 together. The at least one dedicated drive $M_E$ preferably axially adjusts the at least one first transport sub-section 707 and the at least one second transport sub-section 708 of the at least one transport section 706 together. This preferably minimizes the number of required dedicated drives $M_E$ and/or the number of structural components.

In the case of the second preferred embodiment of the at least one transport section 706, the at least two transport sub-sections 707; 708 are advantageously axially moved together, preferably uniformly. The coupling 711 transmitting the axial movement preferably comprises at least one bearing arrangement 714, for example a four-point bearing, of the coupling rod 713 to a transport sub-section 707; 708, preferably the first transport sub-section 707, of the at least two transport sub-sections 707; 708. As a result of the bearing arrangement 714, preferably exclusively the axial movement, and not the rotational torque, is transmitted to the at least one further transport sub-section 707; 708, preferably the second transport sub-section 708. The coupling 711 transmitting the axial movement preferably comprises at least one compensating space, by way of which pressure equalization during an axial movement is made possible. The at least one compensating space preferably at least partially surrounds the at least one coupling rod 713 and has at least one reservoir adjoining the first transport sub-section 707 and at least one reservoir adjoining the second transport sub-section 708. The at least one dedicated drive $M_E$ preferably engages on the at least one first transport sub-section 707 for the axial movement. During an axial movement of the at least one first transport sub-section 707, the at least one coupling rod 713 is preferably axially moved, and the movement is transmitted to the at least one second transport sub-section 708. Preferably, pressure equalization of a fluid situated in the at least one compensating space, preferably air, takes place. The fluid is transported through a region of the compensating space at the first transport sub-section 707 into a reservoir at the second transport sub-section 708 and/or vice versa. The lubricant, in particular the grease, of the at least one bearing arrangement 714 is preferably preserved, that is, remains at the particular lubricating point, preferably without being displaced.

The at least one alignment segment 750, in particular the second alignment region, comprises the at least one dedicated drive $M_E$ for axially adjusting at least one transport section 706 of the transport sections 706. The at least one, preferably at least two, more preferably at least five, more preferably at least eleven, more preferably all axially adjustable transport sections 706 of the at least one alignment segment 750 preferably each comprise at least one dedicated drive $M_E$ for the axial adjustment. The at least one dedicated drive $M_E$ is designed so as to axially adjust the at least one transport section 706 of the transport sections 706. Preferably, the at least one dedicated drive $M_E$ is designed so as to adjust the at least one transport section 706, preferably at least the at least one transport element 701, in the axial direction, preferably in or counter to the transverse direction A and/or orthogonally to the transport direction T in the plane of the transport path and/or in the direction of the working width. The axial adjustment is preferably carried out independently of the position and/or the adjustment of further transport sections 706. The at least one dedicated drive $M_E$ is preferably designed so as to position the at least one transport section 706 relative to at least one further transport section 706 of the at least two transport sections 706 and/or positions the same relative to the at least one further transport section 706. For example, in addition or as an alternative, the at least one dedicated drive $M_E$ is designed so as to position the at least one transport section 706 relative to at least one tool of the at least one succeeding processing unit 600; 900. In the case of the groupwise adjustment of the plurality of transport elements 701, the groupwise adjustable transport elements 701, which can be adjusted together, preferably comprise at least one dedicated drive $M_E$, that is, preferably a shared dedicated drive $M_E$. The at least one transport section 706, in particular at least the axially adjustable transport section 706, is connected to the at least one dedicated drive $M_E$. Preferably, each transport section 706, in particular at least the axially adjustable transport section 706, comprises a separate dedicated drive $M_E$. Each of the transport sections 706 thus preferably comprises a dedicated drive $M_E$ for the axial adjustment. As a result, preferably at least one transport section 706, preferably at least one transport element 701, of the transport unit 700 comprises at least two drives, these being at least one main drive M and at least one dedicated drive $M_E$.

In a preferred embodiment, the at least one dedicated drive $M_E$ is designed as a direct drive, in particular magnetic direct drive. A direct drive is also referred to as a linear motor, that is, directly generates a translatory movement. The at least one dedicated drive $M_E$ is preferably designed as a linear drive, that is, a drive causing a translatory movement, and/or an electric motor, preferably closed loop position-controlled. The at least one dedicated drive $M_E$ is preferably designed as a linear drive and/or a direct drive. The at least one dedicated drive $M_E$ is thus preferably connected without a gear mechanism to the transport section 706 to be driven, in particular the shaft 739 thereof. This advantageously minimizes the number of components and/or increases the accuracy of the adjustment.

The at least one dedicated drive $M_E$ preferably comprises at least one stator 738 and at least one rotor 737 designed as a drive shaft 737. The at least one stator 738 preferably has a tubular design. The at least one rotor 737 is preferably arranged, at least with a section, within the at least one stator 738. Advantageously, the at least one dedicated drive $M_E$ has a simple, cost-effective design, which preferably at the same time enables precise axial positioning of the at least one transport section 706.

The at least one dedicated drive $M_E$ is preferably designed so as to generate an axial force, preferably exclusively an axial force. The at least one dedicated drive $M_E$ is preferably designed so as to exclusively generate a linear movement. The at least one dedicated drive $M_E$ is preferably designed so as not to generate a torque that generates a rotational movement. In particular, the at least one dedicated drive $M_E$ preferably does not generate any torque, in particular no torque that generates a rotational movement. Advantageously, the need of a gear mechanism that translates the torque into a linear movement is dispensed with. Advantageously, the design of the dedicated drive $M_E$ increases the accuracy of the axial adjustment and/or reduces wear. In particular, the movement in the circumferential direction, preferably the rotational movement, of the at least one transport element 701 can thus take place independently of the axial movement, that is, can preferably be activated using different parameters. Preferably, an axial force, preferably exclusively an axial force, is generated by the at least one dedicated drive $M_E$. The at least one dedicated drive $M_E$ is preferably designed so as to generate an axial force, in particular only an axial force for axially adjusting the at least one rotor 737. The at least one dedicated drive $M_E$ is preferably designed so as to transmit the axial force to the at least one transport section 706, in particular the shaft 739 thereof. In this way, the axial movement thereof is preferably generated in a simple manner.

Compared to a drive which generates both the axial force and the force for the movement in the circumferential direction, the solution using at least one dedicated drive $M_E$ exclusively generating the axial force and a main drive M generating the rotational movement is preferably more cost-effective and/or has less rigidity in the rotational movement, whereby wear is preferably reduced and/or response times of the components are minimized. This advantageously makes a customization to account for necessary adjustments of the individual substrates possible.

At least one sensor, for example at least one Hall sensor, is preferably designed so as to ascertain and/or ascertains the position of the at least one rotor 737 relative to the at least one stator 738. This preferably makes it possible to set the at least one rotor 737 relative to the at least one stator 738.

Preferably, at least one control unit is provided, which activates the at least one dedicated drive $M_E$. The at least one control unit is preferably designed as a position controller, in particular for axially positioning the at least one transport section 706. The at least one control unit is preferably designed so as to generate and/or generates at least one traveling magnetic field in the at least one stator 738, in particular by setting a flow of current and/or a voltage which is applied to the at least one stator 738. Preferably, alternating voltage is present. The at least one rotor 737 preferably comprises at least one permanent magnet, preferably several permanent magnets arranged in series. The at least one dedicated drive $M_E$ is preferably designed so as to axially position the at least one rotor 737 and the at least one stator 738 relative to one another, preferably the at least one rotor 737 relative to the at least one stator 738. In particular, the at least one dedicated drive $M_E$ axially positions the at least one rotor 737 and the at least one stator 738 relative to one another. In this way, the axial positioning of the at least one shaft 739 of the transport section 706 is advantageously inferred and/or the positioning thereof is set. The at least one rotor 737 is preferably designed so as to move in the generated traveling field, preferably corresponding to the polarization of the poles occurring in the stator 738 and/or corresponding to the relative position of the poles occurring in the stator 738 with respect to one another. The extent of the axial adjustment of the at least one drive shaft 737, and thus preferably the extent of the axial adjustment of the at least one shaft 739 of the at least one transport section 706, is preferably generated by the applied voltage and/or the frequency of the traveling magnetic field.

Preferably, the at least one dedicated drive $M_E$ is designed so as to axially adjust the at least one transport section 706, preferably the at least one transport element 701, by no more than 25 mm (twenty-five millimeters), preferably by no more than 15 mm (fifteen millimeters), more preferably by no more than 10 mm (ten millimeters), more preferably by no more than 8 mm (eight millimeters), more preferably by no more than 5 mm (five millimeters), more preferably by no more than 2.5 mm (two point five millimeters). Preferably, the at least one dedicated drive $M_E$ is designed so as to axially adjust the at least one transport section 706, preferably the at least one transport element 701, by at least 0.01 mm (zero point zero one millimeters), preferably by at least 0.02 mm (zero point zero two millimeters), more preferably by at least 0.05 mm (zero point zero five millimeters), more preferably by at least 0.1 mm (zero point one millimeters), preferably by at least 0.5 mm (zero point five millimeters), more preferably by at least 1 mm (one millimeter).

The at least one transport unit 700, which is preferably designed to align substrate 02, preferably comprises the at least one transport element 701, for example also a first number of transport elements 701 that can be groupwise adjusted together, and at least one further transport element 701 arranged thereafter and/or therebefore in the transport direction T, for example also a second number of transport elements 701 that can be groupwise adjusted together. In particular, the at least one transport unit 700, which is preferably designed to align substrate 02, preferably comprises the at least one transport section 706 and at least one further transport section 706 arranged thereafter and/or therebefore in the transport direction T. Each of the transport sections 706 of the second alignment region preferably comprises a dedicated drive $M_E$ for the axial adjustment. The at least one transport unit 700, preferably of the second alignment region, preferably comprises the at least one transport section 706, in particular the at least one transport element 701 thereof, and the at least one further transport section 706 arranged thereafter and/or therebefore in the transport direction T, in particular the at least one transport element 701 thereof, which are each axially adjusted by means of a dedicated drive $M_E$. The dedicated drive $M_E$ of the at least one transport section 706, for example also the first number of transport sections 706 that can be groupwise adjusted together, preferably adjusts the at least one transport section 706, for example also the first number of transport sections 706 that can be groupwise adjusted together, by a first component in the axial direction, preferably in or counter to the transverse direction A. The dedicated drive $M_E$ of the at least one further transport section 706, for example also of the second number of transport sections 706 that can be groupwise adjusted together, preferably adjusts this section by a second component in the axial direction, preferably in or counter to the transverse direction A. The two adjustments are preferably independent of one another. As a result, the first component and the second component thus differ from one another, for example, or are identical to one another, preferably depending on the requirement.

The operative connection of the at least one main drive M to at least one transport sub-section 707; 708, in particular to the at least one respective transport sub-section 707; 708 of the at least one transport section 706 and the operative connection of the at least one dedicated drive $M_E$ to the at least one transport section 706 are preferably independent of one another. This preferably increases the accuracy of the adjustment in the axial direction. The transmission of torque by the at least one main drive M to the at least one respective transport sub-section 707; 708 of the at least one transport section 706, in particular the shaft thereof 739, preferably takes place independently of a transmission of an axial movement from the at least one dedicated drive $M_E$ to the at least one transport section 706, in particular the at least one shaft 739 thereof.

So as to superimpose the rotational torque with the axial movement, the at least one coupling 734, preferably at least one linear bearing, also referred to as a ball bushing, in particular a torque-resistant ball bushing 734, is preferably provided. Torque-resistant ball bushings 734 are drive elements for torque transmission with simultaneous translatory movement. This advantageously reduces the number of components and creates a space-saving solution. The at least one coupling 734 advantageously prevents a transmission of the axial movement of the at least one transport section 706, in particular of the at least one shaft 739 thereof, to the at least one gear train 731 and/or to a drive shaft of the at least one main drive M. Advantageously, a design of the gear wheels 732 of the at least one gear train 731 having a fixed position in the transverse direction A is created, and wear of the components of the gear train is reduced.

The at least one rotor 737 preferably comprises the at least one bearing arrangement 736, preferably the at least one axial bearing 736, to the at least one shaft 739 of the at least one transport section 706. The at least one rotor 737 is preferably connected by means of the at least one bearing arrangement 736, preferably the at least one axial bearing 736, to the at least one shaft 739 of the at least one transport section 706.

The at least one drive shaft 737 of the at least one dedicated drive $M_E$ is preferably decoupled with respect to the rotational movement from the at least one shaft 739 of the at least one transport section 706, preferably by means of at least one bearing arrangement 736 preferably designed as an axial bearing 736. The drive shaft 737 of the dedicated drive $M_E$ preferably designed as a direct drive thus preferably does not experience any rotating movement. This advantageously allows a more precise axial displacement and reduces the wear.

For example, as an alternative, the at least one rotor 737 rotates along with a rotating movement of the at least one shaft 739. As a result, however, the positioning accuracy is reduced.

The at least one alignment segment 750 preferably comprises at least one sensor 704 for substrate alignment. The at least one sensor 704 for substrate alignment is, preferably the at least two sensors 704 that are parallel in the transport direction T, more preferably the at least three sensors 704 for substrate alignment, are preferably arranged between the at least one application unit 600 and the at least one succeeding processing unit 600; 900, preferably the die-cutting unit 900. Preferably, in addition or as an alternative, the at least one sensor 704 for substrate alignment is, preferably the at least two sensors 704 that are parallel in the transport direction T are, assigned to the at least one alignment segment 750, preferably the at least one transport unit 700 which is preferably designed to align substrate 02, more preferably is arranged along the alignment segment.

In a preferred embodiment, at least one sensor 704 for substrate alignment is, for example two sensors 704 for substrate alignment that are parallel to one another are, preferably provided at only one position along the transport direction T, at least for detecting the positioning of a substrate 02 with respect to the skewed position thereof and/or with respect to the axial position thereof and/or with respect to the position thereof in the circumferential direction. For example, the processing machine 01 comprises at least one sensor 704 for substrate alignment, preferably at least two sensors 704 for substrate alignment which are parallel to one another and/or spaced apart from one another in the transverse direction A, at only one position along the transport direction T. Preferably, at least one sensor 704 for substrate alignment is only arranged at one position along the transport direction T, which preferably detects at least one printing mark. For example, at least one further sensor 164; 622; 722; 922, which preferably detects at least one edge 03; 04 of the substrate 02, is then arranged at at least one position that is spaced apart in the transport direction T, for example at at least one position of the further positions, shown above and below, of the at least one sensor 704 for substrate alignment.

Advantageously, at least one printing mark is thus detected at only one position along the transport direction T, in particular for computing a positioning of the substrate 02 including the at least one printing mark. This advantageously minimizes costs of the sensor system and/or minimizes a data set to be taken into consideration in the computation of the positioning.

In an alternative preferred embodiment, at least one sensor 704 for substrate alignment is, preferably at least two sensors 704 for substrate alignment which are parallel to one another and/or spaced apart from one another in the transverse direction A, are in each case arranged in the processing machine 01 at at least two, for example at only two or at at least three, positions along the transverse direction T. Preferably, at least one sensor 704 for substrate alignment of the sensors 704 for substrate alignment is, for example two sensors 704 for substrate alignment which are parallel to one another are, designed at least for detecting the positioning of a substrate 02 with respect to the skewed position thereof and/or with respect to the axial position thereof and/or with respect to the position thereof in the circumferential direction. This advantageously increases the accuracy of the detection of the positioning of the substrate 02 and/or the accuracy of the alignment of the substrate 02.

The processing machine 01 preferably comprises at least one first sensor 704 for substrate alignment and/or at least one second sensor 704 for substrate alignment and/or at least one third sensor 704 for substrate alignment. The at least one first sensor 704 for substrate alignment and/or the at least one second sensor 704 for substrate alignment and/or the at least one third sensor 704 for substrate alignment are preferably sensors 704 that differ from one another, at differing positions in the transport direction T. For example, as an alternative, at least two of the sensors 704 for substrate alignment of the at least one first sensor 704 for substrate alignment and/or of the at least one second sensor 704 for substrate alignment and/or of the at least one third sensor 704 for substrate alignment are combined in one sensor 704 for substrate alignment and/or arranged at a shared position along the transport direction T. Preferably, at least one shared sensor 704 for substrate alignment, at a position along the transport direction T, then carries out the detection of the positioning of the substrate 02 with respect to the skewed position thereof and/or with respect to the axial position thereof and/or with respect to the position thereof in the circumferential direction.

Preferably, at least one sensor 704 for substrate alignment of the sensors 704 for substrate alignment is arranged before at least one first transport section 706 of the alignment segment 750, which is preferably axially adjustable. For example, at least one sensor 704 for substrate alignment of the sensors 704 for substrate alignment is arranged after at least one first transport section 706 of the alignment segment 750, which is preferably axially adjustable. In particular, the alignment segment 750 preferably comprises at least one sensor 704 for substrate alignment at at least one position, preferably at at least two positions, more preferably at at least three positions, along the alignment segment 750 in the transport direction T. For example, as an alternative, the alignment segment 750 comprises at least one sensor 704 for substrate alignment, for example two sensors 704, which more preferably are arranged parallel to one another, at only one position along the alignment segment 750 in the transport direction T. At least one sensor 704 for substrate alignment in each case is, preferably at least two sensors 704 for substrate alignment in each case are, arranged along the at least one alignment segment 750, preferably at at least two, preferably at least three, positions. This preferably allows the activation of the transport sections 706 to be checked and/or readjusted based on the particular substrate detection.

In a preferred embodiment, at least two sensors 704 for substrate alignment, preferably in each case only two sensors 704 for substrate alignment, are arranged one behind the other in the transverse direction A at the at least one position, preferably at a first position and/or at a second position and/or at a third position, which preferably each recognize the substrate 02. Preferably two sensors 704, preferably sensors 704 designed as cameras, are in each case arranged at a position along the transport direction T, so that preferably at least two printing marks that are spaced apart from one another are detectable at the one position along the transport direction T. These at least two sensors 704 are preferably arranged parallel to one another in the transport direction T. As an alternative, for example, a sensor 704 for substrate alignment is arranged at the at least one position, the detection range of which comprises at least two positions that are spaced apart from one another in the transverse direction A. Preferably, at least two first sensors 704 for substrate alignment are arranged parallel to one another in the transport direction T and/or at least two second sensors 704 for substrate alignment are arranged parallel to one another in the transport direction T and/or at least two third sensors 704 for substrate alignment are arranged parallel to one another in the transport direction T. This advantageously enables a, preferably selective, evaluation of a skewed position and/or of an axial offset and/or of the alignment in the circumferential direction at the particular position.

Preferably, at least one sensor 704 for substrate alignment is at least provided for detecting the positioning of a substrate 02 with respect to the skewed position thereof, which above and below is preferably referred to as a first sensor 704 for substrate alignment. Preferably, the at least one first sensor 704 for substrate alignment, preferably at least one sensor pair made up of at least two first sensors 704 for substrate alignment which are arranged parallel to one another in the transport direction T, is assigned to the first alignment region for the alignment of a skewed position. The at least one first sensor 704 for substrate alignment is, preferably the at least two first sensors 704 for substrate alignment are, preferably arranged in the transport direction T before at least 75%, preferably before at least 80%, more preferably before at least 85%, more preferably before at least 90%, of the transport sections 706, in particular the transport elements 701 thereof, of the at least one alignment segment 750, preferably immediately therebefore, in particular without further transport units 700 or transport sections 706 being interposed. Preferably, the at least one sensor 704 for substrate alignment is, preferably the at least two sensors 704 for substrate alignment are, arranged in the transport direction T before at least 75%, preferably before at least 80%, more preferably before at least 85%, of the transport elements 701 of the transport unit 700, which is preferably designed to align substrate 02, and preferably immediately therebefore, in particular without further transport means 700 being interposed. More preferably, the at least one first sensor 704 for substrate alignment is, preferably the at least two first sensors 704 for substrate alignment are, arranged in the transport direction T before a first transport section 706 of at least the first alignment region, preferably before a first transport section 706 of the alignment segment 750. In particular, the at least one first sensor 704 for substrate alignment has a data connection to the at least one control unit of the first alignment region. For example, the at least one main drive M of the first alignment region is activated by means of data of the at least one first sensor 704 for substrate alignment, preferably so as to compensate for a skewed position of the substrate 02.

For example, the at least one first sensor 704 for substrate alignment is alternatively arranged in a unit 100; 300; 600; 700 arranged upstream from the at least one alignment segment 750. At least one further sensor 164; 622; 704; 722; 922, which is designed as a light sensor, for example, is then preferably arranged at the at least one alignment segment 750 and/or is preferably assigned to the at least one first alignment region, wherein this sensor 164; 622; 704; 722; 922 preferably detects at least one edge 03; 04 of the substrate 02. For example, the at least one further sensor 164; 622; 704; 722; 922 triggers an adjustment of the at least one transport section 706, in particular of the at least one first and/or the at least one second transport sub-section 707; 708, wherein data of the at least one sensor 704 for substrate alignment are preferably taken into consideration in the at least one control unit for the adjusting movement.

The at least one alignment segment 750 preferably comprises the at least one main drive M for driving in the circumferential direction the at least one transport sub-section 707; 708 of the at least two transport sections 706 of the first alignment region, preferably the at least one main drive M for driving in the circumferential direction the at least one first transport sub-section 707 and the at least one main drive M for driving in the circumferential direction the at least one second transport sub-section 708. In other words, preferably the at least one transport sub-section 707; 708 of the at least two transport sections 706 of the first alignment region is in each case driven by the main drive M, in particular by way of the coupling. The at least one first sensor 704 for substrate alignment is preferably connected to the at least one main drive M, preferably to the at least two main drives, by means of the at least one control unit. Advantageously, the at least one main drive M is controlled based on ascertained data, preferably based on the sensor detection by the at least one first sensor 704 for substrate alignment. The at least one first transport sub-section 707 and the at least one second transport sub-section 708 of the at least two transport sections 706 of the first alignment region for aligning a skewed position can preferably be driven relative to one another at differing speeds in the circumferential direction based on ascertained data, preferably based on the sensor detection by the at least one first sensor 704 for substrate alignment.

In a preferred embodiment, at least one further sensor 704 for substrate alignment is, in particular at least one second and/or at least one third sensor 704 for substrate alignment is, for example at least two sensors 704 for substrate alignment which are arranged one behind the other in the transverse direction A and/or are arranged parallel to one another in the transport direction T are, arranged along the transport path after the at least one first sensor 704 for substrate alignment and before the succeeding processing unit 600; 900, preferably die-cutting unit 900. For example, if there are at least two transport units 700 of the alignment segment 750, at least one further sensor 704 for substrate alignment is, in particular at least one second and/or at least one third sensor 704 for substrate alignment, preferably at least two sensors 704, are arranged in the transport direction T after at least 40%, preferably after at least 50%, more preferably after at least 55%, of the transport sections 706 of the at least one alignment segment 750 and/or before at least 70%, preferably before at least 65%, more preferably before at least 60%, of the transport sections 706 of the at least one alignment segment 750.

Preferably, at least one sensor 704 for substrate alignment is at least provided for detecting the positioning of a substrate 02 with respect to the axial position thereof, which above and below is preferably referred to as a second sensor 704 for substrate alignment. Preferably, the at least one second sensor 704 for substrate alignment, preferably at least one sensor pair made up of at least two second sensors 704 for substrate alignment which are arranged parallel to one another in the transport direction T, is assigned to the second alignment region for alignment of an axial offset. In particular, the at least one second sensor 704 for substrate alignment has a data connection to the at least one control unit of the second alignment region. The at least one alignment segment 750 preferably comprises the at least one dedicated drive $M_E$ for axially adjusting the at least one transport section 706 of the transport sections 706 of the second alignment region for aligning an axial offset. The at least one second sensor 704 for substrate alignment is preferably connected, preferably in terms of control, to the at least one dedicated drive $M_E$ for the axial adjustment, in particular to the at least two, more preferably at least three, more preferably all, dedicated drives $M_E$ of the second alignment region, by means of the at least one control unit. Preferably, the at least one dedicated drive $M_E$ for the axial adjustment is activated by means of ascertained data, preferably by means of data of the at least one second sensor 704 for substrate alignment, preferably so as to compensate for an axial offset.

For example, the at least one second sensor 704 for substrate alignment is alternatively arranged in a unit 100; 300; 600; 700 arranged upstream from the at least one alignment segment 750. At least one further sensor 164; 622; 704; 722; 922, which is designed as a light sensor, for example, is then preferably arranged at the at least one alignment segment 750 and/or is preferably assigned to the at least one second alignment region, wherein this sensor 164; 622; 704; 722; 922 preferably detects at least one edge 03; 04 of the substrate 02. For example, the at least one further sensor 164; 622; 704; 722; 922 triggers an adjustment of the at least one transport section 706, in particular of the at least one first and/or the at least one second transport sub-section 707; 708, wherein data of the at least one sensor 704 for substrate alignment are preferably taken into consideration in the at least one control unit for the adjusting movement.

For example, the at least one main drive M is activated by means of ascertained data, preferably by means of data of the at least one second sensor 704 for substrate alignment, preferably so as to compensate for an offset of the substrate 02 in the circumferential direction. The at least one second sensor 704 for substrate alignment is preferably connected to the at least one main drive M for driving in the circumferential direction the at least two transport sections 706 of the second alignment region, preferably by means of the at least one control unit. For example, in addition or as an alternative, for the alignment in the third alignment region, a substrate 02 is aligned within the second alignment region in the circumferential direction. The at least one main drive M preferably accelerates and/or decelerates transport sections 706 of the second alignment region based on the sensor detection, that is, in particular the deviation from the target position computed therefrom.

In a preferred embodiment, the at least one second sensor 704 for substrate alignment is arranged along the alignment segment 750 within the second alignment region. The at least one second sensor 704 for substrate alignment is preferably arranged after at least 15%, preferably after at least 25%, more preferably after at least 30%, of the transport sections 706 of the alignment segment 750. For example, in addition, the at least one second sensor 704 for substrate alignment is arranged before at least 20%, preferably before at least 30%, more preferably before at least 35%, more preferably before at least 50%, more preferably before at least 60%, of the transport sections 706 of the alignment segment 750. Preferably, at least one, preferably at least three, for example six, transport sections 706 of the transport sections 706, comprising at least one dedicated drive $M_E$ for the axial adjustment, are arranged in the transport direction T before the at least one second sensor 704 for substrate alignment. More preferably, the at least one second sensor 704 for substrate alignment is arranged after at least 15%, preferably after at least 20%, more preferably after at least 30%, of the transport sections 706 of the second alignment segment, that is, in particular the transport sections 706 of the alignment segment 750 comprising the at least one dedicated drive $M_E$ for the axial adjustment. Advantageously, the adjustment of the substrate 02 can thus begin as early as possible since the starting time of the adjustment can be before the point in time at which a trailing end of the substrate 02 passes the at least one second sensor 704 for substrate alignment.

Preferably, in addition or as an alternative, at least one, preferably at least three, more preferably at least eight, for example eleven, transport sections 706 of the transport sections 706, comprising at least one dedicated drive $M_E$ for the axial adjustment, are arranged in the transport direction T after the at least one second sensor 704 for substrate alignment. More preferably, the at least one second sensor 704 for substrate alignment is arranged before at least 40%, preferably before at least 50%, more preferably before at least 60%, of the transport sections 706 of the second alignment segment, that is, in particular the transport sections 706 of the alignment segment 750 comprising the at least one dedicated drive $M_E$ for the axial adjustment. In particular, the at least one sensor 704 for substrate alignment is connected at least to at least one dedicated drive $M_E$ arranged in the transport direction T after the at least one sensor 704, in particular to the dedicated drives $M_E$ having transport sections 706 which are arranged after the at least one sensor 704 in the transport direction T. Advantageously, as high an accuracy as possible of the alignment is achieved since the substrate 02 travels as short a path as possible along the transport path between the time at which the substrate 02 is detected and the time at which the adjustment starts. Advantageously, an as long as possible distance of the alignment segment 750, in particular of the second alignment region, is available for the axial alignment. Advantageously, even large axial offsets can be compensated for.

Preferably, the at least one transport section 706, preferably at least the at least one transport element 701, for example also the groupwise adjustable number of transport elements 701, is axially adjusted based on ascertained data, preferably based on the detection of the at least one image-producing element of the substrate 02, preferably so as to align the substrate 02 during the transport thereof. The at least one transport section 706 of the transport sections 706 of the at least one alignment segment 750, in particular of the second alignment region for aligning an axial offset, can preferably be axially adjusted based on ascertained data, more preferably based on the detection of at least one image-producing element of the substrate 02 by at least one sensor 704 for substrate alignment of the sensors 704 for substrate alignment. The at least one transport element 701, for example the groupwise adjustable transport elements 701, of the at least one transport unit 700, which is preferably designed to align substrate 02, is preferably axially adjustable based on ascertained data, more preferably based on the detection of at least one image-producing element of the substrate 02 by the at least one sensor 704 for substrate alignment. Preferably, the at least one transport section 706, preferably the at least one transport element 701, is axially adjusted based on ascertained data, preferably based on the detection of at least one image-producing element of the substrate 02. More preferably, the plurality of transport elements 701 are individually axially adjusted or groupwise axially adjusted.

Preferably, at least one sensor 704 for substrate alignment is at least provided for detecting the positioning of a substrate 02 with respect to the position thereof in the circumferential direction, which above and below is preferably referred to as a third sensor 704 for substrate alignment. Preferably, the at least one third sensor 704 for substrate alignment, preferably at least one sensor pair made up of at least two third sensors 704 for substrate alignment which are arranged parallel to one another in the transport direction T, is assigned to the third alignment region for aligning a substrate 02 in the circumferential direction. In particular, the at least one third sensor 704 for substrate alignment has a data connection to the at least one control unit of the third alignment region. The at least two transport sections 706 of the third alignment region for aligning a substrate 02 in the circumferential direction preferably comprise the at least one main drive M for driving in the circumferential direction. The at least one third sensor 704 for substrate alignment is preferably connected to the at least one main drive M for driving in the circumferential direction the at least two transport sections 706 of the third alignment region, preferably by means of the at least one control unit. Preferably, the at least one main drive M of the third alignment region is activated based on ascertained data, preferably by means of data of the at least one third sensor 704 for substrate alignment, preferably so as to align a substrate 02 in the circumferential direction.

In a preferred embodiment, the at least one sensor 704 for substrate alignment which is designed as the third sensor 704 for substrate alignment is arranged along the alignment segment 750 in the transport direction T after the at least one transport section, preferably after all transport sections 706, of the transport sections 706 comprising the at least one dedicated drive $M_E$ for the axial adjustment. The at least one third sensor 704 for substrate alignment is preferably arranged after a last transport section 706, in the transport direction T, of the second alignment region. More preferably, the at least one third sensor 704 for substrate alignment is arranged after at least 50%, preferably after at least 55%, more preferably after at least 60%, of the transport sections 706 of the alignment segment 750. For example, in addition, the at least one third sensor 704 for substrate alignment is preferably arranged before at least 20%, preferably before at least 30%, more preferably before at least 35%, of the transport sections 706 of the alignment segment 750. The alignment in the circumferential direction advantageously takes place as close as possible to the succeeding processing point 621; 910, whereby a particularly high accuracy of the processing operation is achieved.

For example, the at least one third sensor 704 for substrate alignment is alternatively arranged in a unit 100; 300; 600; 700 arranged upstream from the at least one alignment segment 750 or is arranged at the first alignment region or is arranged at the second alignment region. At least one further sensor 164; 622; 704; 722; 922, which is designed as a light sensor, for example, is then preferably arranged at the at least one alignment segment 750 and/or is preferably assigned to the at least one third alignment region, wherein this sensor 164; 622; 704; 722; 922 preferably detects at least one edge 03; 04 of the substrate 02. For example, the at least one further sensor 164; 622; 704; 722; 922 triggers an adjustment of the at least one transport section 706, in particular of the at least one first and/or the at least one second transport sub-section 707; 708, wherein data of the at least one sensor 704 for substrate alignment are preferably taken into consideration in the at least one control unit for the adjusting movement.

For example, in addition or as an alternative, the at least one third sensor 704 for substrate alignment has a data connection to the at least one control unit of the first alignment region, whereby advantageously a readjustment of the adjustment values can be and/or is initiated based on the data acquired by the at least one first sensor 704 for substrate alignment. For example, in addition or as an alternative, the at least one third sensor 704 for substrate alignment has a data connection to the at least one control unit of the second alignment region, whereby advantageously a readjustment of the adjustment values can be and/or is initiated based on the data acquired by the at least one second sensor 704 for substrate alignment.

The at least one third sensor 704 for substrate alignment preferably checks the alignment of the substrate 02 at the particular detection time, preferably with respect to a change of the position relative to the position at the point in time of the detection by the at least one first sensor 704 for substrate alignment or by the at least one second sensor 704 for substrate alignment. In this way, serial defects in the alignment, that is, defects occurring in several substrates 02, are preferably taken into consideration in the at least one control unit, preferably by superimposition of the data of the at least one first and/or of the at least one second sensor 704 for substrate alignment with the further adjustment values. For example, at least one sensor 622 for recognizing the leading edge 03 of the substrate is arranged upstream from the at least one third sensor 704 for substrate alignment, preferably so as to trigger the signal that the substrate 02 is entering the detection zone of the at least one third sensor 704 for substrate alignment.

Preferably, in addition or as an alternative to the at least one third sensor 704 for substrate alignment, the at least one alignment segment 750 preferably comprises the at least one sensor 622; 922 which recognizes a leading end of the substrate 02, preferably the leading edge 03 of a substrate 02, and/or which supplies data for setting a start of the processing operation of a substrate 02 at a succeeding processing point 621; 910. This sensor 622; 922 is preferably designed as a light sensor and/or a photoelectric sensor. This at least one sensor 622; 922 is preferably assigned to the third alignment region for aligning a substrate 02 in the circumferential direction. In particular, the at least one sensor 622; 922 has a data connection to the at least one control unit of the third alignment region. The at least one sensor 622; 922, in particular the at least one sensor 622; 922 recognizing a leading end, preferably the leading edge 03, of a substrate 02 is preferably connected by means of the at least one control unit to the at least one main drive M for driving in the circumferential direction the at least two transport sections 706 of the at least one third alignment region. Preferably, the at least one main drive M of the at least one third alignment region is activated based on ascertained data, preferably by means of data of the at least one sensor 622; 922, preferably so as to align a substrate 02 in the circumferential direction.

The at least one sensor 622; 922 recognizing a leading end, preferably the leading edge 03, of a substrate 02, is, in particular the at least two sensors 622; 922 for recognizing a leading end, preferably the leading edge 03, of a substrate 02, are preferably arranged in the transport direction T after at least 75%, preferably after at least 80%, more preferably after at least 85%, of the transport sections 706 of the at least one alignment segment 750. The at least one sensor 622; 922 recognizing a leading end, preferably the leading edge 03, of a substrate 02 is more preferably arranged in the transport direction T after the at least one transport section 706 comprising the at least one dedicated drive $M_E$ for the axial adjustment, that is, preferably after the second alignment region. The at least one sensor 622; 922 for recognizing the leading end, preferably the leading edge 03, of a substrate 02 is, in particular the at least two sensors 622; 922 for recognizing a leading edge 03 of a substrate 02 are, arranged in the transport direction T at least before a last transport section 706, preferably at least before the last two transport sections 706, of the at least one alignment segment 750. The detection of the substrate 02 for the alignment in the circumferential direction advantageously takes place as close as possible to the succeeding processing point 621; 910, whereby a particularly high accuracy of the processing operation is achieved.

For example, in addition or as an alternative, the at least one sensor 622; 922 recognizing a leading end, preferably the leading edge 03, of a substrate 02 is connected by means of the at least one control unit to the at least one main drive M for driving in the circumferential direction the at least one transport section 706 of the transport sections 706 comprising at least one dedicated drive $M_E$ for the axial adjustment, that is, preferably to the at least one main drive M for driving in the circumferential direction the at least one transport section 706 of the second alignment region. For example, in addition or as an alternative, for the alignment in the third alignment region, a substrate 02 is thus aligned within the second alignment region in the circumferential direction.

Preferably, in particular if present, the at least one first sensor 704 for substrate alignment and the at least one second sensor 704 for substrate alignment and the at least one third sensor 704 for substrate alignment are sensors 704 for substrate alignment which differ from one another, at differing positions along the transport direction T within the processing machine 01, preferably along the at least one alignment segment 750. For example, as an alternative, at least one sensor 704 for substrate alignment assumes the function of at least two sensors 704 for substrate alignment, for example of the first and the second sensors 704 for substrate alignment or of the second and the third sensors 704 for substrate alignment or of the first, the second or the third sensor 704 for substrate alignment, at only one position along the transport direction T within the processing machine 01, preferably along the alignment segment 750. This at least one sensor 704 for substrate alignment is then preferably connected to the control units of the first and/or second and/or third alignment regions. This at least one sensor 704 for substrate alignment is preferably arranged at the only one position of the at least one first sensor 704 for substrate alignment. Advantageously, for example, at least two, preferably all, alignment regions of the alignment segment are thus activated based on the ascertained data.

Preferably, at least one sensor 622 recognizing a leading end of the substrate 02, preferably the leading edge 03 of the substrate 02, for example a photoelectric sensor, is arranged upstream from at least one sensor 704 for substrate alignment of the sensors 704 for substrate alignment. Preferably, at least one sensor 622 recognizing a leading end of the substrate 02, preferably the leading edge 03 of the substrate 02, for example a photoelectric sensor, is arranged upstream from the at least two sensors 704 for substrate alignment at two different positions along the alignment segment 750, more preferably from the at least three sensors 704 for substrate alignment at three different positions along the alignment segment 750, in particular the at least two sensors 704 arranged parallel to or next to one another in the transport direction T. This sensor preferably provides a signal to the at least one sensor 704 for substrate alignment that the substrate 02 is entering the detection zone of the sensor 704 for substrate alignment. In particular, the signal of the at least one sensor 622 triggers the recognition mechanism of the at least one sensor 704 for substrate alignment. As a result of the at least one signal of the at least one sensor 622 recognizing a leading end of the substrate 02, preferably the leading edge 03 of the substrate 02, a respective evaluation of the data set acquired by the at least one sensor 704 for substrate alignment of the sensors 704 for substrate alignment, to which the at least one sensor 622 is assigned, is preferably triggered.

Preferably, the at least one sensor 704 for substrate alignment, which is preferably connected to the at least one transport section 706, in particular to the at least one transport element 701, comprises at least one photocell. The at least one sensor 704 for substrate alignment is preferably designed as a light sensor. In a preferred embodiment, the at least one sensor 704 for substrate alignment is designed as a sensor for contrast recognition. In addition or as an alternative, the at least one sensor 704 for substrate alignment is designed as a sensor for recognizing at least one printing mark. The at least one sensor 704 for substrate alignment is, preferably the sensors 704 for substrate alignment of the alignment segment 750 are, preferably designed to detect at least one image-producing element of a substrate 02, preferably at least one trapezoidal element and/or a wedge mark. Preferably, the at least one sensor 704 for substrate alignment detects, preferably the at least one first sensor 704 for substrate alignment and/or the at least one second sensor 704 for substrate alignment and/or the at least one third sensor 704 for substrate alignment detect, the at least one image-producing element of the substrate 02. The at least one sensor 704 for substrate alignment preferably has at least one detection zone, which preferably covers a region of the transport path of substrate 02. The at least one sensor 704 for substrate alignment preferably recognizes a substrate 02 passing the sensor 704 for substrate alignment along the transport path. In a preferred embodiment, the at least one sensor 704 for substrate alignment detects the at least one image-producing element of the substrate 02, and more preferably the at least one printing mark. For example, in addition or as an alternative to the at least one image-producing element, the at least one sensor 704 for substrate alignment preferably detects an edge 03; 04, in particular leading edge 03 and/or trailing edge 04, of the substrate 02 and/or register mark 16; 17; 18; 19; 21; 22; 23; 24 and/or an element of a print image that can be distinguished from the surrounding area thereof. In a preferred embodiment, the substrate 02, preferably the at least one image-producing element, more preferably the at least one printing mark, is recognized as a result of the difference in contrast with respect to the surrounding area of the object to be recognized, in particular with respect to the surface of the substrate 02 surrounding the image-producing element.

For example, as an alternative, the at least one sensor 704 for substrate alignment is designed as an image acquisition device, preferably a camera, wherein this, however, causes a longer processing time of the data and thus, for example, a slower control response.

In an alternative or additional embodiment, the at least one sensor 704 for substrate alignment detects at least one edge 03; 04 of the substrate 02. For example, the sensor 704 for substrate alignment only detecting at least one edge 03; 04 is more cost-effective than a sensor 704 for substrate alignment recognizing at least one image-producing element. If only the at least one edge 03; 04 is detected, the alignment of the print image with the die-cut pattern is more imprecise than in the case where at least one image-producing element is recognized. This is why, for example, data establishing a relationship between a print image of the substrate 02 and at least one edge 03; 04 of the substrate 02, for example the positioning thereof relative to one another, is stored in a control unit. Advantageously, the data establishing a relationship between a print image of the substrate 02 and at least one edge 03; 04 of the substrate 02, for example the positioning thereof relative to one another, are included in the computation of the required adjustment movements, for example of the axial adjustment path and/or the rotational speed of at least one transport section 706.

In a preferred embodiment, the at least one image-producing element which is detected by the at least one sensor 704 for substrate alignment is a printing mark. The detection of an image-producing element preferably allows the position of the substrate 02 in the transport direction T to be detected, preferably by way of the detection time. The at least one printing mark is preferably an element that can be printed by at least one application unit 600. For example, the substrate 02 already includes the at least one image-producing element when fed into the processing machine 01, for example, as an alternative, the at least one image-producing element is printed by at least one application unit 600 of the processing machine 01, preferably by the first application unit 600 of the processing machine 01 along the transport path.

The substrate 02 preferably includes at least two, for example four, image-producing elements, preferably at least two printing marks, on the surface thereof, in particular on one side of the surface. By using at least two image-producing elements, preferably by the detection thereof by means of the at least one sensor 704 for substrate alignment, the accuracy of the detection is preferably increased and/or the detection of a skewed position of the substrate 02 is made possible. The at least two image-producing elements are preferably arranged so as to be spaced apart axially, that is, in the transverse direction A, and/or in the direction X from one another. Preferably, the at least one image-producing element, preferably in each case the at least two image-producing elements, are arranged on the substrate 02 so as to be arranged in the at least one detection zone when passing a detection zone of the at least one sensor 704 for substrate alignment. Preferably, the substrate 02, preferably the sheet 02, includes the at least one image-producing element in the region of the leading end of the substrate 02, for example close to the leading edge 03, that is, spaced a shorter distance apart from the leading edge 03 than from the trailing edge 04, and/or preferably outside a region of the substrate 02 which forms an end product.

The at least one image-producing element preferably has a varying length in the direction Y, that is, in the transport direction T, along the direction X, that is, preferably in the transverse direction A. The at least one image-producing element preferably includes a forward edge in the direction y, which corresponds to a line parallel to the direction X. Proceeding from the forward edge, the at least one image-producing element, preferably at a first position, preferably along the direction X, has a first length in the direction Y toward the trailing edge 04 of the substrate 02. At a second position along the direction X, the at least one image-producing element, preferably in the direction Y toward the trailing edge 04 of the substrate 02, has a second length, which differs from the first length of the first position, for example is longer or shorter. For example, the at least one image-producing element is trapezoidal or wedge-shaped or triangular. The at least two image-producing elements, which are preferably arranged parallel to one another in the direction X, are preferably mirror-symmetrical with respect to one another.

Preferably, the at least one image-producing element, preferably the at least one printing mark, is recognized by the at least one sensor 704 for substrate alignment. Preferably, one of the at least two sensors 704 that are parallel to one another in each case recognizes at least one printing mark. For example, the at least one sensor 704 for substrate alignment recognizes a difference in contrast that is present as soon as the at least one image-producing element enters the detection zone. The difference in contrast is likewise preferably recognized when the at least one image-producing element leaves the detection zone. Preferably, the duration of the detection of the at least one image-producing element in the detection zone is determined. Preferably, the arrival time of the substrate 02, and thus preferably the position in the transport direction T, is determined by the initial detection of the at least one image-producing element in the detection zone. As a result of the duration of the detection of the at least one image-producing element in the detection zone, preferably the axial position of the substrate 02, that is, a lateral offset of the substrate 02 relative to a target position, is determined. As a result of a detection of the at least two image-producing elements, which are preferably spaced apart from one another in the direction X, preferably a skewed position of the substrate 02 is determined.

Preferably, the forward edge of the image-producing elements, and preferably the difference in contrast that occurs during the initial detection of the at least two image-producing elements in the at least one detection zone, is used for this purpose. Preferably, the at least two sensors 704 for substrate alignment are used for this purpose, which each detect one of the at least two image-producing elements. For example, as an alternative, the detection zone of the one sensor 704 for substrate alignment is designed so as to be able to detect both image-producing elements.

The at least one alignment segment 750 of the processing machine 01 is activated. Preferably, the at least one alignment segment 750 is activated so as to align at least one preferably sheet-format substrate 02. The at least one alignment segment 750 arranged before at least one processing unit 600; 900, in particular shaping unit 900, of the processing machine 01 is activated, more preferably the alignment segment 750 arranged between two consecutive processing units 600; 900, more preferably the alignment segment 750 arranged between a processing unit 600 designed as an application unit 600 and a processing unit 900 designed as a shaping unit 900.

At least one substrate 02 is preferably aligned by the at least one alignment segment 750, preferably with respect to the skewed position and/or axial position and/or position thereof in the circumferential direction. The at least one substrate 02 is preferably aligned with respect to the position thereof based on ascertained data, preferably based on the at least one sensor detection. During the sensor detection and/or during the alignment, the at least one substrate 02 is preferably moved along the alignment segment 750 in the transport direction T.

The activation of the at least one alignment segment 750 and/or the alignment of the at least one substrate 02 are preferably carried out incrementally. The individual steps of the activation of the at least one alignment segment 750 are preferably carried out in addition or as an alternative to one another, preferably depending on the evaluation of the actual position of the substrate 02. The at least one substrate 02 is preferably transported along the at least one alignment segment 750 in the transport direction T during each step, preferably during each step of at least three steps. In a preferred first step, the at least one substrate 02 is preferably aligned with respect to the skewed position thereof. In a preferred second step, the at least one substrate 02 is preferably aligned with respect to the axial position thereof. In a preferred third step, the at least one substrate 02 is preferably aligned with respect to the position thereof in the circumferential direction.

The activation in each case preferably takes place based on ascertained data, in particular data with respect to the positioning of the print image of the substrate 02 relative to at least one edge 03; 04 of the substrate 02 and/or with respect to the positioning of the substrate 02 relative to a reference. The ascertained data of the first step are preferably ascertained by at least one sensor 704 for substrate alignment and/or the ascertained data of the second step are ascertained by at least one sensor 704 for substrate alignment and/or the ascertained data of the third step are ascertained by at least one sensor detection. The data are preferably ascertained within the at least one alignment segment 750. For example, as an alternative, the data are ascertained elsewhere in the processing machine 01, for example in the infeed device 300 or the feeder 100 and stored in the at least one control unit. For example, at least one sensor which detects an edge 03; 04 of the substrate 02, and thus preferably the presence thereof in the region of the alignment segment 750, is then arranged at the position along the transport direction T of the at least one sensor 704 for substrate alignment, wherein the control unit preferably activates the alignment region when a presence is detected.

In an alignment region of the alignment regions the substrate 02 is preferably in each case aligned with respect to a parameter such as the skewed position, axial offset and position in the circumferential direction. The at least one control unit of the processing machine 01 controls by closed loop and/or open loop the at least one alignment segment 750 based on ascertained data, preferably based on the detection of the at least one substrate 02 by the at least one first sensor 704 for substrate alignment and/or based on the detection of the at least one substrate 02 by the at least one second sensor 704 for substrate alignment and/or based on the detection of the at least one substrate 02 by the at least one third sensor 704 for substrate alignment. The actual position of the substrate 02 relative to a reference and/or target position is preferably determined by the at least one control unit. For example, a tolerance is defined, within the scope of which the actual position of the substrate 02 is accordingly recognized as the reference and/or target position. The position of the substrate 02 is preferably corrected in the event of a deviation from the reference and/or target position, in particular outside the tolerance. For example, a deviation exists in the case of a deviation by at least 0.005 mm (zero point zero zero five millimeters), preferably by at least 0.01 mm.

In the preferred first step, the at least one substrate 02 is preferably aligned with respect to the skewed position thereof. Preferably, the at least one first alignment region is activated. In the preferred first step, the at least one first alignment region of the at least three alignment regions of the alignment segment 750 is activated for aligning a skewed position based on ascertained data. More preferably, in the preferred first step, the at least one first alignment region of the at least three alignment regions of the at least one alignment segment 750 for aligning a skewed position is activated, preferably by the at least one control unit, based on data of the at least one sensor 704 for substrate alignment, preferably of the at least one first sensor 704 for substrate alignment. For example, as an alternative, the data are ascertained elsewhere in the processing machine 01, for example in the infeed device 300 or the feeder 100 and stored in the at least one control unit. For example, at least one sensor which detects an edge 03; 04 of the substrate 02, and thus preferably the presence thereof in the region of the alignment segment 750, is then arranged at the position along the transport direction T of the at least one first sensor 704 for substrate alignment, wherein the control unit preferably activates the alignment region when a presence is detected. Along the at least one alignment segment 750, the at least one first sensor 704 for substrate alignment preferably detects the positioning of at least one substrate 02 with respect to the skewed position thereof. The skewed position of the substrate 02 relative to a reference and/or target position is preferably determined based on ascertained data, preferably by the at least one control unit. The at least one substrate 02 is preferably aligned in terms of skew in the at least one first alignment region and/or in the first step. The at least one sensor 704 for substrate alignment of the first step, in particular the at least one first sensor 704 for substrate alignment, is preferably arranged in the transport direction T before at least 75%, preferably before at least 80%, more preferably before at least 85%, more preferably before at least 90%, more preferably before the first transport section 706, of the transport sections 706 of the at least one alignment segment 750 and/or the at least one sensor 704 for substrate alignment of the first step, in particular the at least one first sensor 704 for substrate alignment, preferably detects the at least one image-producing element of a substrate 02.

In the case of the first preferred embodiment of the at least one transport section 706, that is, preferably when only one main drive M is assigned to the at least one transport section 706 and/or preferably when the at least one first transport sub-section 707 and the at least one second transport sub-section 708 of the transport section 706 are driven by a main drive M, when a skewed position of the substrate 02 is identified by the at least one sensor 704 for substrate alignment, preferably the at least one first sensor 704, wherein more preferably the at least one first sensor 704 for substrate alignment is connected to the at least one dedicated drive $M_E$ of the at least one transport section 706, the skewed position of the substrate 02 is compensated for by axially adjusting the at least one transport section 706, in particular the at least one transport element 701 thereof. Preferably, the at least one control unit controls the at least one dedicated drive $M_E$. Preferably, for compensating for the skewed position, the substrate 02, preferably the sheet 02, is transported in the transport direction T until both the leading edge 03 and the trailing edge 02 can be moved by transport elements 701 of this transport unit 700, preferably when no other transport elements 701 of further transport units 700 are in contact with the substrate 02. In the process, preferably at least the transport elements 701 that are in contact with the substrate 02 are preferably arranged in a starting position. Preferably, in each case at least as many transport sections 706, in particular as many transport elements 701 arranged one behind the other in the transport direction T, as are located within the length of the distance along the alignment segment 750 in the transport direction T are axially adjusted, wherein the length corresponds to the length of the at least one working zone of the at least one plate cylinder 616; 901 of the at least one processing unit 600; 900 of the processing units 600; 900. This advantageously ensures that the substrate 02 is adjusted by all transport sections 706 in contact therewith, that is, does not experience any force and/or moment working against the adjustment by the relevant transport sections 706. Preferably, a turning point of the substrate 02 is stored in the machine control system, preferably in the control unit controlling the at least one dedicated drive $M_E$, for example in particular computed from the length and/or width of the substrate 02. The turning point is preferably the point about which the substrate 02 has to be turned to compensate for the skewed position. At least one transport element 701, which in the transport direction T is arranged before, that is, downstream from, the turning point, is preferably axially adjusted in or counter to the transverse direction A, preferably by means of the dedicated drive $M_E$ thereof. At least one transport element 701, which in the transport direction T is arranged after, that is, upstream from, the turning point, is preferably axially adjusted in the opposite direction with respect to the transport element 701 before the turning point, preferably by means of the dedicated drive $M_E$ thereof. The transport element 701, which corresponds to the position of the turning point, is preferably not axially adjusted, but remains in the axial position thereof assumed at this time. For example, the transport elements 701 are adjusted groupwise or individually, in each case those transport elements 701 that are in contact with the substrate 02. The adjustment, for example, is carried out incrementally or continuously, in particular as long as the contact exists between the particular transport element 701 and the substrate 02. Preferably, the at least one transport element 701 is axially adjusted by no more than 15 mm (fifteen millimeters), preferably by no more than 10 mm (ten millimeters), more preferably by no more than 8 mm (eight millimeters), more preferably by no more than 5 mm (five millimeters), more preferably by no more than 2.5 mm (two point five millimeters). Preferably, the at least one transport section 706, preferably the at least one transport element 701, is preferably axially adjusted and/or is at least axially adjustable by at least 0.1 mm (zero point one millimeters), preferably by at least 0.5 mm (zero point five millimeters), more preferably by at least 1 mm (one millimeter). Since the substrate 02 is simultaneously moved in the transport direction T, preferably by means of the revolving movement preferably generated by the at least one main drive M, a further transport element 701 makes contact with the substrate 02, while a first transport element 701, in the transport direction T, of the transport unit 700 is no longer in contact with the substrate 02. In addition, the turning point is moved in the transport direction T due to the movement of the substrate in the transport direction T. The transport element 701 that has now made contact is preferably likewise axially adjusted starting with the contact with the substrate 02, corresponding to the direction in which the transport elements 701 are adjusted before the turning point. The transport element 701 which now has the position of the turning point remains in the position thereof, while the transport element 701 that no longer has the turning point is likewise axially adjusted, corresponding to the direction of the transport elements 701 behind the turning point. The transport element 701 that is no longer arranged in contact with the substrate 02 is preferably axially adjusted so as to return into the starting position. As a result, each further transport element 701 making contact is preferably axially adjusted, while each transport element 701 ending the contact is axially adjusted into the starting position thereof. The substrate 02 preferably reaches the target position thereof at least at the last transport section 706 of the at least one first alignment region, preferably at least before the last transport element 701 of the transport unit 700 of the alignment segment 750.

In the case of the second preferred embodiment of the at least one transport section 706, wherein the at least one first transport sub-section 707 and the at least one second transport sub-section 708 preferably comprise differing main drives M, when a skewed position of the substrate 02 is identified by the at least one sensor, preferably at least two sensors, 704 for substrate alignment of the first step, preferably the at least one first sensor 704 for substrate alignment, the skewed position of the substrate 02 is preferably compensated for by individual, preferably differing, activations of the speeds in the circumferential direction of the at least one first transport sub-section 707 and the at least one second transport sub-section 708. The at least one main drive M drives the at least one transport sub-section 707; 708 of the at least one transport section 706 of the at least two transport sections 706 of the at least one first alignment region in the circumferential direction. In particular, the one main drive M in each case drives the at least one transport sub-section 707; 708 of the at least one transport section 706 of the at least two transport sub-sections 706 in the circumferential direction. The at least one control unit preferably controls the at least one main drive M based on the ascertained data, preferably based on the sensor detection by the at least one sensor 704 for substrate alignment of the first step, more preferably by the at least one first sensor 704 for substrate alignment. The at least one control unit preferably controls the at least one main drive M of the at least one first transport sub-section 707 and/or the at least one main drive M of the at least one second transport sub-section 708 of at least one transport section 706 of the transport sections 706 of the at least one first alignment region. So as to compensate for the skewed position, the preferably sheet-format substrate 02 is preferably transported in the transport direction T until both a leading end and a trailing end of the substrate 02, preferably both the leading edge 03 and the trailing edge 04, are moved by transport sections 706 of the at least one alignment segment 750, preferably by transport sections 706 of the at least one first alignment region, for example by transport elements 701 of the first transport unit 700 of the alignment segment 750.

Until the substrate 02 is arranged on the transport sections 706 of the first alignment region, for example, the at least one main drive M of the first transport sub-sections 707 drives the at least one first transport sub-section 707 at an initial speed $v_0$, and the at least one main drive M of the second transport sub-sections 708 drives the at least one second transport sub-section 708 at the initial speed $v_0$, with the speeds being identical relative to one another. The transport sub-sections 707; 708 are preferably driven at the initial speed $v_0$ until the substrate 02, over the entire length thereof, is arranged in an active region of the transport sections 706 of the at least one first alignment region, preferably is in contact with transport sections 706 of the alignment segment 750, in particular of the first alignment region. Thereafter, the substrate 02 is preferably aligned in terms of the skewed position. This advantageously ensures that the substrate 02 is aligned by all transport sections 706 in contact therewith, that is, does not experience any force and/or moment working against the alignment by the relevant transport sections 706. Compared to the first embodiment, it is advantageously not necessary to axially return the transport sections 706 during the alignment of the identified skewed position. The at least one main drive M of the at least one first transport sub-section 707 drives the at least one first transport sub-section 707 at a first speed, while the at least one main drive M of the at least one second transport sub-section 708 drives the at least one second transport sub-section 708 at a second speed. The at least one main drive M for driving the at least one first transport sub-section 707 drives at least two, preferably at least four, more preferably all, first transport sub-sections 707, following one another in the transport direction T, of at least two, preferably at least four, more preferably all, transport sections 706 of the transport sections 706 of the at least one first alignment region. In addition or as an alternative, the at least one main drive M for driving the at least one second transport sub-section 708 drives at least two, preferably at least four, more preferably all, second transport sub-sections 708, following one another in the transport direction T, of at least two, preferably at least four, more preferably all, transport sections 706 at least of the transport sections 706 of the at least one first alignment region. The at least two first transport sub-sections 707 following one another in the transport direction T are preferably driven at the same speed. The at least two second transport sub-sections 708 following one another in the transport direction T are preferably driven at the same speed. Preferably, in each case at least as many transport sections 706, in particular as many transport elements 701 arranged one behind the other in the transport direction T, as are located within the length of the distance along the alignment segment 750 in the transport direction T are driven together by the at least one main drive M, wherein the length corresponds to the length of the at least one working zone of the at least one plate cylinder 616; 901 of the at least one processing unit 600; 900 of the processing units 600; 900. The design of the alignment segment 750 is advantageously simplified.

The at least one transport sub-section 707; 708 at which the substrate 02 is arranged further downstream in the transport direction T with at least part of the leading edge 03 thereof is preferably driven at a slower speed, relative to the speed of the respective other at least one transport sub-section 707; 708 of the at least one transport section 706. For example, in addition or as an alternative, the transport sub-section 707; 708 at which the substrate 02 is arranged further upstream in the transport direction T with at least part of the leading edge 03 thereof is preferably driven at a faster speed, relative to the at least one further transport sub-section 707; 708 of the relevant transport section 706. For example, the at least one main drive M of the first transport sub-sections 707 drives the at least one first transport sub-section 707, preferably all first transport sub-sections 707 coupled to the main drive M, at the first speed $v_1$, while the at least one main drive M of the second transport sub-sections 708 drives the at least one second transport sub-section 708, preferably all second transport sub-sections 708 coupled to the main drive M, at a second speed $v_2$, with the speeds preferably being different relative to one another. For example, the first speed $v_1$ is lower than the second speed $v_2$. For example, either the first speed $v_1$ or the second $v_2$ is identical to the initial speed $v_0$ or both speeds $v_1$; $v_2$ differ from the initial speed $v_0$.

When the substrate 02 reaches the target position thereof, that is, the aligned state with respect to the skewed position thereof, the main drives M of the first transport sub-sections 707 and of the second transport sub-sections 708 are preferably synchronized with one another, in particular the speed of the movement in the circumferential direction, preferably of the rotational movement, of the transport sub-sections 707; 708 relative to one another. For example, the transport sub-sections 707; 708 are again driven at the initial speed $v_0$ or at the first speed $v_1$ or at the second speed $v_2$ or at a further speed different therefrom. For example, as soon as the at least one substrate 02 has left the active region of the transport sections 706 of the first alignment region, preferably as soon as the substrate 02 no longer has direct contact with at least one transport section 706, which is driven by at least one of the main drives M of the first alignment region, the at least one main drive M, preferably the at least one main drive M of the at least one first transport sub-section 707 and/or the at least one main drive M of the at least one second transport sub-section 708, drives the at least one transport sub-section 707; 708, preferably the respective coupled transport sub-sections 707; 708, again at the initial speed $v_0$.

Above and below, the rotational driving of a transport section 706 or of a transport sub-section 707; 708 preferably describes the rotational driving of the at least one shaft 739 thereof and/or of the at least one transport element 701 thereof.

The alignment of the skewed position is preferably completed before the substrate 02 is detected by the at least one second sensor 704 for substrate alignment. This advantageously dispenses with the need to take the skewed position of the substrate 02 into consideration during the axial alignment.

In the preferred second step, the at least one substrate 02 is preferably aligned with respect to the axial position thereof. Preferably, the at least one second alignment region is activated. In the preferred second step, the at least one second alignment region of the at least three alignment regions of the alignment segment 750 for aligning an axial offset is preferably activated based on ascertained data. More preferably, in the preferred second step, the at least one second alignment region of the at least three alignment regions of the at least one alignment segment 750 for aligning an axial offset is activated, preferably by the at least one control unit, based on data of the at least one sensor 704 for substrate alignment, preferably of the at least one second sensor 704 for substrate alignment. Along the at least one alignment segment 750, preferably in the transport direction T after the at least one first sensor 704 for substrate alignment, the at least one second sensor 704 for substrate alignment preferably detects the positioning of a substrate 02 with respect to the axial position thereof. The at least one second sensor 704 for substrate alignment is preferably connected to the at least one control unit of the at least one second alignment region. The at least one transport section 706 for the axial adjustment is preferably activated based on the detection of the at least one image-producing element of the substrate 02. In the second step, the at least one second sensor 704 for substrate alignment preferably detects the substrate 02 within the second alignment region, preferably in the transport direction T after at least one transport section 706 comprising at least one dedicated drive $M_E$ for the axial adjustment and before at least one transport section 706 comprising at least one dedicated drive $M_E$ for the axial adjustment of the at least one second alignment region. For example, as an alternative, the data are ascertained elsewhere in the processing machine 01, for example in the infeed device 300 or the feeder 100 and stored in the at least one control unit. For example, at least one sensor which detects an edge 03; 04 of the substrate 02, and thus preferably the presence thereof in the region of the alignment segment 750, is then arranged at the position along the transport direction T of the at least one second sensor 704 for substrate alignment, wherein the control unit activates the alignment region when a presence is detected. The axial position of the substrate 02 relative to a reference and/or target position is preferably determined based on ascertained data, preferably by the at least one control unit. The at least one substrate 02 is preferably axially aligned in the at least one second alignment region and/or in the second step, preferably with respect to the axial offset thereof in the transverse direction A.

The at least one transport section 706 of the transport sections 706 of the at least one alignment segment 750, preferably of the at least one second alignment region, is adjusted axially, that is, in the transverse direction A. In particular in the second step, the at least one dedicated drive $M_E$ axially adjusts the at least one transport section 706 of the transport sections 706 of the at least one second alignment region. The at least one control unit preferably controls the at least one dedicated drive $M_E$ for the axial adjustment based on the sensor detection by the at least one second sensor 704 for substrate alignment. Preferably, at least one dedicated drive $M_E$, which is arranged in front of the at least one second sensor 704 for substrate alignment in the transport direction T, is activated for axially adjusting at least one transport section 706 and/or at least one dedicated drive $M_E$, which is arranged after the at least one second sensor 704 for substrate alignment in the transport direction T, is activated for axially adjusting at least one transport section 706. Preferably when a lateral offset of the substrate 02, that is, a deviation from the target position in the transverse direction A, is identified by the at least one preferably second sensor 704 for substrate alignment, which is preferably connected to the at least one transport section 706 of the at least one second alignment region of the at least one alignment segment 750, more preferably to the at least one transport element 701 thereof, the at least one transport section 706, preferably at least the at least one transport element 701, is moved counter to the lateral offset, preferably in or counter to the transverse direction A. The at least one transport section 706 is preferably moved from the basic position thereof toward the at least one adjustment position. The adjustment movement is carried out in a manner driven by the at least one dedicated drive $M_E$. The axial movement preferably takes place independently of a movement in the circumferential direction, preferably of the rotational movement, of the at least one transport section 706, in particular the transport element 701 thereof.

In particular, both the at least one first and the at least one second transport sub-section 707; 708 of the at least one transport section 706 are moved axially, preferably together. This advantageously makes the design and/or activation easier.

For example, the adjustment of the transport sections 706, in particular of the transport elements 701 thereof, groupwise or individually, is in each case carried out for those transport elements 701 that are in contact with the substrate 02. All transport sections 706, preferably all transport elements 701, that are being axially adjusted are preferably adjusted in the same direction, that is, in or counter to the transverse direction A. This means that the adjustment positions of all transport sections 706 that are axially adjusted during this alignment are preferably arranged in the same direction relative to the basic position, that is, in the transverse direction A before or after the basic position. The return movement accordingly takes place in the opposite direction.

Within the at least one alignment segment 750, in particular within the at least one second alignment region, preferably at least one first group comprising at least two, preferably at least three, more preferably at least four, transport sections 706 of the plurality of transport sections 706 following one another in the transport direction T and at least one second group comprising at least two transport sections 706 of the plurality of transport sections 706 following one another in the transport direction T follow one another in the transport direction T. The at least one first group comprising at least two transport sections 706 of the transport sections 706 of the at least one second alignment region and the at least one second group comprising at least two transport sections 706 of the transport sections 706 of the at least one second alignment region preferably follow one another in the transport direction T. The transport sections 706 of the at least one first group and the transport sections 706 of the at least one second group preferably each have the basic position and the at least one adjustment position, wherein the at least one adjustment position is in each case offset relative to the basic position in the transverse direction A. The transport sections 706 of the at least one first group and/or the transport sections 706 of the at least one second group are preferably each adjusted from the basic position into the at least one adjustment position thereof, and/or vice versa, by the at least one dedicated drive $M_E$ for the axial adjustment.

Preferably, the at least one first group comprises at least two, preferably at least three, more preferably at least four, for example five or six, and/or preferably no more than eleven, more preferably no more than ten, consecutive transport sections 706. At least two, preferably at least three, more preferably at least four, transport sections 706 of the transport sections 706 of the at least one first group, that is, of the preferably consecutive transport sections 706 of the plurality of transport sections 706, preferably simultaneously guide at least one substrate 02, preferably a sheet 02. The substrate 02 is preferably transported in the transport direction T simultaneously by at least two transport sections 706 of the transport sections 706 of the at least one first group. The substrate 02, during the transport thereof, is thus preferably located in the active region of transport sections 706, in particular of at least two, preferably at least three, more preferably of at least four, transport sections 706 of the at least one first group. In a preferred embodiment, the at least one first group comprises at least two transport sections 706, in the active region of which the at least one substrate 02 is located, and the at least one first group preferably additionally comprises at least one transport section 706 which follows the at least two transport sections 706 in the transport direction T, that is, is preferably arranged downstream, in the transport direction T, from the substrate-guiding transport sections 706 of the at least one first group. This at least one following transport section 706 of the first group is preferably substrate-free, however due to the movement of the substrate 02 in the transport direction T preferably becomes substrate-guiding as the next transport section 706 of the transport sections 706 of the at least one alignment segment 750. The at least one first group thus preferably comprises at least two transport sections 706, in the active region of which the at least one substrate 02 is located, and the at least one first group preferably additionally comprises at least one substrate-free transport section 706 which follows the at least two transport sections 706 in the transport direction T. In other words, the first group preferably comprises at least two transport sections 706 designed as substrate-guiding transport sections 706 and at least one transport section 706 that follows the at least two substrate-guiding transport sections 706 in the transport direction T and is designed as a substrate-free transport section 706.

The at least one second group preferably comprises at least two, preferably at least three, consecutive transport sections 706. For example, the at least one second group preferably comprises no more than three consecutive transport sections 706. The transport sections 706 of the at least one second group are preferably substrate-free, preferably sheet-free, in other words, not substrate-guiding. Preferably, no substrate 02 is arranged in the active region of the transport sections 706 of the at least one second group. In the active region of at least one transport section 706, a substrate 02 to be transported, preferably sheet 02, is preferably held and/or transported and/or moved by this at least one transport section 706. For example, in the active region, the substrate 02 makes direct contact with the at least one transport element 701 of the transport section 706, in particular at the transport surface 702 thereof. For example, the length of the at least one second group, that is, preferably the substrate-free region between at least two consecutive substrates 02, along the transport direction T is at least 50 mm, preferably at least 60 mm, more preferably at least 80 mm, for example at least 150 mm. The length of the at least one second group, for example, is no more than 300 mm, preferably no more than 200 mm. For example, the length of the at least one second group is defined by the length of the distance that a substrate 02 travels during a machine cycle, preferably as the length of the distance that a substrate 02 travels during a machine cycle, minus the length of the substrate 02 in the transport direction between the leading edge 03 and trailing edge 04 thereof.

The at least one transport section 706 is preferably transferred from the basic position thereof into the at least one adjustment position by way of an adjustment movement. The at least one control unit preferably controls the adjustment movement of the at least one transport section 706, preferably based on data of the at least one preferably second sensor 704 for substrate alignment. The at least one control unit preferably activates the at least one dedicated drive $M_E$ for carrying out the adjustment movement of the at least one transport section 706. The at least one first group, in particular the transport sections 706 thereof, preferably carries out an adjustment movement in a direction from the respective basic position thereof into the at least one adjustment position thereof. Preferably, the at least one transport section 706 is, preferably at least two transport sections 706, more preferably at least three transport sections 706, more preferably at least four transport sections 706, of the transport sections 706 of the first group are adjusted from the basic position thereof toward the at least one adjustment position thereof. The transport sections 706 of the at least one first group preferably carry out the adjustment movement from the respective basic position thereof toward the at least one adjustment position simultaneously with one another at at least one point in time. For example, during the simultaneous adjustment movement, at least two transport sections 706 of the transport sections 706 are located at differing positions along the path between the basic position and the at least one adjustment position.

The axial adjustment of the at least one transport section 706 preferably in each case takes place from the basic position thereof. This advantageously makes the activation and computation of the adjustment path easier. The at least one transport section 706 carrying out the adjustment movement is preferably at least temporarily moved continuously or incrementally during the adjustment movement. The at least one transport section 706 is preferably accelerated from the axial idle position thereof until it has an axial adjustment speed. The at least one transport section 706 is then preferably moved at the axial adjustment speed, preferably until the at least one adjustment position has been reached. The substrate 02 preferably does not enter the active region of the at least one transport section 706 until this transport section has the axial adjustment speed. This advantageously prevents the acceleration of the transport section 706 from affecting the alignment of the substrate 02. In a preferred embodiment, the at least one substrate-free transport section 706 of the at least one first group accelerates to the axial adjustment speed before the substrate 02 enters the active region thereof, that is, before becoming substrate-guiding. The substrate-guiding transport sections 706 of the first group are preferably moved at the axial adjustment speed.

The at least one first group of transport sections 706 comprises a first number of transport sections 706. The number of transport sections 706 of the at least one first group is preferably dependent on the format of the substrate 02 to be aligned. Preferably, the length of the distance along the at least one alignment segment 750 in the transport direction T comprising consecutive transport sections 706, which carry out the adjustment movement simultaneously, more preferably comprising the transport sections 706 of the at least one first group, along the at least one alignment segment 750 is at least as long as the length of the at least one substrate 02 in the transport direction T, preferably the distance between the leading end of the substrate 02 and the trailing end of the substrate 02, that is, preferably between the leading edge 03 and the trailing edge 04 of the substrate 02. The length of the at least one first group along the at least one alignment segment 750 is preferably at least as long as a preferably contiguous, substrate-guiding region of the at least one alignment segment 750. The length of the distance along the at least one alignment segment 750 in the transport direction T comprising consecutive transport sections 706, which carry out the adjustment movement simultaneously, more preferably comprising the transport sections 706 of the at least one first group, is preferably at least as long as the length of the at least one working zone of the cylinder circumference in the circumferential direction of at least one plate cylinder 616; 901 of at least one processing unit 600; 900 of the processing machine 01, preferably of the plate cylinder 616 of the at least one application unit 600 and/or of the plate cylinder 901 of the at least one shaping unit 900. More preferably, the length of the distance along the at least one alignment segment 750 in the transport direction T of the at least one first group is at least as long as the length of the at least one working zone of the cylinder circumference in the circumferential direction of at least one plate cylinder 616; 901 of at least one processing unit 600; 900 of the processing machine 01, that is, in other words, preferably of the cylinder circumference of a plate cylinder 616; 901. The substrate 02 is thus advantageously axially aligned by all transport sections 706 in the active region of which the substrate is located.

In a preferred embodiment, the at least one first group comprises the at least one substrate-free transport section 706 which is arranged along the at least one alignment segment 750 downstream from the substrate-guiding transport sections 706 of the at least one first group. The length of the distance along the at least one alignment segment 750 of the at least one first group is thus preferably as long as the working zone of the cylinder circumference in the circumferential direction of the at least one plate cylinder 616; 901, plus the length of the distance along the at least one alignment segment 750 of the active region of the at least one substrate-free transport section 706 of the at least one first group. For example, the length of the at least one first group corresponds to the length of the at least one substrate 02 in the transport direction T, plus at least 5% of the length of the at least one second alignment region, preferably at least 10%, more preferably at least 15%.

The at least one transport section 706 is preferably transferred from the at least one adjustment position thereof into the basic position by way of a return movement. The at least one control unit preferably controls the return movement of the at least one transport section 706, preferably based on data of the at least one preferably second sensor 704 for substrate alignment. The at least one control unit preferably activates the at least one dedicated drive $M_E$ for carrying out the return movement of the at least one transport section 706. Preferably simultaneously with the adjustment movement of the at least one first group, at least one transport section 706 of the transport sections 706 of the at least one second group preferably carries out a return movement in a direction from the respective at least one adjustment movement into the basic position. More preferably simultaneously with the adjustment movement of the at least one first group, preferably at least two, preferably at least three and/or, for example, no more than three transport sections 706 of the transport sections 706 of the at least one second group carries out a return movement in a direction from the respective at least one adjustment movement into the basic position. The at least one transport section 706 of the transport sections 706 of the second group is preferably adjusted from the at least one adjustment position thereof toward the basic position thereof. Preferably, at least two consecutive transport sections 706 of the transport sections 706, that is, preferably at least two transport sections 706 of the transport sections 706 of the at least one second group, preferably carry out a movement toward the basic position, that is, preferably the return movement from the at least one adjustment position in the direction of the basic position, simultaneously with one another at at least one point in time. The duration of the time required until an adjustment and a return are completed, that is, in particular the duration of the time required for aligning a substrate 02, is advantageously reduced. For example, a transport section 706 of the at least one second group remains in the basic position thereof as soon as it has reached this position, preferably in particular until it switches into the at least one first group.

The at least one second group of transport sections 706 comprises a second number of transport sections 706. The number of transport sections 706 of the at least one second group is preferably dependent on the format of the substrate 02 to be aligned. Preferably, the length of the distance along the at least one alignment segment 750 in the transport direction T comprising consecutive transport sections 706, which carry out the return movement simultaneously, more preferably of the at least one second group, along the at least one alignment segment 750 is at most as long as the length of the at least one alignment segment 750 between two consecutive substrates 02, preferably the distance between a leading end and a trailing end of two consecutive substrates 02, that is, preferably between the trailing edge 04 of the forward substrate 02 and the leading edge 03 of the subsequent substrate 02. The length of the at least one second group along the at least one alignment segment 750 is preferably at most as long as a preferably contiguous, substrate-free region of the at least one alignment segment 750. The length of the distance along the at least one alignment segment 750 in the transport direction T comprising consecutive transport sections 706, which carry out the return movement simultaneously, which thus preferably belong to the at least one second group, is preferably at most as long as the length of the cylinder circumference in the circumferential direction of at least one plate cylinder 616; 901 of at least one processing unit 600; 900 of the processing machine 01, preferably of the plate cylinder 616 of the at least one application unit 600 and/or of the plate cylinder 901 of the at least one shaping unit 900, minus the length in the circumferential direction of the at least one working zone. The length of the distance along the at least one alignment segment 750 in the transport direction T comprising consecutive transport sections 706 which carry out the return movement simultaneously is thus preferably at most as long as the length of the cylinder circumference in the circumferential direction of the plate cylinder 616; 901 of a processing unit 600; 900, minus the length in the circumferential direction of the at least one working zone. The length of the distance along the at least one alignment segment 750 in the transport direction T comprising consecutive transport sections 706, which carry out the return movement simultaneously, which thus preferably belong to the at least one second group, is preferably at most as long as the length of the processing-free region of the plate cylinder 616; 901. More preferably, the length of the distance along the at least one alignment segment 750 in the transport direction T of the at least one second group is at most as long as the length of the cylinder circumference in the circumferential direction of at least one plate cylinder 616; 901 of at least one processing unit 600; 900 of the processing machine 01, that is, in other words, particularly preferably of the cylinder circumference of a plate cylinder 616; 901, minus the length in the circumferential direction of the at least one working zone. Advantageously, an alignment that is independent of the alignment of further substrates 02 is carried out for each substrate 02. As a result, the number of transport sections 706 that carry out the adjustment movement from the basic position toward the adjustment position simultaneously with one another at at least one point in time differs from the number of transport sections 706 that carry out the return movement from the at least one adjustment position toward the basic position simultaneously with one another at at least one point in time by at least one transport section 706. The length in the circumferential direction of the working zone is preferably greater than the length of the processing-free region of the plate cylinder 616; 901. In particular then, the number of transport sections 706 carrying out the adjustment movement, that is, of the first group, is preferably greater than the number of transport sections 706 carrying out the return movement.

In a preferred embodiment, the at least one first group comprises the at least one substrate-free transport section 706 which is arranged along the at least one alignment segment 750 downstream from the substrate-guiding transport sections 706 of the at least one first group. The length of the distance along the at least one alignment segment 750 of the at least one second group is thus preferably at most as long as the length of the cylinder circumference in the circumferential direction of at least one plate cylinder 616; 901 of at least one processing unit 600; 900 of the processing machine 01, that is, in other words, particularly preferably of the cylinder circumference of a plate cylinder 616; 901, minus the length in the circumferential direction of the at least one working zone as well as minus the length of the distance along the at least one alignment segment 750 of the active region of the at least one substrate-free transport section 706 of the at least one first group.

The return movement of at least one transport section 706 of the at least two transport sections 706, in particular of the at least one second group, preferably starts when a substrate 02 to be transported has left the active region of the particular at least one transport section 706. The return movement of the particular transport section 706 of the at least two transport sections 706 preferably starts when the trailing edge 04 of the substrate 02 to be transported has ended the contact with the particular transport section 706. The return movement of at least one transport section 706 of the at least two transport sections 706, in particular of the at least one second group, preferably ends before a succeeding substrate 02 enters the active region of the particular at least one transport section 706. The return movement of at least one transport section 706 of the at least two transport sections 706, in particular of the at least one second group, from the at least one adjustment position into the basic position preferably takes place within a distance between a trailing end of a substrate 02 leading in the transport direction T and a leading end of a subsequent substrate 02, that is, preferably between the trailing edge 04 of the forward substrate 02 and the leading edge 03 of the subsequent substrate 02. Advantageously, the transport of substrate 02 is not affected by the return movement, in particular since no substrate 02 is arranged in the active region of a transport section 706 carrying out the return movement.

The return movements of the at least two transport sections 706 of the transport sections 706 of the at least one second group preferably start and/or end in each case at differing points in time. This means that the start of the return movement from the at least one adjustment position toward the basic position of at least two transport sections 706 of the at least two transport sections 706 preferably takes place chronologically one after the other. The start of the particular return movement from the at least one adjustment position toward the basic position of the at least two transport sections 706, preferably of the at least two transport sections 706 of the at least one second group, more preferably takes place chronologically one after the other, preferably staggered. As a result, the efficiency of the at least one alignment segment 750 is advantageously increased.

A forward transport section 706, in the transport direction T, of the at least two transport sections 706, in particular of the at least one second group, preferably starts the return movement, that is, the return movement from the at least one adjustment position toward the basic position, earlier than a transport section 706 of the at least two transport sections 706 which succeeds in the transport direction T, preferably follows immediately thereafter and/or without further transport sections 706 therebetween. For example, during the simultaneous return movement, the at least two transport sections 706 of the transport sections 706 of the at least one second group are thus located at differing positions along the path between the basic position and the at least one adjustment position. The forward transport section 706, in the transport direction T, preferably reaches the basic position thereof earlier than the succeeding transport section 706. Preferably, at least three transport sections 706 of the transport sections 706 which follow one another in the transport direction T each have the basic position and the at least one adjustment position. The return movement of at least one third transport section 706, along the transport direction, of the at least three transport sections 706 preferably starts after the return movement of at least one transport section 706 arranged therebefore, in the transport direction T, of the at least three transport sections 706 has started, preferably both after the start of the first and also after the start of the second transport section 706.

The at least one first group and/or the at least one second group preferably each comprise a constant number of transport sections 706 during an alignment process of at least one substrate 02. The association of a transport section 706 with the at least one first group and/or the at least one second group preferably changes over time, in particular with the transport of a substrate 02 along the at least one alignment segment 750. Since the substrate 02 is moved simultaneously, in particular simultaneously with an axial adjustment, in the transport direction T, preferably by means of the revolving movement preferably generated by the at least one main drive M, a further transport section 706, preferably at least one further transport element 701, makes contact with the substrate 02, while a first transport section 706, preferably at least one first transport element 701, in the transport direction T, of the transport unit 700 is no longer in contact with the substrate 02. This means that the at least one main drive M preferably rotationally drives at least one transport section 706 of the transport sections 706 simultaneously with an axial adjustment, wherein this at least one transport section 706 is preferably in operative contact with the substrate 02. The transport section 706, preferably the at least one transport element 701, that has now made contact is preferably likewise axially adjusted, in particular starting with the contact with the substrate 02. This transport section 706 has preferably joined the at least one first group of transport sections 706. The transport section 706, preferably the at least one transport element 701, that is no longer in contact is preferably axially adjusted in the opposite direction so as to return into the basic position. As a result, each further transport section 706, preferably each further transport element 701, that makes contact is preferably axially adjusted, while each transport section 706, preferably each transport element 701, ending the contact is axially adjusted in the opposite direction into the basic position thereof. The transport section 706 ending the contact preferably joins the at least one second group of transport sections 706. This means that the transport sections 706 of the first group preferably carry out the adjustment movement from the basic position toward the adjustment position simultaneously with one another at at least one point in time. The return movement of these transport sections 706 thus preferably starts at differing points in time, in particular in succession. In other words, the point in time of the start of the return movement, that is, preferably the point in time at which the return movement is carried out, toward the basic position thus differs for at least two of the transport sections 706 simultaneously carrying out the adjustment movement.

At least one transport section 706 of the at least one first group preferably switches to the at least one second group as soon as a substrate 02 to be transported, in particular the trailing end thereof, preferably the trailing edge 04 thereof, has left the active region of the at least one transport section 706. Advantageously, the transport section 706 having carried out the adjustment movement is thereafter returned into the basic position thereof again. After the return movement has been completed, at least one transport section 706 of the at least one second group preferably switches to the at least one first group of transport sections 706, preferably so as to align at least one succeeding substrate 02. The switch from the at least one second group to the at least one first group preferably in particular takes place when a further substrate 02 is to be aligned with the aid of this transport section 706.

The length of the distance along the at least one alignment segment 750 of a first group and of a subsequent second group is preferably as long as the length of the cylinder circumference in the circumferential direction of at least one plate cylinder 616; 901 of at least one processing unit 600; 900 of the processing machine 01, that is, in other words, particularly preferably of the cylinder circumference of a plate cylinder 616; 901. The adjustment movement and the return movement of a transport section 706 of the transport sections 706 preferably take place within a machine cycle, that is, preferably within a cylinder revolution of the at least one plate cylinder 616; 901. As a result, there is advantageously sufficient time and/or distance between two substrates 02 following one another to return the axially adjusted transport sections 706 into the basic position thereof before the succeeding substrate 02 arrives. The alignment segment 750 can thus advantageously react individually to the position of each substrate 02 for the alignment thereof. For example, this ensures that a substrate 02 can be axially aligned during a machine cycle.

Preferably, to compensate for a lateral offset, the substrate 02, preferably the sheet 02, is transported in the transport direction T until both the leading edge 03 and the trailing edge 02 can be moved by transport sections 706 of the at least one alignment segment 750, preferably transport sections 706 of the at least one second alignment region, more preferably transport elements 701 of this transport unit 700, preferably when no other transport elements 701 of further transport units 700 are in contact with the substrate 02. In the process, preferably at least the transport elements 701 that are in contact with the substrate 02 are preferably arranged in the basic position. Preferably, at least one group of transport sections 706 of the at least two transport sections 706 in particular of the at least one second alignment region, that is, preferably a group of transport sections 706 comprising the at least one dedicated drive $M_E$, starts the adjustment movement from the basic position toward the at least one adjustment position together. In particular, these are the transport sections 706 that are adjusted as first transport sections 706 of the at least one second alignment region in response to the sensor detection by the at least one preferably second sensor 704 for substrate alignment for aligning the detected substrate 02.

The length of the group of transport sections 706 starting the adjustment movement together along the at least one alignment segment 750 is preferably as long as the length of the distance comprising the at least one first group of transport sections 706. The transport sections 706 of the at least one first group, which are the first transport sections 706 of the at least one alignment segment 750 to carry out an axial adjustment for aligning the particular substrate 02, preferably form the group of transport sections 706 that start together. The length of the distance along the at least one alignment segment 750 of the at least one group of transport sections 706 starting the adjustment movement together is preferably at least as long as the working zone of the cylinder circumference in the circumferential direction of the at least one plate cylinder 616; 901, more preferably as long as the working zone of the cylinder circumference in the circumferential direction of the at least one plate cylinder 616; 901, plus the length of the distance along the at least one alignment segment 750 of the active region of the at least one substrate-free transport section 706 of the at least one first group.

The transport sections 706 of the at least one second alignment region which follow the at least one group of transport sections 706 starting the adjustment movement together preferably start the adjustment movement individually, preferably in succession, more preferably in each case before the substrate 02 to be transported enters the active region thereof. The transport section 706 joining the at least one first group as the next transport section 706 preferably starts the adjustment movement from the basic position toward the at least one adjustment position before becoming substrate-guiding, that is, before the substrate 02 enters the active region thereof. The adjustment movement from the basic position toward the at least one adjustment position of at least one further transport section 706 following in the transport direction T preferably starts chronologically later than the adjustment movement of the transport sections 706 arranged therebefore in the transport direction T.

The at least one transport section 706, preferably at least the at least one transport element 701, more preferably all transport sections 706, in particular all transport elements 701, of the transport unit 700 which are in contact with the substrate 02, are axially adjusted, preferably by means of the at least one dedicated drive $M_E$. In particular, the at least one first group is axially adjusted. This advantageously ensures that the substrate 02 is adjusted by all transport sections 706 in contact therewith, that is, does not experience any force and/or moment working against the adjustment by the relevant transport sections 706.

The at least one transport section 706 of the at least one alignment segment 750 preferably travels the distance between the basic position thereof and at least one adjustment position during the axial adjustment. At least two transport sections 706 of the at least two transport sections 706, preferably at least two transport sections 706 of the transport sections 706 of the at least one second alignment region, each having a basic position and at least one adjustment position, preferably travel lengths of the path from the basic position thereof to the at least one adjustment position thereof, and/or vice versa, which differ relative to one another. In particular during the alignment of the one substrate 02, the at least two transport sections 706 travel differing lengths of the path. Advantageously, the length of the path is adapted, preferably customized, to the actually present axial offset of the substrate 02 to be aligned. In a preferred embodiment, at least one transport section 706 of the transport sections 706 of the alignment segment 750, preferably at least at least one transport element 701 of the transport unit 700, is axially adjusted until the lateral offset of the substrate 02 has been compensated for, that is, the actual position thereof corresponds to the target position. For example, the at least one control unit computes the distance between the basic position and the adjustment position to be moved into for the at least one transport section 706, preferably for all transport sections 706 to be axially adjusted.

In a preferred embodiment, the axial offset of a substrate 02 to be transported is incrementally compensated for by the at least two transport sections 706, in particular the transport sections 706 of the at least one second alignment region, in each case with a basic position and at least one adjustment position. Incrementally preferably denotes a manner of stages that each progress from the one before, wherein the sum of the axial adjustments of the involved transport sections 706 preferably aligns the substrate 02 in terms of the axial offset. Preferably, at least two transport sections 706 take over, preferably each transport section 706 involved in the axial alignment takes over, a part of the axial distance which is necessary for a complete alignment of the substrate 02. The distance that is necessary for the axial alignment of the substrate 02 is preferably divided among at least two, preferably at least four, more preferably at least eight, more preferably at least eleven, more preferably all, transport sections 706 of the transport sections 706 of the at least one second alignment region. Advantageously, the distance of the axial adjustment to be carried out by the individual transport section 706 is minimized. This advantageously protects the components and makes the activation thereof easier.

At least one transport section 706 of the at least one first group and at least one further transport section 706 of the at least one first group preferably travel differing lengths of the path from the basic position into the at least one adjustment position. The adjustment movement from the basic position toward the at least one adjustment position is preferably carried out by the at least one transport section 706 of the at least two transport sections 706, preferably the at least one transport section 706 of the at least one first group, until the at least one adjustment position is reached and/or until the substrate 02 to be aligned leaves the active region of the transport section 706. The adjustment, for example, is carried out incrementally or continuously, in particular as long as the contact exists between the particular transport section 706, preferably the transport element 701, and the substrate 02 and/or until the at least one adjustment position is reached.

The at least one transport section 706 of the at least two transport sections 706, preferably the at least one transport section 706 of the at least one second alignment region, preferably remains in the adjustment position until the substrate 02 to be aligned has left the active region thereof. When the aligned state of the substrate 02 is reached, the transport sections 706 arranged in the adjustment position thereof preferably remain in the adjustment position until the substrate 02 leaves the particular active region thereof.

At least two transport sections 706 of the at least one alignment segment 750, preferably of the at least one second alignment region, preferably of the transport sections 706 having the basic position and at least one adjustment position, preferably travel differing lengths of the path from the at least one adjustment position into the basic position. At least one transport section 706 of the at least one second group and at least one further transport section 706 of the at least one second group preferably travel differing lengths of the path from the at least one adjustment position into the basic position. In particular, during the return movement the transport sections 706 only travel the length of the path which they traveled earlier during the adjustment movement in the opposite direction. Advantageously, the at least one, preferably each, transport section 706 is arranged in the basic position thereof again after the return movement thereof. Advantageously, a succeeding adjustment movement starts from the basic position again.

The minimum length of the path between the basic position and the at least one adjustment position of all transport sections 706 carrying out an adjustment movement for the alignment of the one substrate 02 is preferably at least 0.01 mm (zero point zero one millimeters), preferably at least 0.05 mm (zero point zero five millimeters), more preferably at least 0.1 mm (zero point one millimeters). The maximum length of the path between the basic position and the at least one adjustment position of all transport sections 706 carrying out an adjustment movement for the alignment of the one substrate 02 is preferably at least 0.1 mm (zero point one millimeters), preferably at least between 0.1 mm and 0.5 mm, and/or no more than 25 mm (twenty-five millimeters), preferably no more than 15 mm (fifteen millimeters), more preferably no more than 10 mm (ten millimeters), more preferably no more than 8 mm (eight millimeters), more preferably no more than 5 mm (five millimeters), more preferably no more than 4.0 mm (four point zero millimeters), more preferably no more than between 3.0 mm and 4.0 mm. Preferably, the at least one transport section 706, preferably the at least one transport element 701, is axially adjusted and/or is maximally adjustable by no more than 25 mm (twenty-five millimeters), preferably by no more than 15 mm (fifteen millimeters), more preferably by no more than 10 mm (ten millimeters), more preferably by no more than 8 mm (eight millimeters), more preferably by no more than 5 mm (five millimeters), more preferably by no more than 4 mm (four millimeters), more preferably by no more than 3 mm (three millimeters), more preferably by no more than 2.5 mm (two point five millimeters). Preferably, the at least one transport section 706, preferably the at least one transport element 701, is preferably axially adjusted and/or at least adjustable by at least 0.1 mm (zero point one millimeters), preferably by at least 0.3 mm (zero point three millimeters), preferably by at least 0.5 mm (zero point five millimeters), more preferably by at least 1 mm (one millimeter). For example, the maximum length of the path between the basic position and the at least one adjustment position is structurally limited. For example, in addition or as an alternative, the maximum length of the path between the basic position and the at least one adjustment position is limited by the machine speed and/or the transport speed of the substrate 02. The machine speed is preferably directly proportional to the transport speed of the substrate 02.

At least one transport section 706 of the transport sections 706, in particular of the at least one second alignment region, travels a maximum length of the path between the basic position and the at least one adjustment position of all transport sections 706 carrying out an adjustment movement. For example, at least two, for example at least three, transport sections 706 of the transport sections 706 and/or no more than eight, preferably no more than six, transport sections 706 of the transport section 706 travel the path having the maximum length of the path between the basic position and the at least one adjustment position of all transport sections 706 carrying out an adjustment movement. The number of transport sections 706 having the maximum length of the path between the basic position and the at least one adjustment position of all transport sections 706 that carry out an adjustment movement is preferably dependent on the length of the substrate 02 to be aligned in the transport direction T. Preferably, the number of transport sections 706 having the maximum length of the path between the basic position and the at least one adjustment position of all transport sections 706 that carry out an adjustment movement is lower for a substrate 02 having a larger length in the transport direction T than for a substrate 02 having a shorter length in the transport direction T.

At least the at least one transport section 706 of the transport sections 706 preferably travels the maximum length of the path between the basic position and the at least one adjustment position of all transport sections 706 carrying out an adjustment movement which, at the start of the adjustment movement of all transport sections 706 for the alignment of a substrate 02, is the last transport section 706 arranged in the transport direction T, in the active region of which the substrate 02 is located, that is, which is preferably arranged downstream from the further transport sections 706 starting the adjustment movement. This is preferably at least the transport section 706 of the group of transport sections 706 that start the adjustment movement together, which in the transport direction T is the last transport section 706 of the transport sections 706 starting the adjustment movement together, in the active region of which a substrate 02 to be transported is located at the start of the joint adjustment movement. This is preferably at least the transport section 706 of the group of transport sections 706 that start the adjustment movement together, in the active region of which the leading end, preferably the leading edge 03, of the substrate 02 to be aligned is located at the start of the adjustment movement.

The position along the at least one alignment segment 750, preferably along the at least one second alignment region, of the at least one transport section 706, which preferably has the maximum length of the path between the basic position and the at least one adjustment position, preferably corresponds at least to the position of the leading end, in the circumferential direction, of a working zone of at least one plate cylinder 616; 901 of at least one processing unit 600; 900, measured during an imaginary rolling motion of the working zone from the trailing end thereof, in the circumferential direction, to the leading end thereof along the at least one alignment segment 750, preferably along the at least one second alignment region, wherein the trailing end of the working zone during the rolling motion is arranged in the active region of a first transport section 706, in the transport direction T, of all transport sections 706 carrying out an axial adjustment for the alignment of this substrate 02.

At least one transport section 706 of the at least two transport sections 706, preferably of the at least one second alignment region, which is arranged before the at least one transport section 706, in the transport direction T, having the maximum length of the path between the basic position and the at least one adjustment position of all transport sections 706 carrying out an adjustment movement, preferably travels a shorter length of the path between the basic position and the at least one adjustment position than the at least one transport section 706 having the maximum length of the path. This at least one transport section 706 is preferably a transport section 706 of the group of transport sections 706 that start the adjustment movement together. The substrate 02 preferably leaves the active region of this transport section 706 before leaving the active region of the at least one transport section 706 having the maximum length of the path. The length of the distance that the particular transport section 706 travels between the basic position and the at least one adjustment position preferably increases from the first transport section 706, in the transport direction T, of the group of the transport sections 706 that start the adjustment movement together to the at least one transport section 706 having the maximum length of the path between the basic position and the at least one adjustment position. Within the group of the transport sections 706 that start the adjustment movement together, the at least one following transport section 706 preferably travels a larger distance from the basic position thereof into the adjustment position thereof than a forward transport section 706 in the transport direction T. The at least one transport section 706 preferably carries out the adjustment movement from the basic position toward the at least one adjustment position as long as the substrate 02 is arranged in the active region thereof. The at least one following transport section 706 of the group of the transport sections 706 that start the adjustment movement together is thus preferably adjusted for a longer duration from the basic position thereof into the adjustment position thereof than a forward transport section 706 in the transport direction T.

At least one transport section 706 of the at least two transport sections 706, preferably of the at least one second alignment region, which is arranged after the at least one transport section 706, in the transport direction T, having the maximum length of the path between the basic position and the at least one adjustment position of all transport sections 706 carrying out an adjustment movement, preferably travels a shorter length of the path between the basic position and the at least one adjustment position than the at least one transport section 706 having the maximum length of the path. For example, this at least one transport section 706 is a transport section 706 that follows the group of transport sections 706 that start the adjustment movement together. The length of the distance that the particular transport section 706 travels between the basic position and the at least one adjustment position preferably decreases from the at least one transport section 706 having the maximum length of the path between the basic position and the at least one adjustment position to the last transport section 706 of the transport sections 706 which carries out an adjustment movement for the alignment of a substrate 02, in particular of the at least one second alignment region. The substrate 02 preferably enters the active region of this transport section 706 after having entered the active region of the at least one transport section 706 having the maximum length of the path. The adjustment movement from the basic position toward the at least one adjustment position of the at least one further transport section 706 following in the transport direction T preferably starts chronologically later than the adjustment movement of the transport section 706 arranged therebefore in the transport direction T having the maximum length of the path between the basic position and the at least one adjustment position of all transport sections 706 carrying out an adjustment movement.

The at least one control unit preferably computes the distance between the basic position and the adjustment position to be moved into for the at least one transport section 706, preferably for all transport sections 706 to be axially adjusted. The computation of the maximum length of a path which a transport section 706 of the at least two transport sections 706 carries out during the adjustment from the basic position into the at least one adjustment position or from the at least one adjustment position into the basic position preferably comprises measurement data of an axial offset of the substrate 02 to be aligned and/or a value that is dependent on measurement data of an axial offset of the substrate 02 and/or the number of simultaneously substrate-guiding transport sections 706 and/or a value that is dependent on the number of simultaneously substrate-guiding transport sections 706 and/or the length of the substrate 02 to be aligned in the transport direction T and/or a value that is dependent on the length of the substrate 02 in the transport direction T and/or a length of the working zone of the at least one plate cylinder 616; 901 of the at least one processing unit 600; 900.

The at least one control unit preferably computes the axial adjustment speed, at which the at least one transport section 706 is preferably moved between the basic position thereof and the at least one adjustment position, for the at least one transport section 706, preferably for all transport sections 706 to be axially adjusted. The computation of the axial adjustment speed of at least one transport section 706 of the at least two transport sections 706 during the adjustment movement thereof from the basic position into the at least one adjustment position and/or during the return movement thereof from the at least one adjustment position into the basic position preferably comprises the machine speed at which a substrate 02 is being processed, and/or a value that is dependent on the machine speed and/or measurement data of an axial offset of a substrate 02 to be aligned and/or a value that is dependent on measurement data of an axial offset of the substrate 02 and/or the number of simultaneously substrate-guiding transport sections 706 and/or a value that is dependent on the number of simultaneously substrate-guiding transport sections 706 and/or the length of a substrate 02 to be aligned in the transport direction T and/or a value that is dependent on the length of the substrate 02 in the transport direction T and/or a length of the working zone of the at least one plate cylinder 616; 901 of the at least one processing unit 600; 900.

The at least one control unit preferably computes which transport section 706 of the at least two transport sections 706 is adjusted at which point in time from the adjustment position into the basic position and/or at which point in time from the basic position into the adjustment position. The computation as to which transport section 706 of the at least two transport sections 706 is adjusted at which point in time from the adjustment position into the basic position and/or at which point in time from the basic position into the adjustment position preferably comprises the number of simultaneously substrate-guiding transport sections 706 and/or a value that is dependent on the number of simultaneously substrate-guiding transport sections 706 and/or the length of a substrate 02 to be aligned in the transport direction T and/or a value that is dependent on the length of the substrate 02 in the transport direction T and/or the machine speed at which a substrate 02 is being processed and/or a value that is dependent on the machine speed and/or a length of the working zone of the at least one plate cylinder 616; 901 of the at least one processing unit 600; 900.

For example, at least two second groups of transport sections 706 are spatially separated from one another by at least one first group of transport sections 706 within the at least one alignment segment 750, in particular within the at least one second alignment region. In this way, preferably at least two transport sections 706 between two consecutive substrates 02 are free of substrate 02. In this way, time and/or space for the return movement is advantageously made possible before a succeeding substrate 02 is being aligned.

The substrate 02 preferably reaches the axial target position thereof at least at the last transport section of the at least one second alignment region of the at least one alignment segment 750. The substrate 02 preferably reaches the target position thereof, in particular the axial target position thereof, at least before the last transport element 701 of the at least one transport unit 700 of the at least one alignment segment 750. For example, if there are two transport units 700 of the alignment segment 750, which are designed for the substrate alignment and which are arranged following one another along the transport path, the substrate 02 preferably reaches the target position thereof at least before the last transport section 706 of the second transport unit 700 in the transport direction T. The alignment of the axial position is preferably completed before the substrate 02 is detected by the at least one third sensor 704 for substrate alignment. This advantageously dispenses with the need to take the skewed position and/or the axial position of the substrate 02 into consideration during the alignment in the circumferential direction.

For example, the axial position and/or skewed position of the substrate 02 are detected by the at least one third sensor 704 for substrate alignment and/or, for example, checked by the at least one control unit.

In the preferred third step, the at least one substrate 02 is preferably aligned with respect to the position thereof in the circumferential direction. An offset in the circumferential direction preferably denotes that the substrate 02 deviates from the target position thereof along the transport path in the transport direction T, that is, the coordinate of the transport direction T of the actual position of the substrate 02 preferably deviates from the coordinate of the transport direction T of the target position. The detection of the substrate 02 for the alignment in the circumferential direction and/or the alignment thereof in the circumferential direction advantageously takes place as close as possible to the succeeding processing point 621; 910, whereby a particularly high accuracy of the processing operation is achieved. Preferably, the at least one third alignment region is activated. In the preferred third step, the at least one third alignment region of the at least three alignment regions of the at least one alignment segment 750 for aligning an offset in the circumferential direction is preferably activated based on ascertained data. More preferably, in the preferred third step, the at least one third alignment region of the at least three alignment regions of the at least one alignment segment 750 for aligning an offset in the circumferential direction is activated, preferably by the at least one control unit, based on at least one sensor detection, preferably based on data of the at least one third sensor 704 for substrate detection and/or of the at least one sensor 622; 922 detecting a leading end of the substrate 02.

Along the at least one alignment segment 750, preferably in the transport direction T after the at least one second sensor 704 for substrate alignment and/or in the transport direction T after the at least one second alignment region, the positioning of a substrate 02 with respect to the position thereof in the circumferential direction is detected. For example, as an alternative, the data are ascertained elsewhere in the processing machine 01, for example in the infeed device 300 or the feeder 100 and stored in the at least one control unit. For example, at least one sensor which detects an edge 03; 04 of the substrate 02, and thus preferably the presence thereof in the region of the alignment segment 750, is then arranged at the position along the transport direction T of the at least one third sensor 704 for substrate alignment, wherein the control unit activates the alignment region when a presence is detected. The position of the substrate 02 in the circumferential direction relative to a reference and/or target position is determined based on ascertained data, preferably by the at least one control unit. The at least one substrate 02 is preferably aligned in the circumferential direction in the at least one third alignment region, which preferably follows the second alignment region in the transport direction T and which preferably comprises at least two transport sections 706, and/or in the third step.

Preferably, the at least one third sensor 704 for substrate alignment detects at least the position of the substrate 02 in the circumferential direction. For example, as an alternative, the at least one second sensor 704 for substrate alignment detects at least the position of the substrate 02 in the circumferential direction. Preferably, a relationship between a print image of the substrate 02 and the leading end of the substrate 02, preferably the leading edge 03, is established by the detection of at least one image-producing element of the substrate 02 by way of the at least one preferably third sensor 704 for substrate alignment. For this purpose, preferably at least the transport speed of the substrate 02 as well as the point in time of the detection by way of the at least one preferably third sensor 704 for substrate alignment and the point in time of the detection by way of the at least one sensor 622; 922 recognizing a leading end of the substrate 02 are taken into consideration. The determination of the relative positioning of the print image relative to the leading end of the substrate 02 is advantageously carried out within the alignment segment 750, preferably before the at least one succeeding processing unit 600; 900, in particular before the at least one shaping device 900.

Preferably, in addition or as an alternative to the detection of the actual position in the transport direction T by the at least one third sensor 704 for substrate alignment, the at least one sensor 622; 922 of the at least one alignment segment 750, which is arranged after at least 75% of the transport sections 706 of the at least one alignment segment 750 and detects a leading end of the substrate 02, detects the position of the substrate 02 in the circumferential direction. Preferably, the substrate 02, preferably the substrate 02 which has been aligned with respect to lateral offset and/or with respect to a skewed position, is detected by the at least one sensor 622; 922 assigned to the succeeding processing unit 600; 900 while being transported by means of the alignment segment 750, preferably by means of the at least one transport unit 700, preferably by recognition of the leading end of the substrate 02, preferably of the leading edge 03. The at least one sensor 622; 922 of the at least one alignment segment 750 which recognizes a leading end, preferably the leading edge 03, of a substrate 02 preferably recognizes the at least one substrate 02. The at least one sensor 622; 922 which recognizes a leading end, preferably the leading edge 03, of a substrate 02 preferably determines the arrival time of the substrate 02 in the detection zone thereof. The arrival time is preferably determined by means of the initial detection of the leading end of the substrate 02, preferably of the leading edge 03, in the at least one detection zone of the at least one sensor 622; 922 and is compared to the target time thereof, that is, the target position of the substrate 02 at this point in time.

The at least one control unit preferably determines a relative deviation of the substrate 02 from the target position in the circumferential direction based on the sensor detection by the at least one third sensor 704 for substrate alignment and/or based on the sensor detection by the at least one sensor 622; 922 recognizing a leading end of the substrate 02. The at least one control unit preferably computes the arrival time of the substrate 02 at the processing point 621; 910 of the processing unit 600; 900 following the at least one alignment segment 750, preferably the shaping device 900. In particular, the computation is carried out taking into consideration the arrival time of the substrate 02 in the detection zone of the at least one sensor 622; 922 recognizing a leading end, preferably the leading edge 03, of a substrate 02 and/or preferably taking into consideration the transport speed of the substrate 02 and/or preferably taking into consideration the detection by the at least one third sensor 704 for substrate alignment and/or preferably taking into consideration the relationship between print image and the leading end of the substrate 02. For example, the transport speed of the substrate 02 is determined by the machine speed.

As a result of the third step, the arrival time of a transported substrate 02 at the processing point 621; 910 in the processing unit 600; 900 following the at least one alignment segment 750, preferably the shaping device 900, is preferably adapted to a start of the processing operation of the substrate 02 in the processing unit 600; 900, preferably the shaping device 900. The arrival time of the working zone of the plate cylinder 616; 901 at the processing point 621; 910 and the arrival time of a region of the substrate 02 to be processed, in particular of the print image, at the processing point 621; 910 are preferably set relative to one another. If a deviation of the substrate 02 from the target position in the circumferential direction, that is, a deviation from the target position along the transport direction T, is identified, the substrate 02 is preferably aligned in the circumferential direction. If a deviation from the target position in the circumferential direction is present, that is, if offset in the circumferential direction is present, the at least one main drive M of the at least one third alignment region is preferably activated. In the third step, the at least one main drive M is preferably activated for generating a rotational movement of the at least one transport section 706 of the transport sections 706 of the third alignment region for aligning the offset in the circumferential direction. Preferably, the rotational movement of the at least one transport section 706 of the transport sections 706 of the at least one third alignment region is positively or negatively accelerated, preferably relative to the initial speed $v_0$. The at least one main drive M of the at least one third alignment region for aligning an offset in the circumferential direction preferably drives the at least two, preferably four, more preferably all, transport sections 706, arranged one behind the other in the transport direction T, of the transport sections 706 of the at least one third alignment region for aligning an offset in the circumferential direction.

The at least one main drive M of the at least one third alignment region preferably accelerates or decelerates the at least one transport section 706, preferably the at least one transport element 701, preferably at least the transport elements 701 that are in contact with the substrate 02, more preferably all transport elements 701 of the transport unit 700, in accordance with the comparison. In the case of the second preferred embodiment, the at least one main drive M of the at least one first transport sub-section 707 and the at least one main drive M of the at least one second transport sub-section 708 are preferably activated, preferably so as to bring the transport sub-sections 707; 708 to an identical speed relative to one another, by means of which the at least one substrate 02 is preferably accelerated or decelerated relative to the initial speed $v_0$. The substrate 02 is thus preferably accelerated or decelerated in the transport direction T and is thus transferred into the target position thereof. In a preferred embodiment, at least the last transport section 706, in the transport direction T, of the at least one third alignment region, preferably the last transport element 701 of the transport unit 700, only comprises the main drive M, that is, does not comprise a dedicated drive $M_E$. Preferably, the accuracy of the alignment of the substrate 02, in particular in the transport direction T, is increased by the multi-stage, preferably two-stage or preferably three-stage, alignment, that is, first the alignment with respect to lateral offset and/or a skewed position, and thereafter the alignment with respect to the transport direction T. For example, this alignment, in particular the alignment in the circumferential direction, is carried out at at least one transport unit 700 of the alignment segment 750 comprising a transport section 706 comprising at least one dedicated drive $M_E$ or at at least one further transport unit 700 of the alignment segment 750 which is arranged downstream from the at least one transport section 706 comprising the at least one dedicated drive $M_E$.

In a preferred embodiment, the alignment of the substrate 02 when laterally offset and the alignment of the substrate 02 when in a skewed position are carried out simultaneously. In an alternative preferred embodiment, in particular in the case of the second embodiment with respect to the main drives M, an alignment of the substrate 02 in the case of a skewed position is preferably carried out first, and the alignment of the substrate 02 in the case of lateral offset is carried out thereafter. For example, the alignment in the transport direction T is carried out simultaneously with the alignment of the substrate 02 when laterally offset and/or simultaneously with the alignment of the substrate 02 when in a skewed position. For a simultaneous adjustment, the adjustment values by means of the at least one dedicated drive $M_E$ are preferably superimposed. For example, as an alternative, the alignment in the transport direction T is carried out subsequent to the alignment of the substrate 02 when laterally offset and/or subsequent to the alignment of the substrate 02 when in a skewed position.

In a particularly preferred embodiment, the first step, the second step and the third step are carried out successively, preferably in this order. The alignments of the substrate with respect to skewed position, axial offset and position in the circumferential direction thus preferably take place successively. This advantageously achieves a particularly high accuracy of the alignment.

For example, data referred to as compensation data are taken into consideration during the activation of the at least one alignment segment 750, that is, in particular during the computation of the activation. For example, data regarding the properties of the surface of the substrate 02 and/or data regarding slippage of a substrate 02 which occurs during the transport thereof and/or data regarding the friction values between the substrate 02 and at least one transport surface 702 are taken into consideration in the computation of the activation data for activating the at least one alignment segment 750. These data are stored in the at least one control unit, for example. These data are empirically ascertained, for example. For the empirical ascertainment, for example, at least three, preferably at least ten, and/or no more than thirty, preferably no more than twenty, substrates 02 are conveyed as test substrates through the processing machine 02 and evaluated with respect to these data. These data are preferably taken into consideration during the processing operation of substrates 02 of a processing order for computing the activation data of the at least one alignment segment 750 and/or are considered in the computation. In this way a, preferably dynamic, control advantageously takes place, instead of a mere activation. The accuracy of the alignment is preferably increased.

In a further preferred embodiment, the at least one alignment segment 750 comprises at least two transport units 700, which are each designed for substrate alignment, and preferably are arranged one behind the other in the transport direction T. These are preferably arranged so as to directly adjoin one another. Preferably, each of these comprises at least two transport sections 706 of the transport sections 706. The at least one first transport unit 700 of the at least two transport units 700 and the at least one second transport unit 700 of the at least two transport units 700 designed for substrate alignment each preferably comprise at least two, preferably at least five, more preferably at least nine, more preferably at least eleven, transport sections 706, which are arranged one behind the other and/or following one another in the transport direction T. The at least two transport units 700 are preferably arranged at least between a processing unit 600; 900 preferably designed as an application unit 600 and a subsequent processing unit 600; 900 preferably designed as a shaping unit 900. Preferably, the at least two, for example two, transport units 700 are arranged consecutively between the two processing units 600; 900, preferably between the at least one application unit 600 and the at least one die-cutting unit 900, which are both preferably designed so as to cooperate with one another for aligning substrate 02. The at least two transport units 700 of the alignment segment 750 preferably each comprise at least one main drive M, preferably either a shared main drive M of the at least two transport sub-sections 707; 708 or at least two main drives M that are each assigned to at least one transport sub-section 707; 708. Preferably, at least two transport sections 706 of the transport sections 706, preferably the transport elements 701, each comprise a dedicated drive $M_E$. The first transport unit 700 of the two transport units 700 preferably comprises the at least one sensor 704 for substrate alignment, based on which the at least one transport section 706, preferably the at least one transport element 701, of the first transport unit 700, and preferably additionally the at least one transport section 706, preferably at least one transport element 701 of the second transport unit 700, are axially adjusted and/or adjustable. The second transport unit 700 preferably comprises at least one further sensor 704 for substrate alignment, which preferably checks an alignment of the substrate 02 that was carried out. Preferably, the last transport unit 700, which is arranged upstream from the die-cutting unit 900, comprises the at least one sensor 922 assigned to the die-cutting unit, preferably for recognizing the leading edge 03 of substrate 02. This last transport unit 700 is, for example, the second transport unit 700 for aligning substrate 02.

For example, at least two substrates 02 are aligned simultaneously at differing positions along the transport path in the transport direction T by the at least one alignment segment 750. For example, a substrate 02 is axially aligned by the at least one alignment segment 750, while a succeeding substrate 02 is aligned in terms of skew by the at least one alignment segment 750. For example, a leading substrate 02 is simultaneously aligned in the circumferential direction. Advantageously, as high a throughput of substrate 02 as possible is achieved.

Although the disclosure herein has been described in language specific to examples of structural features and/or methodological acts, it is to be understood that the subject matter defined in the appended claims is not necessarily limited to the specific features or acts described in the examples. Rather, the specific features and acts are disclosed merely as example forms of implementing the claims.

The invention claimed is:

1. A processing machine (01) for processing a substrate (02), the processing machine (01) comprising at least one alignment segment (750) being arranged before at least one processing unit (600; 900) of the processing machine (01); the at least one alignment segment (750) comprising a plurality of transport sections (706) following one another in a transport direction (T); the at least one alignment segment (750) comprising at least one dedicated drive (ME) for axially adjusting at least one transport section (706) of the plurality of transport sections (706); at least two transport sections (706) of the plurality of transport sections (706) comprising at least one first transport sub-section (707) and at least one second transport sub-section (708) in a transverse direction (A); the at least one first transport sub-section (707) and the at least one second transport sub-section (708) being drivable relative to one another at differing speeds in a circumferential direction; the at least one alignment segment (750) comprising at least one transport section (706) of the plurality of transport sections (706), which comprises the at least one dedicated drive (ME) for axially adjusting the at least one transport section (706) and the transport sub-sections (707; 708) that can be driven relative to one another at differing speeds in the circumferential direction; at least two first transport sub-sections (707), following one another in the transport direction (T), of the at least two transport sections (706), being connected to a first main drive (M) for driving the at least two first transport sub-sections (707), and at least two second transport sub-sections (708), following one another in the transport direction (T), of the at least two transport sections (706), being connected to a second main drive (M) for driving the at least two second transport sub-sections (708), the first main drive (M) differing from the second main drive (M), wherein the at least one processing unit (900) following the at least one alignment segment (750) is configured as a shaping unit (900), or the at least one processing unit (600) following the at least one alignment segment (750) is configured as an application unit (600).

2. The processing machine according to claim 1, characterized in that at least one spatial region (709; 710; 711) connecting the at least two transport sub-sections (707; 708) is provided between the at least two transport sub-sections (707; 708) of the at least one transport section (706) of the transport sections (706), and that the at least one first transport sub-section (707) is connected to the at least one second transport sub-section (708) by at least one spatial region (709; 711) configured as a coupling (709; 711).

3. The processing machine according to claim 1, characterized in that the at least one alignment segment (750) is arranged between two consecutive processing units (600; 900) and/or that the at least one alignment segment (750) is arranged between at least one processing unit (600) configured as an application unit (600) and at least one processing unit (900) configured as a shaping unit (900).

4. The processing machine according to claim 1, characterized in that the first main drive (M) of the at least one first transport sub-section (707) is configurable to drive the at least two first transport sub-sections (707) at a first speed, while the second main drive (M) of the at least two second transport sub-sections (708) is configurable to drive the at least two second transport sub-sections (708) at a second speed that differs from the first speed.

5. The processing machine according to claim 1, characterized in that the at least one dedicated drive (ME) is configurable to axially adjust the at least one first transport sub-section (707) and the at least one second transport sub-section (708) of the at least one transport section (706) together, and/or that the at least one dedicated drive (ME) is configured as a direct drive, and/or that at least two transport sections (706) of the transport sections (706) each comprise a dedicated drive (ME) for the axial adjustment.

6. The processing machine according to claim 1, characterized in that at least one of the first main drive (M) or the second main drive (M) is operatively connected to at least one respective transport sub-section (707; 708) by way of at least one gear train (731).

7. The processing machine according to claim 6, characterized in that gear wheels (732) of the at least one gear train (731) are configured so as to have a fixed position in the transverse direction (A) and/or that at least one gear wheel (732) of the gear train (731) is in each case arranged at the at least one respective transport sub-section (707; 708).

8. The processing machine according to claim 1, characterized in that the at least one alignment segment (750) comprises at least one sensor (704) for substrate alignment.

9. The processing machine according to claim 1, characterized in that central axes of the at least two transport sections (706) following one another in the transport direction (T) are located in one plane and/or that a transport path of substrate (02) is located beneath the central axes of the transport sections (706) and/or that the at least two transport sections (706) are arranged on one side of the transport path of substrate (02).

10. The processing machine according to claim 1, characterized in that at least one transport section (706) of the alignment segment (750) without axial adjustment is arranged upstream, in the transport direction (T), from the axially adjustable transport sections (706) of the at least one alignment segment (750).

11. A method for activating at least one alignment segment (750) of a processing machine (01), the at least one alignment segment (750) arranged before at least one processing unit (600; 900) of the processing machine (01) being activated; a plurality of transport sections (706) of the at least one alignment segment (750) following one another in a transport direction (T); at least one dedicated drive (ME) axially adjusting at least one transport section (706) of the plurality of transport sections (706); at least one transport section (706) of the plurality of transport sections (706) comprising at least one first transport sub-section (707) and at least one second transport sub-section (708) in a transverse direction (A); a first main drive (M) of the at least one first transport sub-section (707) driving the at least one first transport sub-section (707) at a first speed, while a second main drive (M) of the at least one second transport sub-section (708) drives the at least one second transport sub-section (708) at a second speed; the at least one alignment segment (750) comprising at least one transport section (706) of the plurality of transport sections (706), which comprises the at least one dedicated drive (ME) for axially adjusting the at least one transport section (706) and the transport sub-sections (707; 708) that can be driven relative to one another at differing speeds in a circumferential direction, characterized in that the first main drive (M) for driving the at least one first transport sub-section (707) drives at least two first transport sub-sections (707), following one another in the transport direction (T), of at least two transport sections (706) of the plurality of transport sections (706), and that the second main drive (M) for driving the at least one second transport sub-section (708) drives at least two second transport sub-sections (708), following one another in the transport direction (T), of at least two transport sections (706) of the plurality of transport sections (706), the first main drive (M) differing from the second main drive (M), wherein the at least one processing unit (900) arranged after the at least one alignment segment (750) is configured as a shaping unit (900), or the at least one processing unit (600) arranged after the at least one alignment segment (750) is configured as an application unit (600).

12. The method according to claim 11, characterized in that the at least one dedicated drive (ME) axially adjusts the at least one first transport sub-section (707) and the at least one second transport sub-section (708) of the at least one transport section (706) together and/or that the at least two transport sub-sections (707; 708) of the at least one transport section (706) of the plurality of transport sections (706) are connected by at least one spatial region (709; 710; 711) connecting the at least two transport sub-sections (707; 708).

13. The method according to claim 11, characterized in that the at least one alignment segment (750) arranged between two consecutive processing units (600; 900) is activated and/or that the at least one alignment segment (750) arranged between a first processing unit (600) configured as an application unit (600) and a second processing unit (900) configured as a shaping unit (900) is activated, and/or that at least one transport section (706) of the alignment segment (750) without axial adjustment is being arranged upstream, in the transport direction (T), from the axially adjustable transport sections (706) of the at least one alignment segment (750).

14. The method according to claim 11, characterized in that a transmission of torque by at least one of the first main drive (M) or the second main drive (M) to at least one respective transport sub-section (707; 708) takes place independently of a transmission of an axial movement from the at least one dedicated drive (ME) to the at least one transport section (706).

15. The method according to claim 11, characterized in that at least one of the first main drive (M) or the second main drive (M) drives a respective at least one transport sub-section (707; 708) of the at least one transport section (706) by way of at least one gear train (731).

* * * * *